US005836819A

United States Patent [19]

Ugawa

[11] Patent Number: 5,836,819

[45] Date of Patent: Nov. 17, 1998

[54] IMAGE DISPLAY TYPE GAME APPARATUS

[75] Inventor: Shouhachi Ugawa, Gunma, Japan

[73] Assignee: Kabushiki Kaisha Sankyo, Gunma, Japan

[21] Appl. No.: 652,039

[22] Filed: May 23, 1996

[30] Foreign Application Priority Data

May 26, 1995 [JP] Japan ..... 7-128509

[51] Int. Cl.[6] ..... A63F 7/30

[52] U.S. Cl. ..... 463/30; 273/121 B

[58] Field of Search ..... 463/25, 26, 27, 463/28, 30; 273/118 R, 119 R, 120 A, 121 A, 121 D, 122 A, 123 A, 124 A, 125 A

[56] References Cited

U.S. PATENT DOCUMENTS 5,131,655 7/1992 Ugawa ..... 273/121 B
5,509,655 4/1996 Ugawa .

FOREIGN PATENT DOCUMENTS 55-138474 10/1980 Japan .
1-254183 10/1989 Japan .
56-34373 4/1991 Japan .

*Primary Examiner*—George Manuel
*Attorney, Agent, or Firm*—McDermott, Will & Emery

[57] ABSTRACT

In an image display type game machine in which a play field is displayed by an image display apparatus, there are provided on the play field a left reel, a middle reel, a right reel, representing a variable display, and a plurality of pockets into which a flipped ball can enter. Upon establishment of a predetermined game starter condition, an image display is provided in which a ball is automatically flipped into the play field with the variable display device beginning to change its visual representation. When an image display is provided indicating a winning ball into any of the pockets, a credit of a relatively low amount is awarded to the player. When an image display is provided indicating a winning ball in all the pockets, or when the display result of the left, middle and right reels indicates a predetermined particular display result, credit of a relatively high amount is awarded to the player.

47 Claims, 49 Drawing Sheets

FIG. 35

CLEAR SOFT METER

DO YOU WANT TO CLEAR SOFT METER ?

IF YES, PRESS MAX-BET BUTTON
IF NO, PRESS CALL BUTTON

CALL
EXIT

MAX-BET
ENTER

FIG. 36

BILL-IN DATA

| | | |
|---|---|---|
| $1 | : | 5000 bills |
| $2 | : | 5000 bills |
| $5 | : | 5000 bills |
| $10 | : | 5000 bills |
| $20 | : | 5000 bills |
| $50 | : | 5000 bills |
| $100 | : | 5000 bills |
| TOTAL AMOUNT | : | $999,900 |

CALL
EXIT

IMAGE DISPLAY TYPE GAME APPARATUS

BACKGROUND OF THE INVENTION

1. Field of the Invention

The present invention relates to a game machine including a play field into which a game ball is entered to play a game.

2. Description of the Background Art

A game machine called a pinball game machine has conventionally been proposed. This pinball game machine has a play field in which balls roll down, and a player plays a game with the rolling balls. When the balls rolling down in the play field collide with certain obstacles, the balls are flipped and captured at indefinite probabilities during their downward travel of the irregularly changing routes, and consequently a predetermined reward is provided to the player.

A conventional pinball game of particular interest to the present invention is a Japanese pinball game of the type called "pachinko" which is popular in Japan.

Although the present invention is not limited to such a "pachinko" game machine, it is most widely applicable to a "pachinko" game machine.

A large number of such "pachinko" game machines are installed in a game house or a pachinko parlor, and a player goes to the game house and plays games with the "pachinko" game machines. In the game house, the player first buys a plurality of pachinko balls and inserts them into the "pachinko" game machine to play a game. The inserted balls are flipped one by one into a play field of the game machine by the player's manual operation. A number of protruding obstructive nails or pegs are arranged in the play field. The flipped balls fall down in irregularly changing routes while colliding with the obstructive nails. In the play field are further provided winning holes or pockets into which the rolling balls fall at indefinite probabilities. If any one of the balls falls into such a winning hole, a predetermined prize ball is dispensed to the player. The player flips the prize ball again into the play field, so that he or she can play the game again. The player can also preserve a large number of such prize balls and exchange them for some prizes prepared in the game house. The player can acquire prizes of his or her choice by winning the game in the "pachinko" game machine.

FIG. 60 is a front view of a pachinko game machine which is an example of a conventional game machine. This conventional pachinko game machine is disclosed in Japanese Patent Laying-Open No. 1-254183, for example.

Referring to FIG. 60, a door supporting frame 404 is mounted on a front game 403 serving as a member constituting a PACHINKO pinball game machine 401. A glass door frame 495 fitted with a glass plate is attached rotatably on door supporting frame 404. This glass door frame 495 opens/closes a play field 400 provided on the front face of a play board 406. This play field is a region in which flipped PACHINKO balls fall down along certain routes. A play value which is predetermined with a certain probability corresponding to the routes of the balls in the play field is awarded to the player.

A front panel 421 is provided beneath glass door frame 495. A flip ball supply tray 415 is provided in front of front panel 421. This supply tray 415 is formed so that PACHINKO balls can temporarily be stored therein.

In playing a game, the player first deposits coins into a PACHINKO ball lending machine installed at a predetermined site in a game house to obtain PACHINKO balls by a predetermined operation. Then, the player deposits the PACHINKO balls into supply tray 415. The player holds and turns with his/her hand a flipping operation handle 420 provided at the lower portion of PACHINKO ball game machine 401. In response, the PACHINKO balls stored in supply tray 415 are flipped into play field 400 one by one.

A variable display device 407 is provided substantially at the center of play field 400. A variable winning ball apparatus 429 is located beneath variable display device 407. Variable display device 407 can show in a variable manner plural types of identification information including numerals, designs, symbols, pictures and the like. Variable winning ball apparatus 429 is set such that when PACHINKO balls fall into variable winning ball apparatus 429, a predetermined play value is awarded to the player. Variable winning ball apparatus 429 can alternate between a first state which is advantageous for the player and a second state which is disadvantageous for the player. If any of the PACHINKO balls flipped into play field 400 by operation of flipping handle 420 falls into any of starter winning holes 431*a*, 431*b*, and 431*c* which are one type of starter passage holes, variable display apparatus 407 begins to change its display. At the elapse of a certain time period, the varying display of variable display apparatus 407 comes to a halt. A winning hole is a ball receiving port into which a ball flipped into a play field falls and enters. The winning hole is set such that when a ball is received, a predetermined play value is awarded to the player and the received ball is guided to the backside face of play board 406. A passage hole is a hole into which a ball flipped into the play field falls and enters. The passage hole is set such that a predetermined play value can be awarded to the player in response to entry of a ball into the passage hole. There are two types of passage holes: one through which a ball is guided to the backside face of play board 406, and the other through which a ball passes and is discharged back again into play field 400. In other words, the "passage" is a broad concept including the concept of "winning". The starter winning hole is one type of a winning hole, which is set to initiate the actuation of variable display device 407 (or variable winning ball apparatus 429 in some cases) as well as to award a predetermined play value to the player in response to entry of a flipped PACHINKO ball into the starter winning hole.

If the result of the display provided when variable display device 407 attains a stationary state matches a predetermined specific combination of identification information (e.g., 777), a partition 430 of variable winning ball apparatus 429 is opened to generate a "play value award enable" state, i.e., a bonus hit state, for the player. Play field 400 also includes normal winning holes 432 and 433. When PACHINKO balls fall into normal winning holes 432, 433 or variable winning ball apparatus 429, a predetermined number of prize balls are output from a prize ball outlet 416 into supply tray 415. Thus a play value is awarded to the player. The prize ball is a PACHINKO ball which is awarded to the player in response to a winning entry of a flipped ball profitable as a play value. When supply tray 415 becomes full of prize balls and no more balls can be stored therein, surplus prize balls are paid out through a surplus prize ball outlet 423 into a surplus prize ball receiving tray 422.

A lost ball port 433 serves to collect lost balls. PACHINKO balls flipped into play field 400 in response to the operation of shooting operation handle 420 and arriving at the bottom of play field 400 without falling into any winning hole or winning ball apparatus exit through lost ball port 433 to be collected. A mounting member 419 is provided for the purpose of mounting a ball shooting device 405 on front frame 3.

In a conventional pachinko game machine, a pachinko ball is flipped into play field 400 in response to manipulation of shooting operation handle 420 by the player. A play value is awarded to the player according to the route of the fall of the flipped ball. This conventional pachinko game machine is implemented so that the flipping force of a ball emitted into play field 400 according to the manipulation of shooting operation handle 420 by the player can be adjusted.

In such pachinko machines which are exemplary of conventional game machines, the results or score of the game is likely to depend on the players technique or skill of flipping the balls. The player could not just enjoy the game depending on one's luck or fortuity as in the games of a slot machine or roulette. A game apparatus by which a player can enjoy a game depending only on fortuity and not on his or her flipping skill is disclosed in U.S. Pat. No. 5,509,655.

FIGS. 61–63 show this game machine.

Referring to FIG. 61 showing the entire front view of this game machine 500, a coin inlet 518 through which a player deposits a coin is provided at a front cover panel 521. An exchange switch 522, a credit switch 524, a 1-bet switch 525, a maximum-bet switch 526, and a start switch 527 are provided on front cover panel 521.

The number of coins used in one game can be selected by the player in game machine 500. The player can define a game to play on one to three bets. When the player selects a 1-coin bet play, the play value awarded to the player in one game is a low one corresponding to the stake of one coin. When the player selects a 2-coin bet play, the play value awarded to the player in one game becomes a higher one corresponding to the stake of two coins. When the player selects a 3-coin bet game, the play value awarded to the player in one game becomes the maximum play value corresponding to three coins. Thus, a player can play for arbitrary high stakes.

When the player wants to play a game on a bet of one coin, the player inserts one coin into coin inlet 518, manipulates 1-bet switch 525 once, and depresses start switch 527. When the player wants to play a game on a bet of two coins, the player inserts two coins into coin inlet 518, manipulates 1-bet switch 525 two times, and depresses start switch 527. When the player wants to play a game on a bet of three coins, the player inserts three coins into coin inlet 518, manipulates 1-bet switch 525 three times, and depresses start switch 527. In the case of a 3-bet game, a game can be started by just depressing maximum-bet switch 526 after three coins are inserted into coin inlet 518. When a game is initiated as described above, flipped balls are automatically and sequentially emitted into a play field 506A. A variable display device 507 including variable display units 508A, 508B, and 508C that can provide variable display states of graphic representation such as a plurality of types of symbols and pictures is arranged at the middle of play field 506A. Variable display device 507 begins to provide a sequence of variable graphic representations simultaneous to the start of a game. When all the balls available for one game are flipped into play field 506A, the varying graphic representation of symbols attain a stationary state in the order of variable display units 508A, 508B and then variable display unit 508C. If the results of the stationary graphical representations show a combination of a particular graphic representation (for example, a straight arrangement of 777), the player wins bonus points, whereby a predetermined number of coins are discharged into a coin tray 538 from coin outlet 537.

Winning holes 509A–509D and a variable winning ball device (tulip) 510 are provided in play field 506A. Variable winning ball device 510 attains a first state which is advantageous for the player or a second state which is disadvantageous for the player. A number of coins are output according to the winning points of the balls. Similar to the pachinko game machine described above, obstacle nails are provided in game field 506A.

A game can be played by credit if the player depresses credit switch 520. In a credit game, a great number of coins are inserted at one time in advance and stored in game machine 500, instead of inserting predetermined number of coins required for each game. A game can be played by withdrawing the number of coins required for one game from the stored play value without having to insert a coin to play a game. When credit switch 524 is operated, the play value earned in a game by the player is not output, and the amount of the play value is stored within game machine 500.

When the flipped balls in play field 506A do not enter any winning pocket, the balls are guided to the back side of play board 506 through an outlet 511 to be collected.

FIG. 62 shows the structure of a ball queue mechanism 568 and flipping ball mechanism 548. The balls used in game machine 500 are enclosed within game machine 500 to be used in a circulating manner. Ball queue mechanism 568 includes a ball passage 570 in which balls are stored in a queuing state. Pachinko balls collected from play field 506A via outlet 511 are stored in ball passage 570. In this state, a rotation cam 581 is rotated by the rotation drive of a shooting ball motor 580. A pin 582*a* is provided at one end of a working plate 582 that rotates integrally with a flipping ball hammer 584. This flipping ball hammer 584 is energized towards the ball shooting direction by a spring (not shown). The rotary drive of rotation cam 581 causes pin 582*a* to be pushed downwards. Flipping ball hammer 584 swings backwards against the bias of the spring. Flipping ball hammer 584 rotates in the flipping direction by the restoring force of the spring while the abutment of cam 581 towards pin 582*a* is released. In response to the reciprocating rotation of flipping ball hammer 584, a cooperative elevation unit 575 moves upwards and downwards. According to the vertical movement, a ball forward member 576 swings about an axis 576*c*. Two holes 577*a* and 577*b* are provided at the trailing end of the downstream of the stored pachinko balls. Pachinko balls are stored in a manner in which a portion thereof is fitted in the hole. By the swing of ball forward member 576, pushing members 576*a* and 576*b* formed at the leading edge of ball forward member 576 pass through both holes 577*a* and 577*b* upwards to push pachinko ball upwards towards the right. Pachinko balls pushed up by push member 576*a* roll rightwards in the drawing to be accommodated in a fitted manner in hole 577*b*. In response to the next swing of ball forward member 576, the pachinko ball partially fitted in hole 577*b* is pushed up by ball push member 576*b* to be conveyed into a ball launching position. The pachinko ball located at the flip ball launching position is struck by hammer 584 to be emitted into game field 506A (refer to FIG. 61) through a shooting rail 571 and between inner and outer rails 553*a* and 553*b*.

When the flipping force is so weak that the pachinko ball flipped towards play field 506*a* does not reach play field 506A, the foul ball falls into a foul ball port 572 to pass through a foul ball passage 572*a*. The foul ball is output from a foul ball outlet 572*b* to be returned into ball passage 570.

Reference number 591 designates a substrate to which ball shooting mechanism 548 is attached. A flipping force fine-adjustment device 589 is provided in substrate 591.

Flipping force fine-adjustment device 589 adjusts the tension of the spring that biases hammer 584 in the flipping direction. A rotary member 588*a* is rotated by turning an adjustment knob 151 (refer to FIG. 63), whereby a gear 587 rotates to fine-adjust the tension of the spring biasing hammer 584 in the flipping direction. Thus, the flipping force can be fine-adjusted.

FIG. 63 shows a structure of a flipping force fine-adjustment device 589. An adjustment knob 651 is provided in flipping force fine-adjustment device 589. A disc 652 and a gear 654 are provided so as to rotate integrally with fine-adjustment knob 651. An operation knob 660 is provided beneath gear 654. An engagement protrusion 661 is provided to slide vertically in an integral manner with operation knob 660. A pin 662 protrudes from the back side of operation knob 660. A tension spring (not shown) is bridged over pin 662 and a fixed pin 663. The restoring force of this tension spring causes engagement protrusion 661 to be pulled upwards in the drawing so as to be engaged with a tooth of gear 654. A communication hole 653 is provided in disc 652. The protrusion of rotary member 588*a* (refer to FIG. 62) is fitted into communication hole 653. When the attendant or clerk of the game house presses operation knob 661 downwards against the tension spring, the engagement of engagement protrusion 661 is released from saw-tooth 657. By rotating adjustment knob 651, gear 587 (refer to FIG. 62) is rotated via disc 652 and rotary member 588*a* (refer to FIG. 62) to pull hammer 584 (refer to FIG. 62) in the flipping direction. As a result, the tension of the biasing spring is adjusted. Thus, the biasing force of hammer 584 towards the flipping direction is adjusted to regulate the flipping force. A stopper 658 abuts against tooth 654 to define the angle of rotation of adjustment knob 651. When adjustment knob 651 is rotated clockwise (in the direction to increase the flipping force), operation knob 660 does not have to be pressed downwards to rotate.

According to the above-described game machine 500, the flipping force can be adjusted in advance by an attendant of the game house. Therefore, the player can enjoy a game independent of his or her technique of a flipping operation.

The structure associated with adjustment of the flipping force in such a conventional game machine 500 is complicated. It is not always easy to uniformly adjust the flipping force for a plurality of game machines 500. Even if the flipping force is adjusted uniformly in game machine 500, the winning probability of a flipped ball entering a winning pocket differs depending on the orientation and angle of the obstacle nails arranged on play field 506A. It was difficult to provide control of game machine 500 as intended by the provider or manager of the game machine. Furthermore, there is a possibility of pachinko balls being jammed in the ball passage in a conventional game machine. Maintenance of the game machine was not easy.

The level of a play value awarded to the player when a flipped ball enters a winning region lacks variety in a conventional game machine. There was a disadvantage that the excitement or anticipation of a ball entering a winning region is reduced for the player. In a conventional pachinko machine 400 shown in FIG. 60, for example, with general winning holes 432 and 433 and starter winning holes 431*a*, 431*b* and 431*c*, the level of a play value awarded to the player was always the same when a flipped ball enters a winning hole regardless of the winning state. The same applies to game machine 500 shown in FIG. 61.

SUMMARY OF THE INVENTION

In view of the foregoing, an object of the present invention is to provide a game machine that can easily be controlled by the provider of the game.

Another object of the present invention is to provide a game machine by which a player can enjoy fortuity of a game independent of his or her game skill.

A further object of the present invention is to provide a game machine that can elevate the expectation of a player for a play value gain in association with entry of a flipped ball into a winning hole.

According to an aspect of the present invention, an image display type game machine includes an image display apparatus that can provide an image display of a play field, a flipped ball moving around the play field, and a variable display device that can cause the visual representation of the display to change. The image display type game machine includes a game starter condition detection unit for detecting establishment of a predetermined game starter condition, an automatic ball-shoot display control unit for providing an image display of a ball automatically flipped into the play field when the game starter condition detection unit detects establishment of a game starter condition, and a variable display control unit for providing an image display control of producing a display result after the variable display device begins to change its visual representation.

More specifically, the variable display control unit provides image display control of a state to produce a display result of the variable display device presented on the image display apparatus when the game starter condition detection unit detects that a game starter condition is established. The variable display control unit includes a display result determination unit for determining the display result of the variable display device, and a display control unit to provide control of the display content of the variable display device so that the display result is shown. The image display type game machine of the present invention further includes a display result value award unit for awarding a predetermined value to a player when the display result of the variable display device attains a predetermined particular display appearance.

The image display type game machine of the present invention includes a monetary object receptor for receiving a monetary object corresponding to a coin, and a monetary object reception detection unit for detecting that a monetary object is received in the monetary object receptor.

The variable display device includes a plurality of variable display units that can have the visual representation of the display changed. The variable display control unit includes a display time period control unit for providing the display result of the variable display units at different time periods after the device begins to change its visual representation. The game machine further includes a notify unit for notifying the establishment of a condition of a predetermined particular visual appearance when the display result of the variable display units satisfy the condition of the predetermined particular visual appearance at a stage where a variable display unit is still providing a varying visual representation. The variable display control unit includes a particular variable display appearance control unit for providing display control of a variable display unit still providing a varying visual representation so as to attain a variable display appearance different from that of when the condition for attaining the predetermined particular visual appearance is not satisfied, in the event that the display result of a variable display unit already producing a stationary display result satisfies the condition of the predetermined particular visual appearance while a part of the plurality of variable display units is still providing a varying visual representation.

The image display type game apparatus of the present invention further includes a bet count setting unit for setting a bet count that defines the dividend rate of a value awarded as a result of a play to a desired count value according to an operation of a player, and a value award unit for awarding a value to the player as a result of a game. The value award rate is defined by the bet count set by the bet count setting unit. The automatic ball-shoot display control unit provides an image display in which a ball is flipped towards the play field consuming the value of the predetermined monetary object. The consumption rate of the value of the monetary object used in the display of flipped balls is defined according to the predetermined bet count.

The image display type game machine of the present invention further includes a game control program memory in which a game control program that provides control of the play state of the image display type game machine is stored, an image control program memory in which an image control program that provides control of an image by the image display apparatus is stored, a data storage unit for storing data related to a game play operation of the image display type game machine, a game control program verification unit for determining whether the game control program is appropriate or not, an image control program verification unit for determining whether the image control program is appropriate or not, a storage data verification unit for determining whether the data stored in the data storage unit is appropriate or not, and a display control unit for displaying on the image display apparatus the determination results of the game control program verification unit, the image control program verification unit, and the storage data verification unit, and the cause of the fault when determination is made of inappropriateness.

The image display type game machine of the present invention includes an error determination unit for determining that an error is generated in the image display type game machine during a play, a game interrupt control unit for interrupting a play when determination is made of an error by the error determination unit, and a display control unit for displaying the cause of the error on the image display apparatus when determination of an error is made by the error determination unit.

The image display type game machine of the present invention further includes a total consumed-value calculation unit for calculating the total value consumed in a game out of the capital value owned by the player, a total awarded-value calculation unit for calculating the total value awarded to the player, and a display control unit for providing on the image display apparatus a display of the game play result status calculated from the total consumed-value calculation unit and the total awarded-value calculation unit when the manager of the game machine carries out a predetermined operation.

The image display apparatus of the image display type game machine of the present invention can provide a display of data for maintenance and administration, and includes a switching operation unit for switching the display screen of the image display apparatus between a play field region or a maintenance/administration data display.

According to another aspect of the present invention, an image display type game machine includes an image display apparatus that can provide an image display of a play field including a plurality of winning regions and a flipped ball moving in the play field. The image display type game machine includes a ball-shoot display control unit for providing an image display of the play field into which a flipped ball is emitted, a value award unit for awarding a predetermined value when an image display is provided indicating entry of a flipped ball into any of a plurality of winning regions, and a particular value award unit for awarding a particular value when a particular winning image display is provided indicating that flipped balls have entered all of a plurality of particular winning regions out of the plurality of winning regions.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 35 shows an image of CLEAR SOFT METER displayed in screen display region 6.

FIG. 36 shows an image of BILL-IN DATA displayed in screen display region 6.

DESCRIPTION OF THE PREFERRED EMBODIMENTS

An embodiment of the present invention will be described in detail with reference to the drawings.

Figure 1:
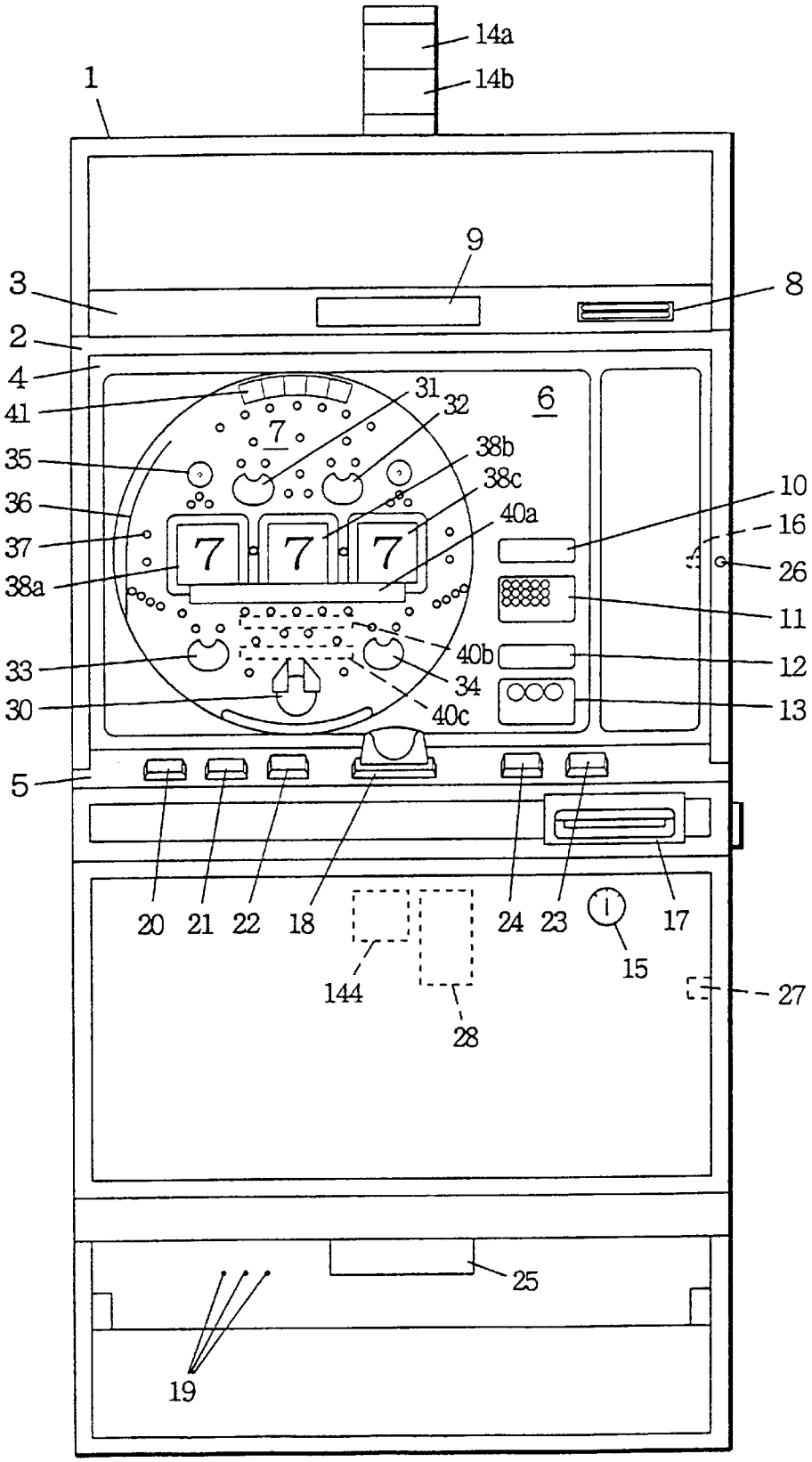
FIG. 1 is a front view of an image display type game machine 1.

Referring to FIG. 1, a front frame 2 is provided in an image display type game machine 1. A glass door frame 4 and a front cover panel 5 are provided in front frame 2 in a manner that can be opened/closed. Glass door frame 4 supports a glass plate covering the front of a play field 7 and a play board screen display region 6.

Figure 39:
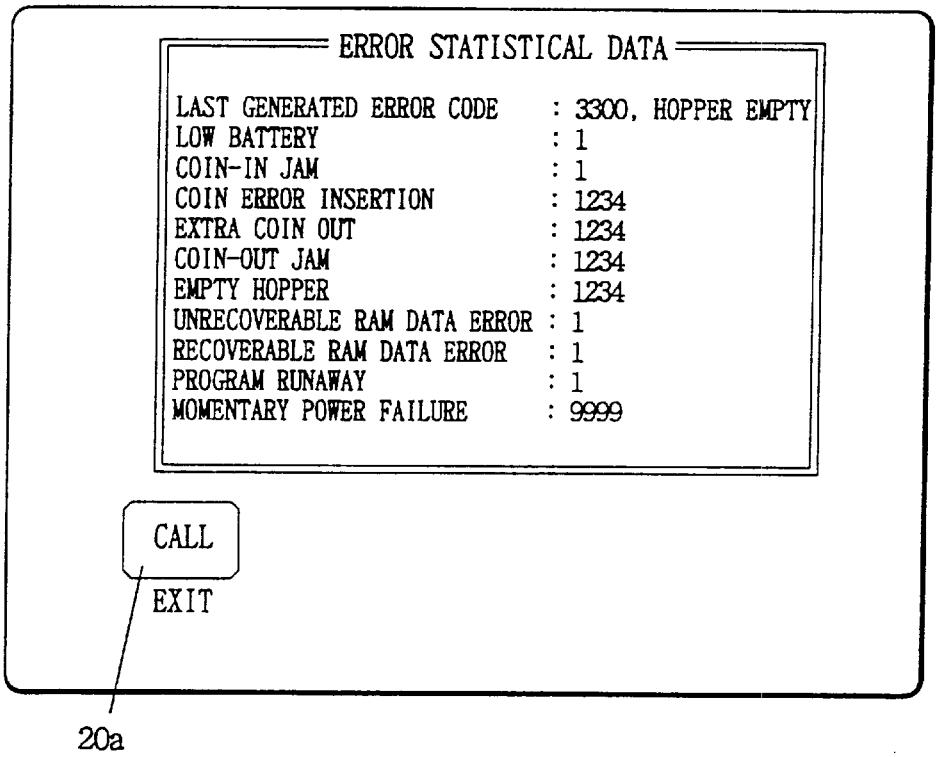
FIG. 39 shows an image of ERROR STATISTICAL DATA displayed in screen display region 6.

A key hole 26 is provided in front frame 2. An attendant, clerk or manager of the game house inserts a predetermined key into this key hole 26 to effect a release operation (for example, turn the key leftwise in the drawing), whereby glass door frame 4 attains an openable state. Opening of this glass door frame 4 is detected by a switch 16. When the key is turned rightwise in the drawing, front frame 2 and front cover panel 5 are released to be openable. A coin selector 144 and a coin sorter 28 are provided at the back side of front cover panel 5. Coin selector 144 determines whether the coin inserted via a coin inlet 18 is a proper coin or not. When the coin is not an appropriate coin, it is rejected to be output from a coin outlet 25. When the inserted coin is a proper one, coin selector 144 detects that proper coin to send a detection signal to a main substrate 140 (refer to FIG. 3). A "coin-in time out" state that will be described afterwards with reference to FIG. 39 is attained when a second sensor located downstream of the coin passage does not provide a coin detection signal within 200 msec., for example, after a first sensor located upstream of the coin passage provides a coin detection signal. Coin sorter 28 is provided to distribute an inserted coin either to a hopper 138 (refer to FIG. 3) in which coins are stored for payment, or to a collector bin or outlet 25. Coin sorter 28 operates to discharge the inserted coin into the collector bin side according to a signal from an overflow switch provided within hopper 138 upon detection of coin overflow in hopper 138. Hopper 138 is formed integrally with image display type game machine 1 and located at the back of front cover panel 5 so as to store coins distributed by coin sorter 28. A coin hopper motor (not shown) for driving hopper 138 is provided below hopper 138. A predetermined number of coins are dispensed through outlet 25 upon the rotary drive of this coin hopper motor. Opening of front cover panel 5 is detected by a door open switch 27.

A coin inlet 18 through which a player inserts a coin or a bill inlet 17 through which a player inserts a paper note are provided in front cover panel 5. A button 20 for calling an attendant or a clerk, a payment button 21 for settling the account, a 1-bet button 22 for betting on one coin, a maximum-bet button 23 (MAX-BET) for betting on the upper limit of a predetermined number of coins (3 coins), and a start button 24 for initiating a game are provided on front cover panel 5. An LED display is incorporated in each of these buttons. By depressing a relevant button, a lamp corresponding to the depressed button is turned on or lighted in a blinking manner. More specifically, each of buttons 20–24 is formed of the so-called illumination type switch.

A reset switch 15 exclusively for personnel of the game house to reset a game or to display administration data of image display type game machine 1, a coin outlet 25 through which coins are dispensed in response to depression of payment button 21, and a loud speaker 19 to elevate the game environment effect are provided in front cover panel 5.

Candle lamps 14*a* and 14*b* are provided at the top portion of image display type game machine 1. Candle lamps 14*a* and 14*b* are lighted in various different states to indicate a specific status of the game machine such as when front cover plate 5 or glass door frame 4 is opened, when a call button 20 is depressed, when there is some error or when "jackpot" has been hit during a play.

A card inlet 8 and a display unit 9 for indicating the consumed credit account are provided in a tracking system 3. If a player inserts a member's card issued by the game house inherent to the player, the count of the credit consumed in games by the player starting from the issuance of the card up to the present time is displayed in credit point display unit 9. As the credit is consumed in games thereafter, the consumed credit points are accumulated to be displayed on credit point display unit 9.

Play board screen display region 6 is formed of an image display of an image display device (not shown) mounted at the middle backside portion of image display type game machine 1. The image display is formed of a CRT, for example. Play board screen display region 6 of FIG. 1 includes play field 7, an earned point display unit 10, an available ball count display unit 11, a credit count display unit 12, and a game bet count display unit 13. A variety of types of image displays can be provided according to the game status on play board screen display region 6 for the purpose of improving the game effect.

Figure 2:
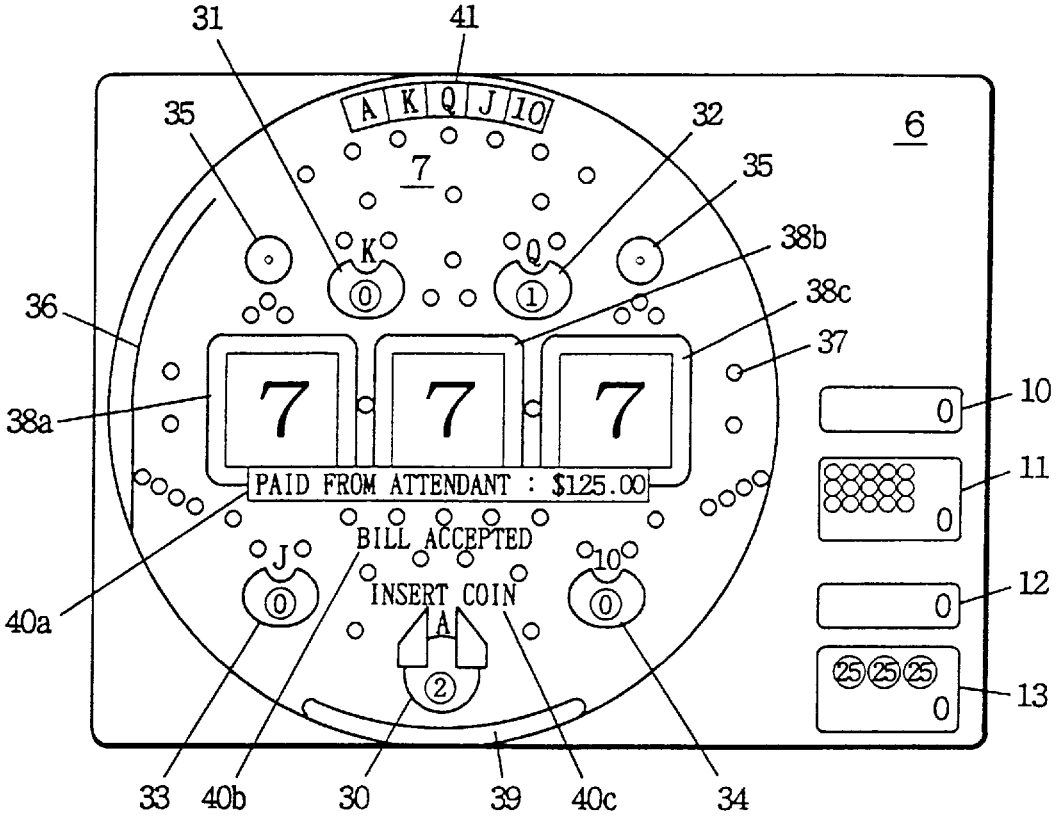
FIG. 2 shows a display of a play board screen display region 6 including a play field 7.

Referring to FIG. 2, play field 7 is displayed in play board screen display region 6 of image display type game machine 1. A flipped ball entering play field 7 passes through a partition rail 36 to collide with an obstacle nail 37 or a windmill 35 to change its travel direction in play field 7. The obstacle nail, windmill, ball and the like are provided as an image on the display. Realistic moving displays are provided so that windmill 35 seems to rotate as a real windmill on a play board by collision with a ball. Pockets 30–34 are winning regions in which flipped balls can enter. A predetermined credit is awarded to the player in response to entry of a flipped ball. Pockets 30–34 include winning count display regions for displaying the number of balls entering respective winning regions for each game. For example, a display of "0" in the winning count display region of pocket 31 indicates that a win has not yet been obtained. The display of "2" in pocket 30 indicates that there are two wins, i.e. two balls have entered that pocket. When at least one win occurs in all pockets 30–34, a "big hit" state it is attained, whereby a credit of a particular amount is awarded to the player. This big hit is particularly referred to as "pocket jackpot". When a win occurs in any of the pockets during a game play, a symbol or a numeral assigned to the relevant pocket is displayed in a light-up manner in a pocket win display region 41. When a win occurs in pocket 31, the corresponding display of "K" in pocket win display region 41 is lighted. Similarly the visual representations of "Q", "J", "10", and "A" light up when there is a win in pockets 32, 33, 34, and 30, respectively.

A pair of movable fragments in a shape of a tulip is displayed in pocket 30. Display is provided so that this pair of movable fragments are opened in the left and right directions so as to increase the entrance of pocket 30 in response to entry of a flipped ball into pocket 30. Display of an opened tulip provides the appreciation that entry of a flipped ball into pocket 30 is facilitated for the player.

Play field 7 includes message display regions 40*a*, 40*b*, and 40*c* in which various messages are displayed.

A region of a reel image provided by a variable display device is located at the middle of play field 7. A plurality of pictures or symbols are displayed in a variable manner rolling downwards. This region of reel image includes the displays of a left reel 38*a*, a middle reel 38*b*, and a right reel 38*c*. The graphic display of the symbols begin to whirl simultaneously at the start of a game play. The variable-displayed symbols are formed of a plurality of types of numerical pictures and a plurality of types of alphabets, or a combination of these symbols and a plurality of types of background colors.

At an elapse of a predetermined time from the start of the simultaneous rotation of the graphical representations at the start of a game, the rotation of left reel 38*a* halts to provide a stationary. Next, middle reel 38*b* provides a stationary display of a symbol. The certain state of the stationary picture of left reel 38*a* matching that of middle reel 38*b* at this time point is called a "leechi" state.

Following the halt of left reel 38*a* and then middle reel 38*b*, right reel 38*c* comes to a halt. When the display result at the stationary state matches a particular combination of a display appearance, a great hit state is achieved. This great hit is particularly referred to as "reel jackpot". This particular combination of a display appearance to establish a reel jackpot state is defined in the present embodiment as a straight 7 arrangement of the stationary symbols of left reel 38*a*, middle reel 38*b*, and right reel 38*c* with a background color of red. When a reel jackpot state is established, a credit of a high amount is awarded to the player. In addition to the combination for establishment of a reel jackpot, a hit is established at other predetermined combinations, whereby a predetermined credit corresponding to the hit will be awarded.

When a ball flipped into play field 7 does not enter any pocket (winning holes), it enters outlet 39 displayed on the screen.

All the images of play field 7 including the ball, partition rail 36, obstacle nail 37, windmill 35, pockets 30–34, pocket win display region 41, left reel 38*a*, middle reel 38*b*, and right reel 38*c* are provided in graphical representations.

The game play of the game machine of the present embodiment will be described hereinafter with reference to FIGS. 1 and 2. The game machine of the present embodiment employs a game system including a credit game system, for example. In a credit game system, it is not required to insert a coin for each game. A plurality of coins or paper notes can be inserted in advance to be stored as a capital value, or the earned monetary value obtained by a previous game play can be suppressed from being paid out to be stored as a capital value. A game can be played by drawing out the credit required for one game from the stored capital value. This credit game system is advantageous in that a game can continuously be played without having to insert a coin as long as there are monetary values left.

When a coin or a bill is inserted through coin inlet 18 or bill inlet 17, the capital value converted into the unit of monetary values required for one game is displayed in a credit count display unit 12. For example, if the monetary value unit (coin) required for one game is twenty five cents, a count of "4" is displayed in credit count display unit 12 when a dollar bill is inserted. By depressing a 1-bet button 22, a game of 1-coin bet is allowed provided that there is credit available (balance) as displayed in credit count display unit 12. This 1-coin bet game is a game in which the number of coins consumed for one game is limited to one coin. One coin is required to play one game, and the monetary value, i.e. the prize of one coin in this case, awarded to the player in one game is a low one corresponding to one coin.

By depressing 1-bet button 22, the count on credit count display unit 12 is decremented by 1, and the number of balls to be used in one game is displayed on available ball count display unit 11. The number of balls can be displayed in a digital form of a numeral. Also a picture of the balls (for example, pachinko balls) can be provided in a light-up manner. As a result, the player can appreciate that the credit has been converted into balls for a game to increase the effect of playing a game in virtual space.

A 2-coin bet game can be played by depressing 1-bet button 22 two times. This 2-coin bet game is limited in that the coins spent in one game is two coins. Two coins are required to play one game, and the monetary value presented to the player as a prize is a relatively higher one corresponding to two coins. In a 2-coin bet play, the number of balls displayed in available ball count display unit 11 is 10, which is two times that of a 1-bet game.

A maximum bet game can be played by depressing 1-bet button 22 three times or by depressing maximum-bet button (MAX-button) 23. In this maximum-bet game, the number of coins consumed in one game is limited to 3, for example. Three coins are required to play one game, and the monetary value that is awarded to the player in one game is great. In the present invention, the capital value of three coins is awarded. In a maximum-bet game play, the number of available balls of 15 is displayed in available ball count display unit 11.

The number of bet counts set by 1-bet button 22 or maximum-bet button 23 is shown in a bet count display unit 13 in the form of a light-up representation display of a quarter coin. Following the setting of the bet according to the depression operation of 1-bet button 22, a start button 24 or maximum-bet button 23 is depressed to start a game. Balls are automatically flipped into play field 7 at a predetermined time interval and the visual representation of left reel 38*a*, middle reel 38*b*, and right reel 38*c* begin to change. If an automatically flipped ball enters any of pockets 30–34, a win is indicated in the relevant winning count display region of the pocket, and the corresponding pocket display region in the pocket win display region 41 lights up. When there is a win in all the pockets at the end of the shooting of all the balls at an elapse of a predetermined time period from the first emission of a ball, a big hit of a pocket jackpot is achieved. When the spinning display of the three reels come to a halt and the combination of the stationary displayed symbols match a predetermined particular combination of symbols, a big hit of a reel jackpot is achieved. A win corresponding to other predetermined combinations can be achieved in which a predetermined credit is presented.

At the end of one game, the credit count won according to the game play is displayed on earned point display unit 10, and also added to the count value on credit count display unit 12.

At the end of a game, the player can have the earned credit paid out by depressing payment button 21. By depressing payment button 21, a number of coins corresponding to the credit count displayed on credit count display unit 12 is dispensed to the player via outlet 25. However, coins will not be dispensed when payment button 21 is depressed if the total number of credit won by the player exceeds a predetermined value. In such a case, the player must press call button 20. In response to depression of call button 20, the attention of an attendant or clerk of the game house is called, whereby cash or a check corresponding to the credit value is directly provided to the player. When there is a great hit of a jackpot during a play, the game is automatically stopped, and cash or a check corresponding to the credit won by the player is directly provided to the player by the attendant.

Figure 3:
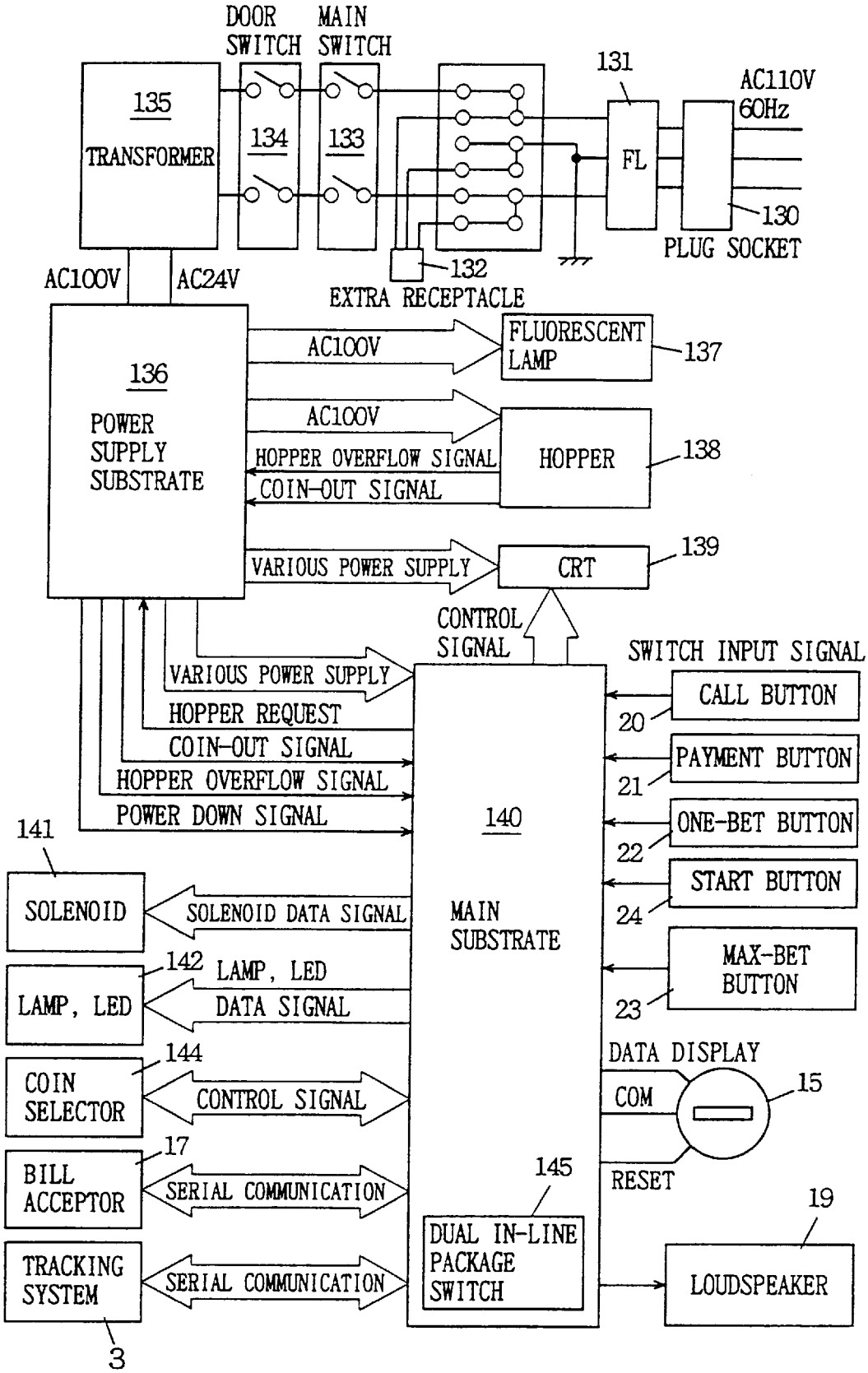
FIGS. 3 and 4 are block diagrams showing a structure of image display type game machine 1.
Figure 4:
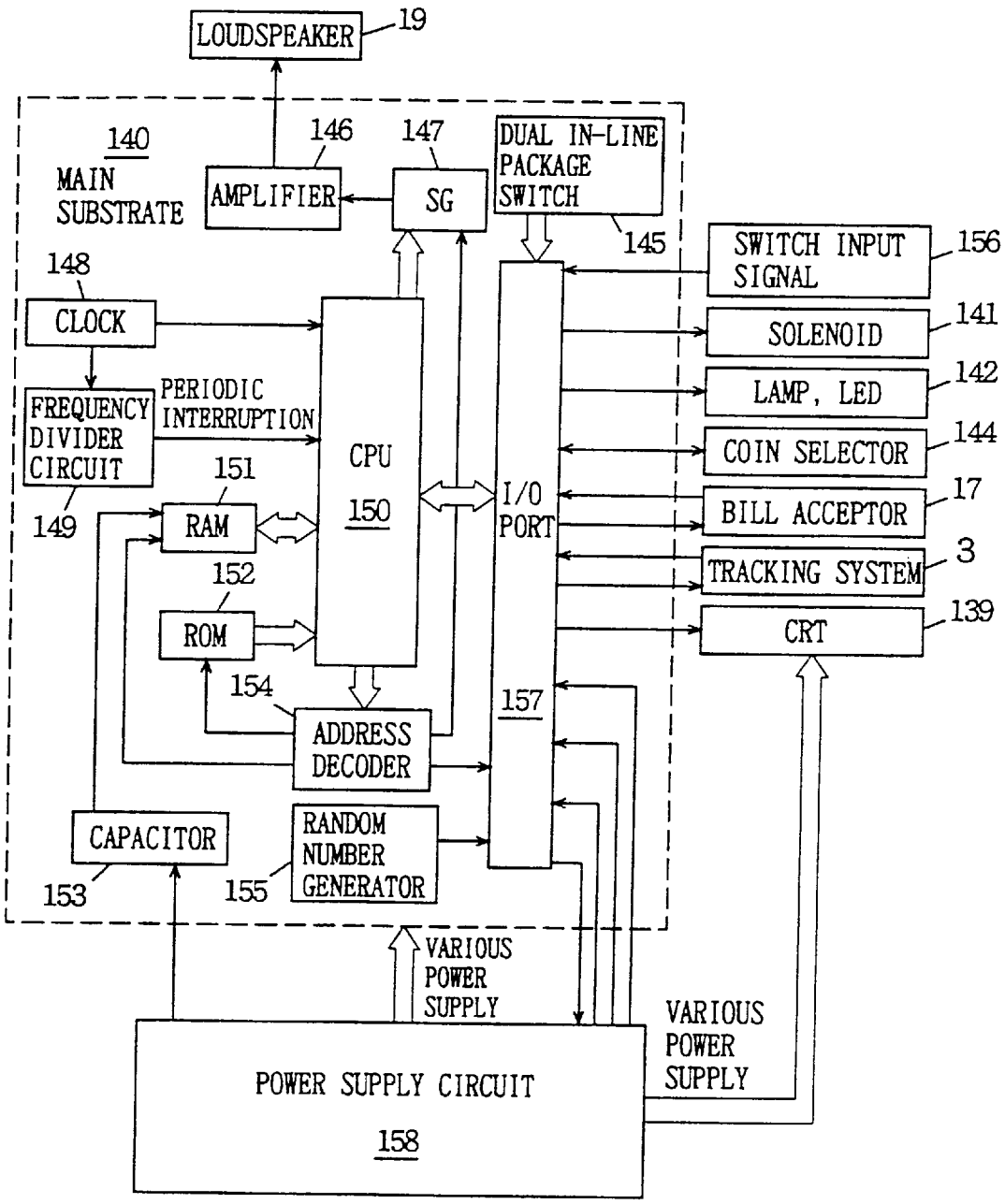

FIGS. 3 and 4 are block diagrams showing control circuitry employed in a game machine.

The control circuit of the game machine includes a main substrate 140 for controlling a game according to a program that provides control of various devices.

Main substrate 140 receives power supplied from a power supply substrate 136, and provides a hopper request signal to power supply substrate 136. Power supply substrate 136 receives a hopper request signal from main substrate 140 to effect discharge of coins by hopper 138. After coins are discharged, power supply substrate 136 transfers a coin-out signal from hopper 138 to main substrate 140. When coins are overflowing in hopper 138, a hopper overflow signal is provided from hopper 138 to main substrate 140. When the output of power supplied from power supply substrate 136 to main substrate 140 is lowered, a power down signal is transmitted from power supply substrate 136 to main substrate 140.

Power supply substrate 136 supplies power to a fluorescent lamp 137, hopper 138, and an image display apparatus (CRT) 139 used for illumination of image display type game machine 1, in addition to supplying power to main substrate 140.

Power of AC 110 V, 60 Hz is converted into AC 100 V and AC 24 V via a plug socket 130, a FL 131, a main switch 133, a door switch 134, and a transformer 135 to be supplied. Reference number 132 designates an auxiliary plug socket.

Figure 33:
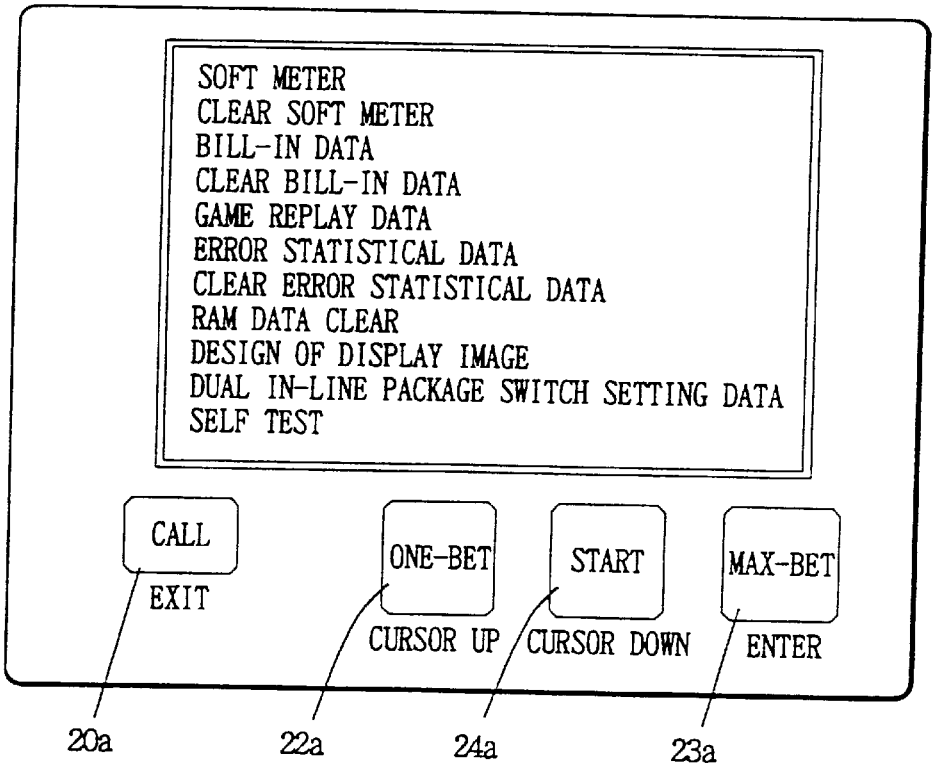
FIG. 33 shows a menu screen displayed when image display type game machine 1 attains a data display mode.

Main substrate 140 provides control signals for carrying out various image displays to CRT 139. A solenoid 141 is provided in coin sorter 28. In response to solenoid 141 being excited according to a solenoid data signal from main substrate 140, a coin inserted via coin inlet 18 is sorted into hopper 138 or to the collector bin side. An electromagnetic counter (not shown) indicating the total number of inserted coins, the total number of dispensed coins, the total number of coins in the collector bin receives a solenoid data signal. Main substrate 140 carries out bidirectional serial communication with bill inlet (bill acceptor) 17 and tracking system 3 to transmit predetermined control signals to coin selector 144. A switch input signal corresponding to depression of call button 20, payment button 21, 1-bet button 22, start button 24, and maximum-bet button 23 is applied to main substrate 140. In response to operation of key switch 15, main substrate 140 effects various control operations to transmit a control signal to CRT 139. More specifically, when a predetermined key is inserted into key switch 15 to enter a reset mode (rotating key switch 15 of FIG. 1 leftwards), a reset operation of image display type game machine 1 is effected. When a data display mode is entered (rotate key switch 15 of FIG. 1 rightwards), a screen of a data display mode that will be described afterwards with reference to FIG. 33 is displayed on CRT 139. In a normal game play, key switch 15 is positioned at a control mode (COM). Reference number 145 designates a dual in-line package switch. By setting a hard strap, the cycle time period for one game, for example, is set.

Main substrate 140 includes a CPU 150 for controlling the game according to a program that provides control of various components. A frequency divider circuit 149 for carrying out a periodic interrupt process at a predetermined timing (for example 2 ms), a clock circuit 148 for supplying a predetermined clock signal to frequency divider circuit 149 and CPU 150, and an address decoder 154 for providing a signal to select any of a ROM 152, A RAM 151, an I/O port 157, a sound generator (SG) 147 are connected to CPU 150. Sound generator 147 is connected to an amplifier 146, whereby the output amplified by amplifier 146 is provided in an audible manner via a loudspeaker 19. A random number generator 155 for generating a random number to determine whether to generate a big hit to award a particular value to the player, or to display a win image of a flipped ball to award a predetermined play value to the player, a solenoid 141, a lamp LED 142, coin selector 144, bill inlet (bill acceptor) 17, tracking system 3, and CRT 139 are connected to CPU 150 via I/O port 157. Switch input signals 156 includes signals provided from call button 20, payment button 21, 1-bet button 22, maximum-bet button 23, and start button 24, as well as from frame open switch 16 and door open switch 27.

Power supply substrate 136 also supplies power to a capacitor 153 which functions as a backup power supply for RAM 151. Data stored in RAM 151 can be protected even when main switch 133 or the like is turned off and the power supply from power supply circuit 158 to main substrate 140 is cut off. Various administration data of various counters for controlling the game and the account information are stored in RAM 151. Various programs for controlling a game are stored in ROM 152. CPU 150 controls the game machine according to the program stored in ROM 152. More specifically, CPU 150 executes the program from the beginning to the end to attain a reset standby state. The program is reexecuted from the beginning by a reset signal periodically provided from frequency divider circuit 149. CPU 150 is implemented to control the game-play status of game machine 1 by repeating the program from the beginning to the end at every input of a reset signal.

Random number generator 155 generates a random number for determining the combination of the stationary symbols displayed on left reel 38*a*, middle reel 38*b* and right reel 38*c*, a random number for determining the display manner of leechi that will be described afterwards when a leechi state is achieved in a combination of stationary symbols of left reel 38*a* and middle reel 38*b*, and a random number for determining the win of each displayed flipped ball or the combination of a pocket win at the end of one game. CPU 150 controls the win of a game by these input random numbers.

The play operation of image display type game machine 1 will be described in detail.

Figure 5:
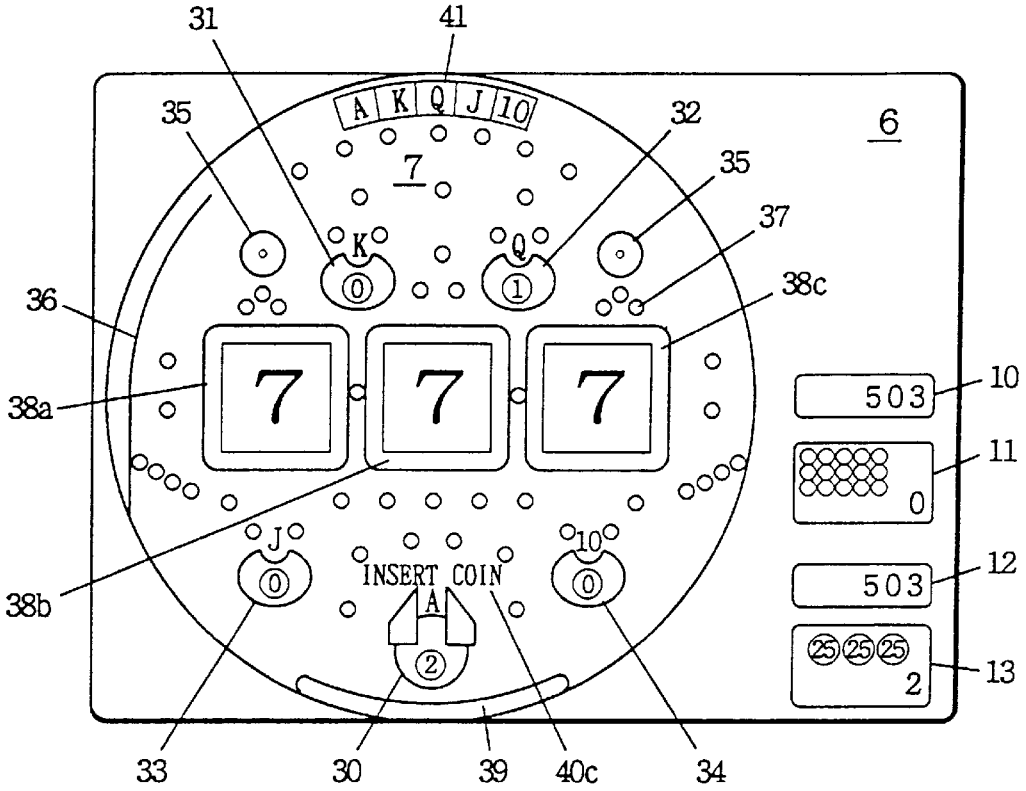
FIG. 5 shows an image of play board screen display region 6 when image display type game machine 1 is in a standby state for insertion of a coin or a bill.

FIG. 5 shows a play board screen display region 6 which attains a standby state for the next play. Stationary displays of symbols of the previous game are shown in play field 7. A message of "INSERT COIN" prompting insertion of a coin is provided in message display region 40*c* in a blinking manner. The result of the previous game is displayed in a faded color in various display units, pocket winning display region 4, and the winning count display regions of each of pockets 30–34. It is appreciated from the count of "2" in bet count display unit 13 that the previous game was played consuming a credit corresponding to two coins (credit "2"). The credit count of "503" in earned point display unit 10 indicates that a credit value of "503" was provided to the player as the result of the game. It is also appreciated that there is one win in pocket 32 and two wins in pocket 30.

Figure 6:
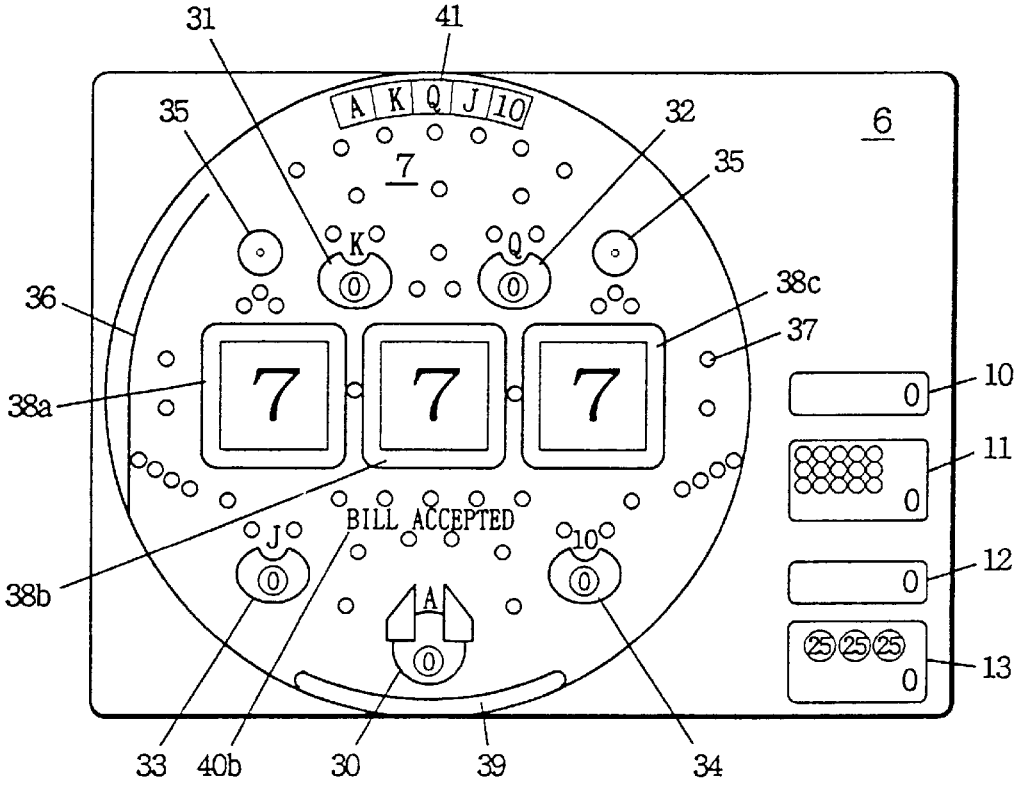
FIGS. 6–8 show images displayed on play board screen display region 6 when a paper note is inserted.
Figure 7:
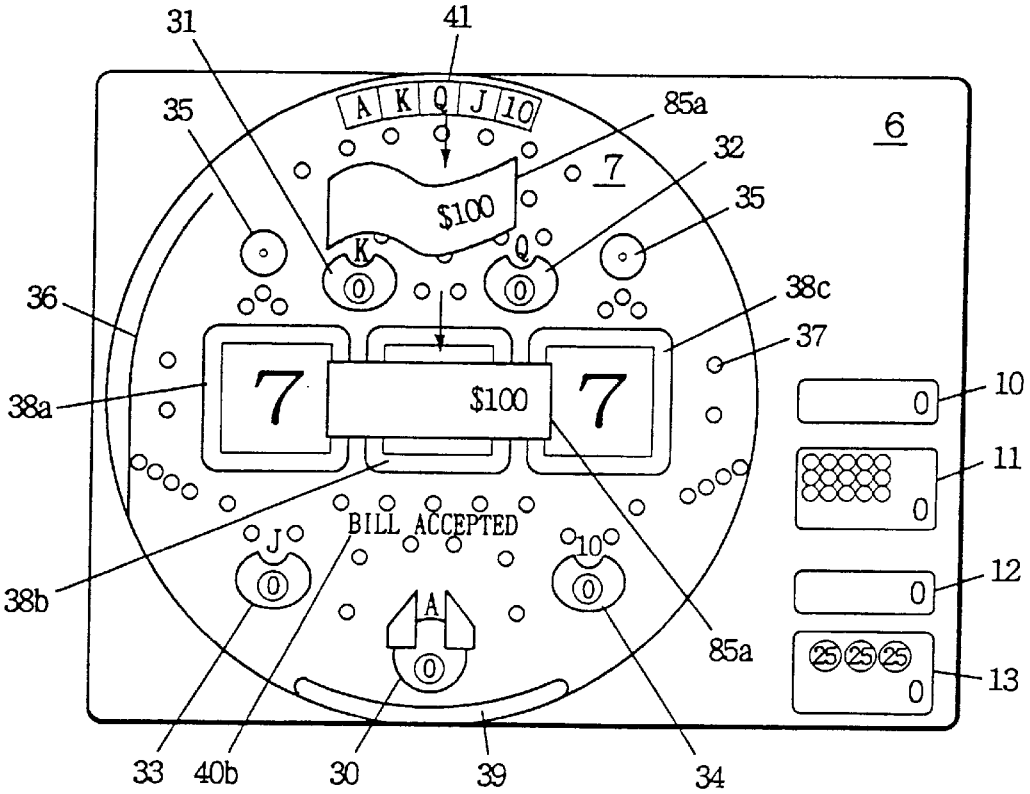
Figure 8:
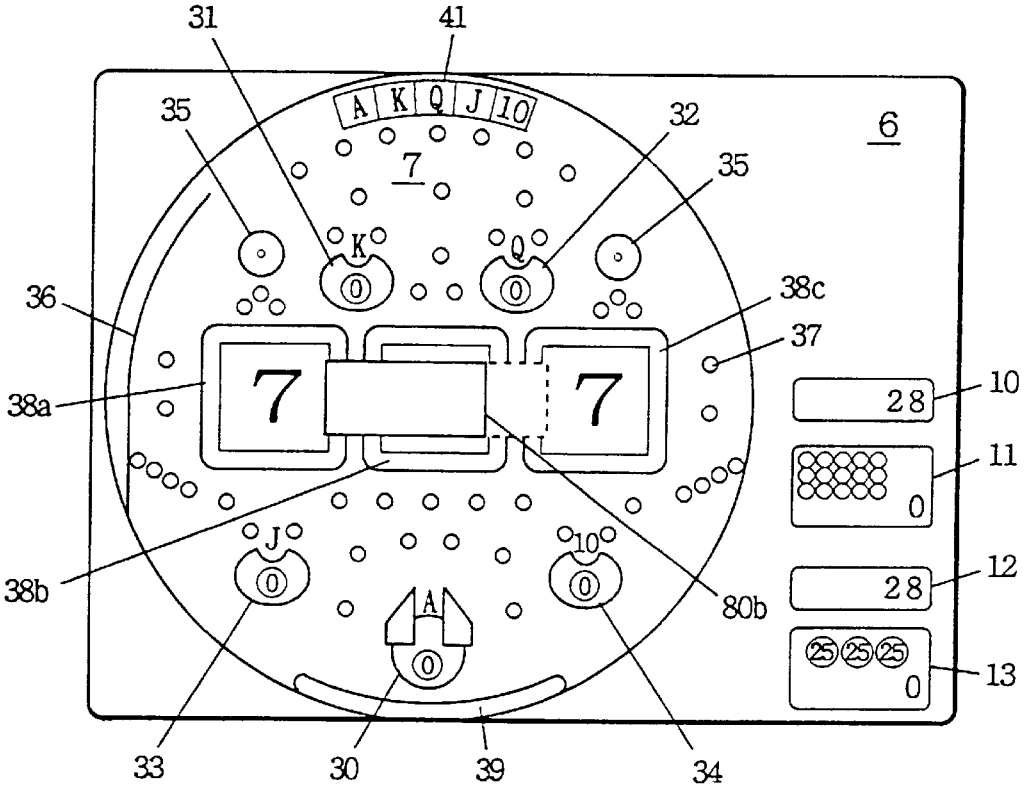

FIGS. 6–8 show image displays of play board screen display region 6 when a paper note is inserted into image display type game machine 1. Referring to FIG. 6, a message of "BILL ACCEPTED" is displayed on message display region 40*b* upon insertion of a paper note via bill inlet 17 to indicate that a bill has been accepted. As shown in FIG. 4, this series of operation is effected by signalling to CPU 150 from bill receptor 17 that a paper note has been inserted via I/O port 157, whereby CPU 150 transmits an image display control command to CRT 139. When the paper note inserted via bill inlet 17 is not a proper one, bill acceptor 17 will discriminate that improper paper note and reject it outside game machine 1.

When a bill is inserted and an appropriate display is shown on message display region 40*b*, the count values in earned point display unit 10, available ball count display unit 11, credit count display unit 12, bet count display unit 13, and the winning count display regions of pockets 30–34, as well as the light-up of pocket win display region 41, are cleared.

Following the predetermined display control described with reference to FIG. 6, an image as shown in FIG. 7 is displayed. A graphical representation 85*a* corresponding to the inserted bill is shown so as to fall like a leaf from the upper portion of play board screen display region 6 towards the center of middle reel 38*b*. The displayed bill appearance depends upon the type of paper note inserted. In FIG. 7, an image when a one hundred dollar bill is inserted is displayed. The bill representation of the falling appearance is maintained at the center of middle reel 38*b*, and an audio effect indicating insertion of a bill is generated from loudspeaker 19.

Referring to FIG. 8, one hundred dollar bill 80 displayed at the center of middle reel 38*b* is gradually reduced in size, and a credit count corresponding to one hundred dollars is displayed in earned point display unit 10 and credit count display unit 12 in an accumulated manner. When the picture of the one hundred dollar bill becomes so small that it disappears from the screen, the accumulation of the counts of earned point display unit 10 and credit count display unit is terminated. Since the amount of a quarter is set to correspond to one credit point in the present embodiment, the value of "400" is displayed in earned point display unit 10 and credit count display unit 12 when a hundred dollar bill is inserted.

An audio effect resembling insertion of a coin is generated from loudspeaker 19 at each accumulated display in earned point display unit 10 and credit count display unit 12 corresponding to the inserted one hundred dollar bill.

Figure 9:
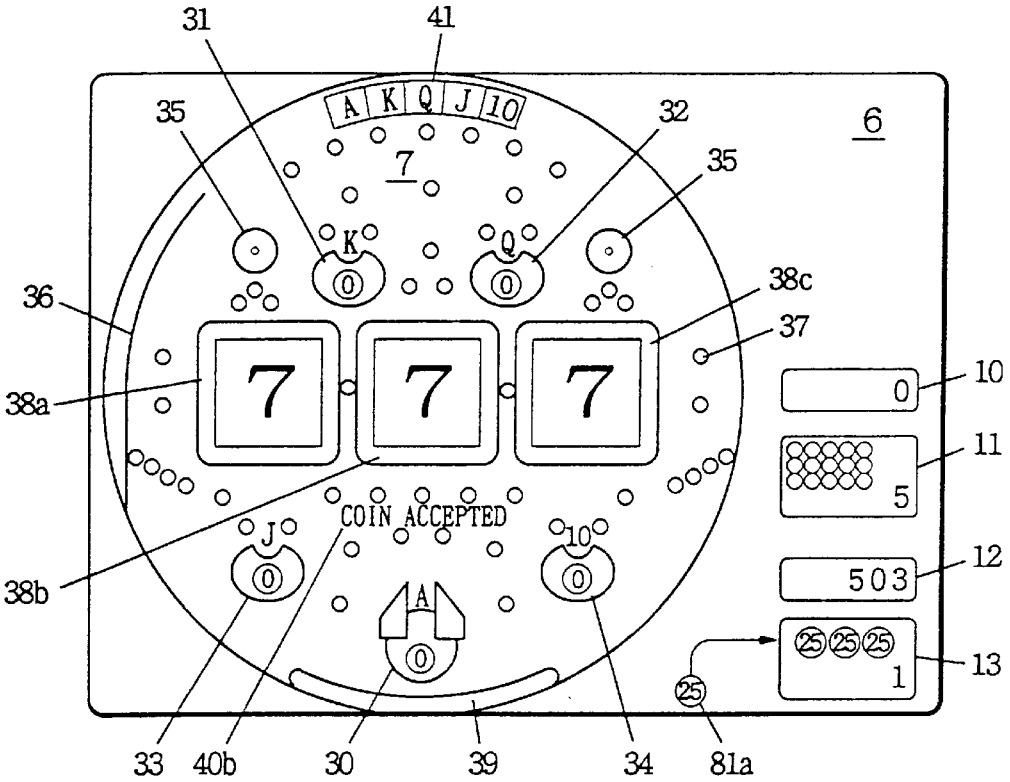
FIG. 9 shows an image displayed in play board screen display region 6 when a coin is inserted.
Figure 10:
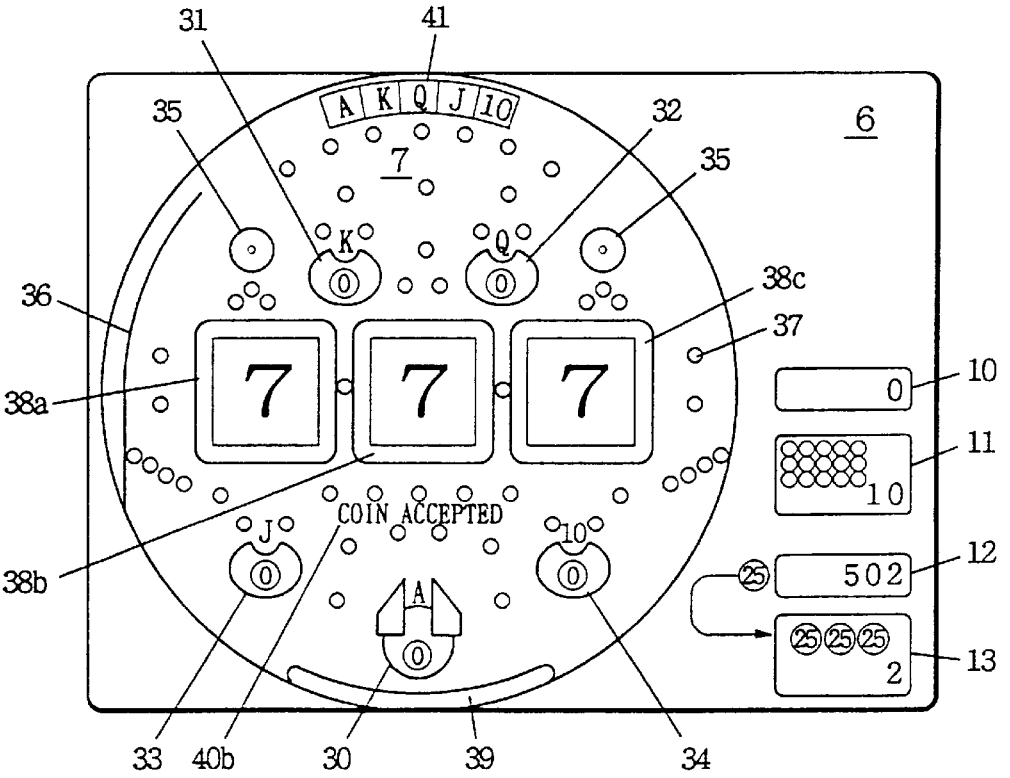
FIG. 10 shows an image of play board screen display region 6 when a bet count is set from the credit count stored in image display type game machine 1.
Figure 11:
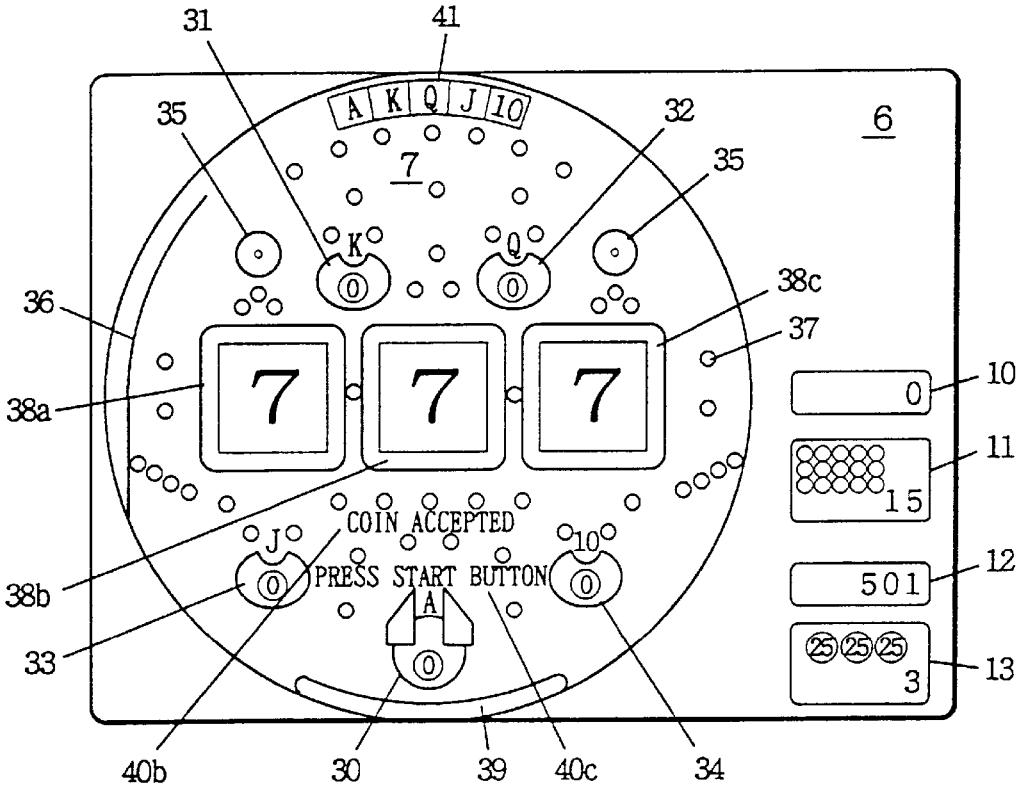
FIG. 11 shows an image displayed in play board screen display region 6 when the bet count is set to 3.

FIGS. 9–11 shows an image display of play board screen display region 6 when a coin is inserted via coin inlet 18. Referring to FIG. 9, an audio effect resembling insertion of a coin is generated from loudspeaker 19 upon the insertion of the first coin into coin inlet 18. Acceptance of the coin is indicated by the display of "COIN ACCEPTED" in message display region 40*b*. Additionally, the display in pocket win display region 41, earned point display unit 10, and the winning count display regions of pockets 30–34 are cleared. The number of balls provided at the bet of one coin is displayed in available ball count display unit 11. As mentioned before, the total number of flipping ball for one bet is five balls.

In response to insert of one coin (quarter), an image 81*a* of a quarter coin is displayed in a shifting manner towards game bet count display unit 13 as shown by the arrow to be combined with the quarter coin image in game bet count display unit 13. The illumination of the quarter coin image is lit, and the count of "1" is indicated in game bet count display unit 13.

In response to the player depressing start button 24 after the image of FIG. 9 is displayed, a game of one bet is initiated. If the player continuously inserts the second coin without depressing start button 24, a display of two coins is provided in game bet count display unit 13 to indicate that a bet of two coins is established. Accordingly, ten balls are displayed in available ball count 11. A game on a 2-coin bet can be initiated by the player depressing start button 24. Similarly, when a total of three coins are inserted, a game on a three coin bet can be carried out.

FIG. 10 shows the display when the player is to play a game by withdrawing the credit owned by the player indicated displayed on credit count display unit 12. The player does not insert a coin via coin inlet 18.

When the player depresses 1-bet button 22, the count on credit count display unit 12 is decremented by 1. Image 81*b* of a quarter is displayed in a moving manner to be combined with the quarter coin image in game bet display unit 13. The image of the quarter coin lights up. A message indicating acceptance of coin is displayed on message display region 40*b*, and an audio effect of inserting a coin is generated from loudspeaker 19. Also, the number of flipping balls are displayed on available ball count display unit 11. If the player continuously depresses 1-bet button 22, the count value of credit count display unit 12 is further decremented by 1, and an image of a second coin is displayed in a lighted manner in game bet count display unit 13. The message of "coin accepted" is displayed in message display region 40*b*, and ten flipping balls are displayed in available ball count display unit 11. FIG. 10 shows the displayed image when the player depresses 1-bet button 22 two times. Upon depressing start button 24, a game of a two-coin bet is initiated.

FIG. 11 shows a play board screen display region 6 of a game of a 3-coin bet according to the player depressing 1-bet button 22 three times or by inserting a coin into coin inlet 18. The representation of three quarters are shown in a light-up manner in bet count display unit 13 together with display of count "3". Furthermore, the number of available balls of 15 is indicated in available ball count display unit 11. The message of "COIN ACCEPTED" in message display region 40*b* maintains it lighted state, and a message of "PRESS START BUTTON" prompting depression of the start button is displayed in message display region 40*c* in a blinking manner. When the player depresses start button 24 in this state, a game of a 3-coin bet is initiated.

The display state indicated in FIG. 11 is provided when the player depresses 1-bet button 22 three times in playing a game according to the credit owned by the player. When the maximum-bet button 23 is depressed, the message in message display region 40*c* of FIG. 11 is not displayed. A display similar to that of FIG. 11 excluding message display region 40*c* is provided, and a game is automatically started without depression of start button 24 by the player.

Figure 12:
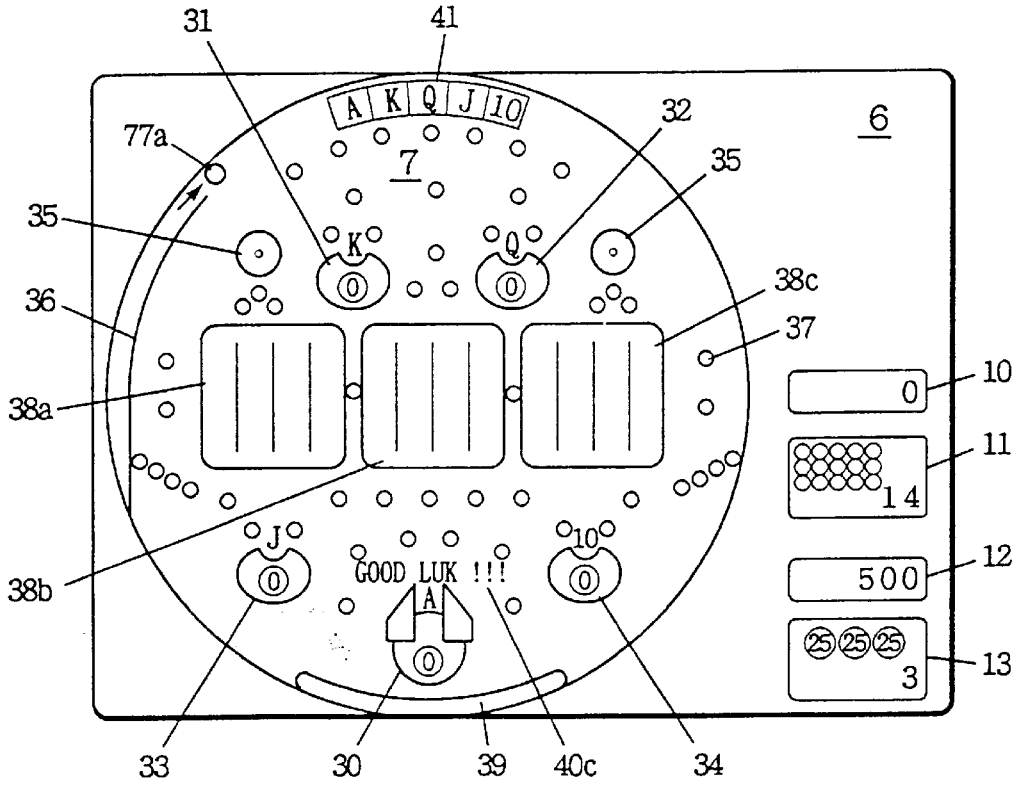
FIG. 12 shows an image provided in play board screen display region when a game is started.

FIG. 12 shows play board screen display region 6 just at the beginning of a game on a 3-coin bet in response to the depression of start button 24 or maximum-bet button 23 by the player. Balls are automatically flipped to enter play field 7. Accordingly, the number of balls in available ball count display unit 11 is decreased. Furthermore, the spinning display of the symbols in left reel 38*a*, middle reel 38*b* and right reel 38*c* begins. A message of "GOOD LUCK" is lighted for one second in message display region 40*c*.

Following the generation of a "game start" audio effect from loudspeaker 19 at the start of a game, an audio effect corresponding to spinning reels is generated.

At the start of a game, an image of a predetermined number of balls in available ball count display unit 11 that are sequentially flipped into play field 7 at a predetermined interval is displayed.

Figure 13:
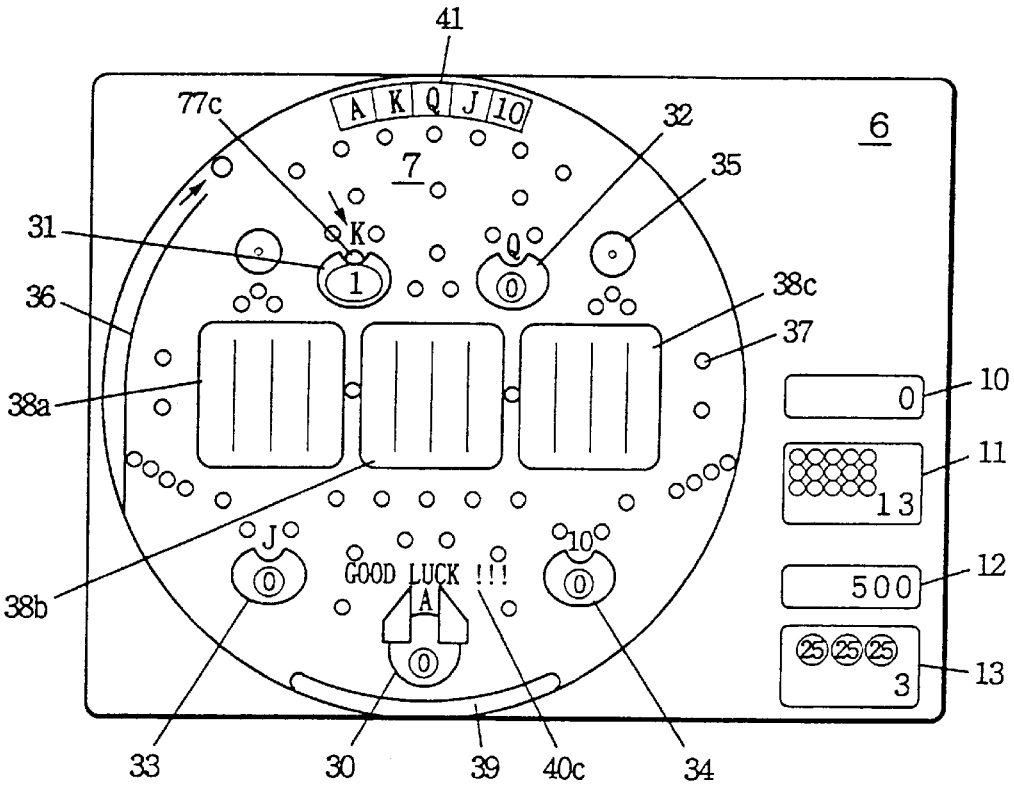
FIGS. 13 and 14 show images displayed in play board screen display region 6 when a flipped ball enters a pocket.

FIG. 13 shows a display when a flipped ball 77*c* enters pocket 31, i.e. when a win is achieved. Upon entry of flipped ball 77*c* into pocket 31 in play field 7, the graphical representation of the winning count display region of pocket 31 is magnified in an elliptical shape and lighted up. The numeral of the win count is updated to "1" from "0". Also, the region of "K" in pocket win display region 41 is lighted up. Furthermore, an audio effect indicating a pocket win is generated from loudspeaker 19.

The number of balls in available ball count display unit 11 is decremented as a ball is flipped into play field 7.

Figure 14:
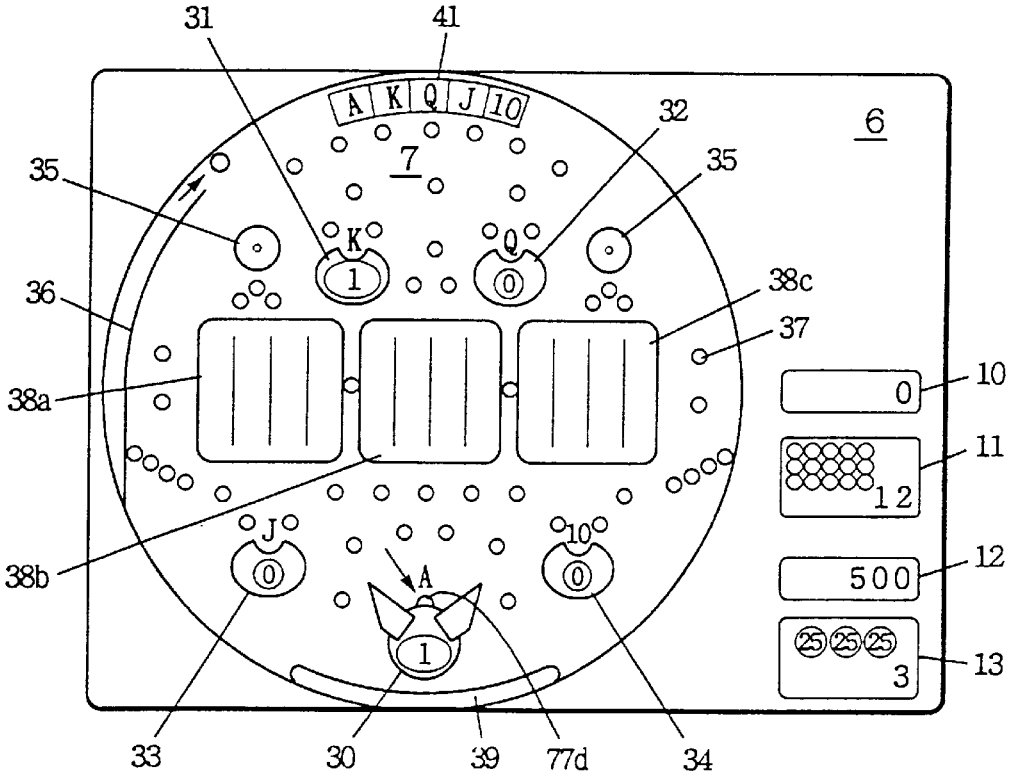

FIG. 14 shows play board screen display region 6 when a flipped ball 77*d* enters pocket 30. At the entry of flipped ball 77*d* in pocket 30, the pair of movable fragments provided at pocket 30 are displayed in an open state. The winning count display region of pocket 3 is magnified and lighted up. Also, the value of the winning count is updated. The region of "A" in pocket win display region 41 is lighted up and an audio effect is generated from loudspeaker 19. The movable fragments at pocket 30 maintain their increased entrance until the termination of one game. The player can feel that the probability of entering pocket 30 is increased when pocket 30 attains an open state to elevate the degree of enthusiasm and excitement for the game. Since the probability of a win in a pocket is determined upon the random number generated from random number generator 155 (refer to FIG. 4), the attendant or manager of the game house can manipulate the probability of a pocket win independent of the state of pocket 30. According to the present embodiment, manipulation is allowed to display an open entrance of pocket 30 at an early stage of a game to arise the excitement of the player while setting the probability of a pocket win to an arbitrary value.

Figure 15:
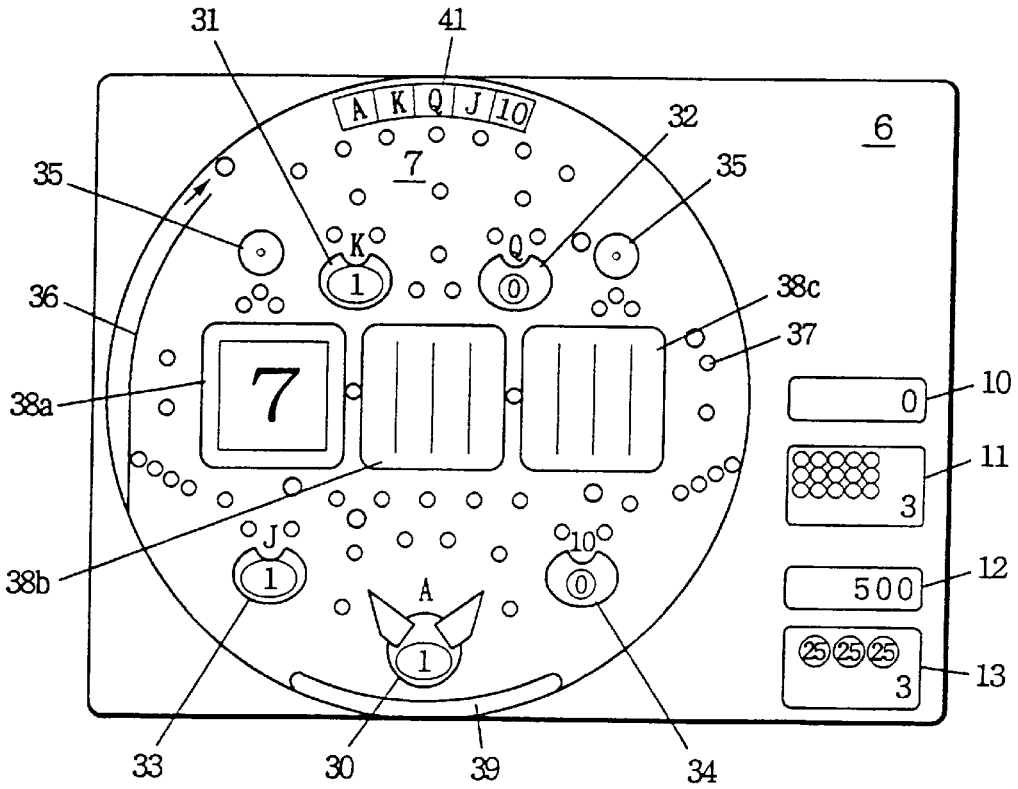
FIG. 15 shows an image displayed in play board screen display region 6 when a left reel 38*a* comes to a halt.
Figure 16:
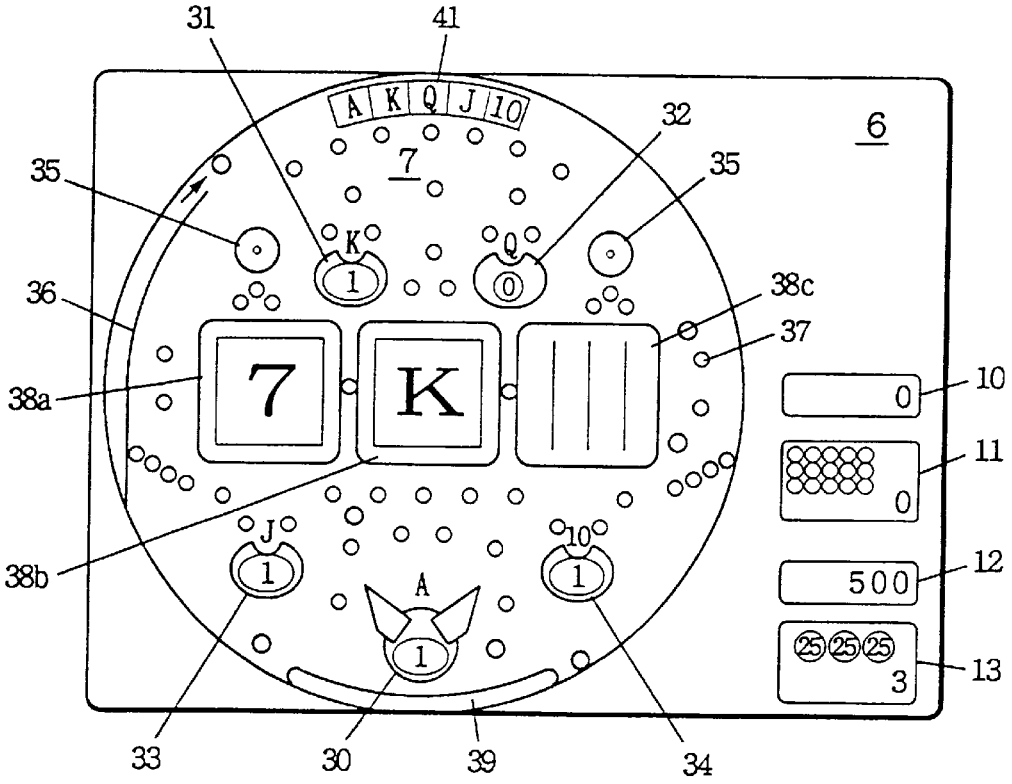
FIG. 16 shows an image displayed in play board screen display region 6 when a middle reel 38*b* comes to a halt.
Figure 17:
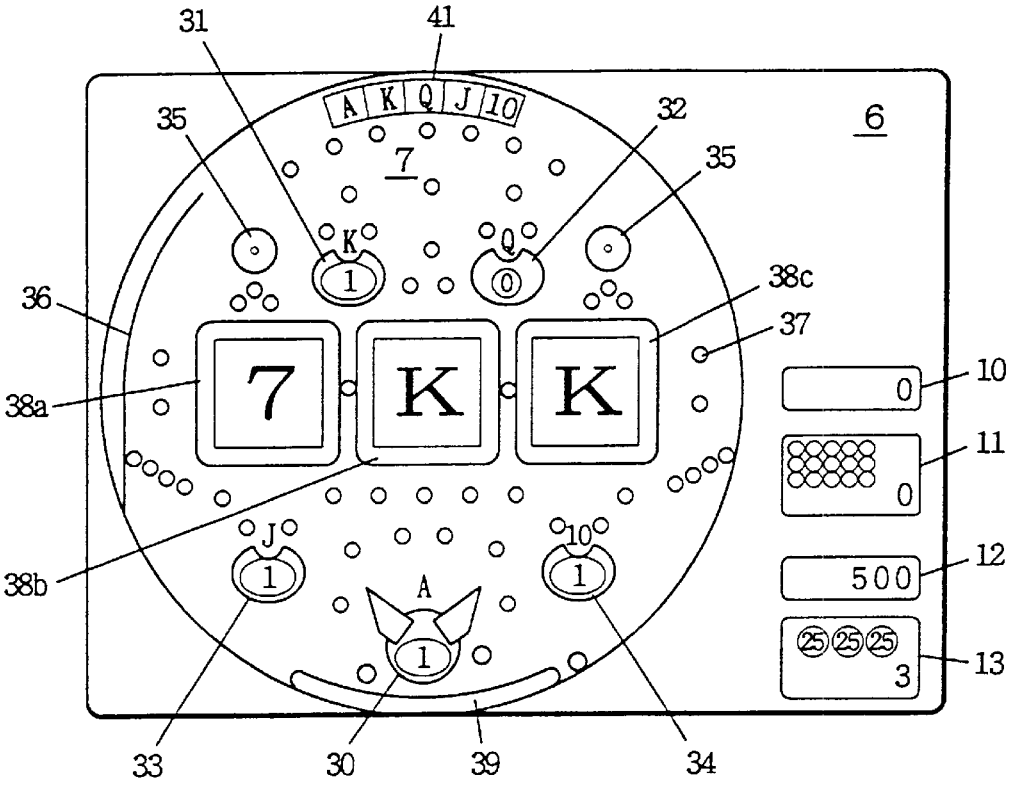
FIG. 17 shows an image displayed in play board screen display region 6 when a right reel 38*c* comes to a halt.

FIGS. 15–17 show a play board screen display region 6 from the start of spinning visual representations of symbols in each of reels 38*a*–38*c* until the halt of all the reels without an achievement of a reel leechi state.

Referring to FIG. 15, control is effected to display a stationary symbol in left reel 38*a* at an elapse of a predetermined time from the start of a game. Here, an audio effect resembling the halt of a spinning reel is output from loudspeaker 19 to inform the halt of left reel 38*a*.

Referring to FIG. 16, control is effected to display a stationary symbol in middle reel 38*b* at an elapse of a predetermined time period from the halt of left reel 38*a*. An audio effect resembling a reel halt is generated from loudspeaker 19.

Referring to FIG. 17, control is effected to display a stationary symbol of right reel 38*c* at an elapse of a predetermined time period from the display of a stationary halt at middle reel 38*b*. Furthermore, an appropriate audio effect of a reel halt is generated from loudspeaker 19. It is to be noted that a variety of combinations of the timing for providing a stationary display of each reel and the timing of displaying a flipped ball can be provided. By controlling the display of the halt of each reel to be effected after all the balls are shooted, for example, the player can enjoy a game without missing the entry of a flipped ball into any of pockets 30–34.

A pocket leechi state will be described hereinafter with reference to FIG. 16 again. A leechi state (one-more-to-go) is attained when a win is achieved in any four of pockets 30–34 and a "big win" for all the pockets can be obtained if a flipped ball enters the remaining one pocket. This game state is called a "pocket leechi" discriminated from a "reel leechi". Generation of a pocket leechi, if any, is informed via loudspeaker 19, and pocket win display region 41 is shown in a blinking manner. The attention of the player is focused on the last pocket that has not yet attained a win by showing the relevant pocket in a different color. The flipped balls eventually entering outlet 39 is displayed so as to pass through the peripheral regions of the relevant pocket (pocket 32 in FIG. 16) and enter outlet 39. By controlling the display in such a manner, the anticipation of achieving a big hit such as a pocket jackpot can be increased. FIG. 16 shows the state where a pocket leechi is achieved indicating that an entry into pocket 32 will produce a great hit. Notification by loudspeaker 19 and various display controls in play board screen display region 6 is provided.

FIGS. 18–22 show play board screen display region 6 in a reel leechi state for describing the types of leechi displays. In the present embodiment, three types of display control for reel leechi set forth in the following are allowed. CPU 150 (refer to FIG. 4) determines the types of leechi display to control the display according to a leechi random number entered from random number generator 155 (refer to FIG. 4).

Figure 18:
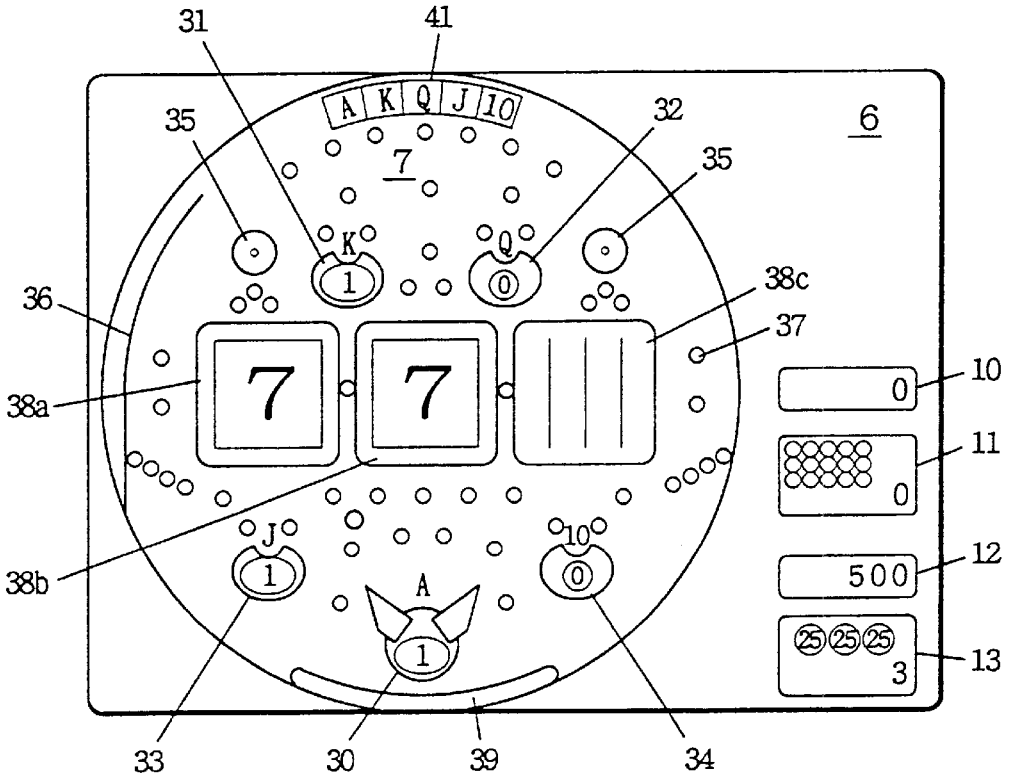
FIGS. 18, 19A, 19B, 20A, and 20B shows images displayed on play board screen display region 3 when a leechi state is established.

FIG. 18 shows a leechi display of a pattern 1. Following the generation of a reel leechi state, the speed of the spinning display on right reel 38*c* is slowed down such that the player can easily identify the symbol of the spinning display. At an elapse of three to five seconds, the rotating representation of the symbol in right reel 38*c* comes to a halt. An audio effect specific to the leechi display of pattern 1 is generated from loudspeaker 19 during the leechi display of pattern 1.

Figure 19A:
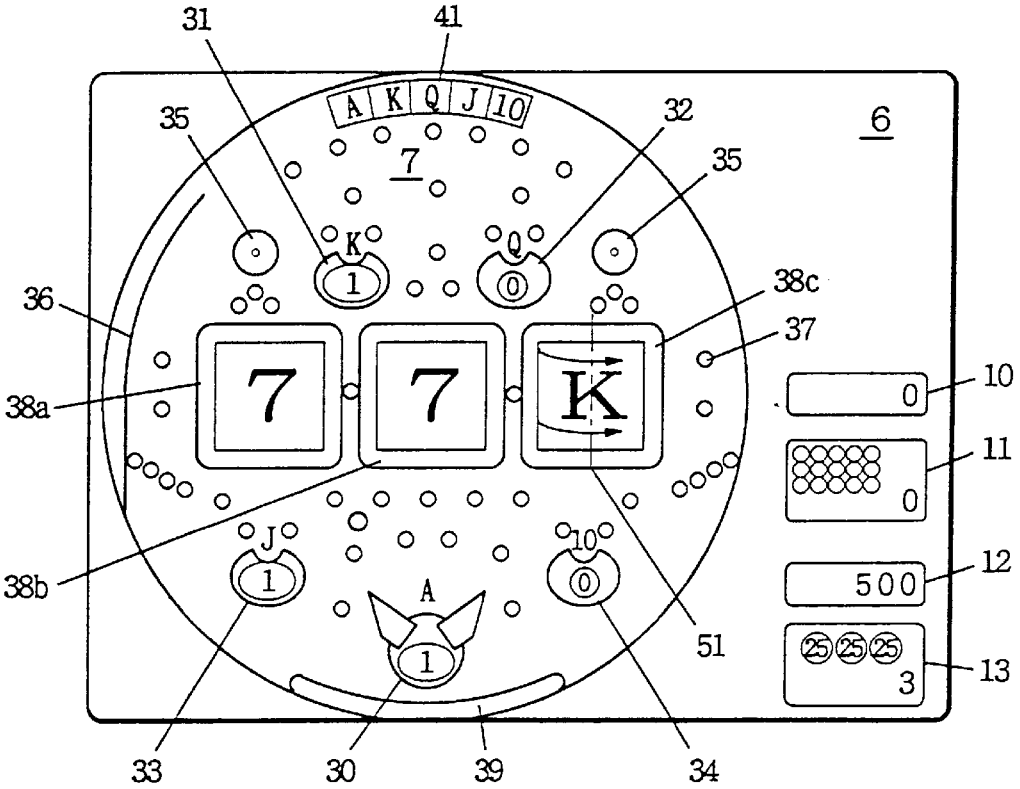
Figure 19B:
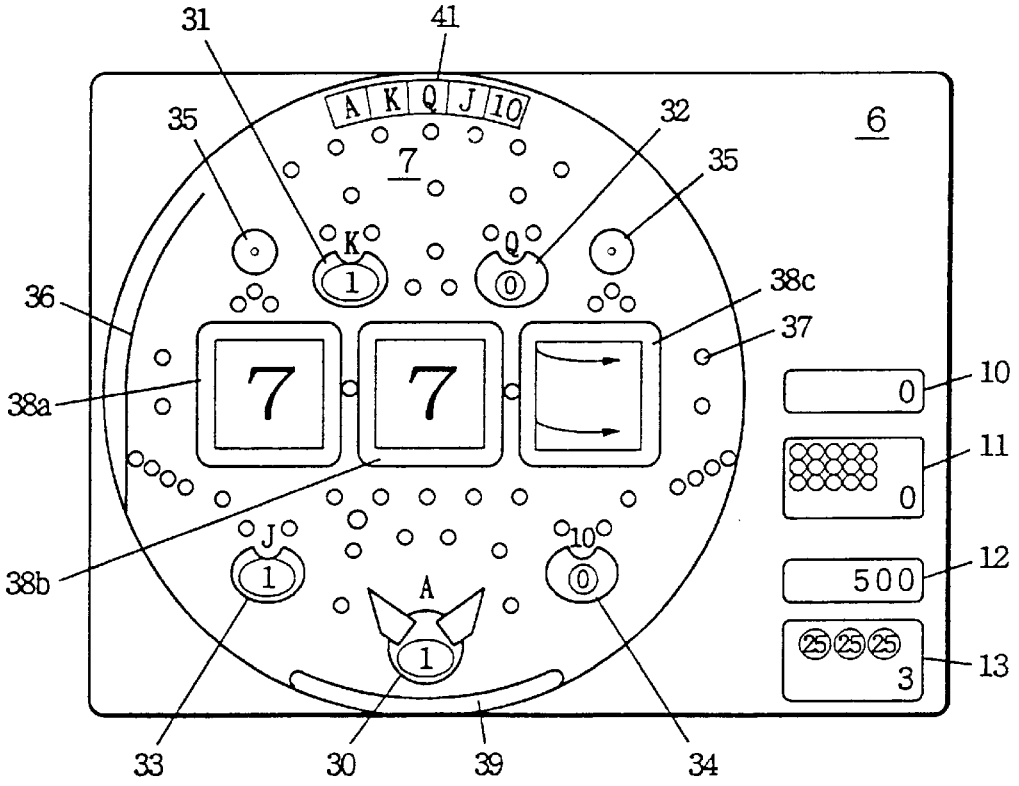

FIGS. 19A and 19B show the leechi display of a pattern 2. In contrast to the varying representation rotating in a vertical manner prior to the establishment of leechi, control for a variable display in which the front side and the back side of a card, for example, can be turned alternately as in the leechi display of pattern 2. A numeral or alphabet is variably displayed at each turn of the symbol picture from the back side to the front side. FIG. 19A shows the state where the front face of a symbol picture is displayed, and FIG. 19B shows the back side of the symbol picture. In FIG. 19A, the symbol picture in reel region 38*c* is altered about a center line 51. The arrow in FIG. 19B indicates that the varying display of the symbol picture is rotated sideways. The variable representation from FIG. 19A to FIG. 19B or from FIG. 19B to FIG. 19A is repeated alternately. When all the symbols are sequentially displayed during the elapse of 6–10 seconds from the start of a leechi display control, control to provide a stationary display of a symbol in right reel 38*c* is effected. An audio effect particular to a leechi state of pattern 2 is generated from loudspeaker 19 during the leechi display control of pattern 2.

Figure 20A:
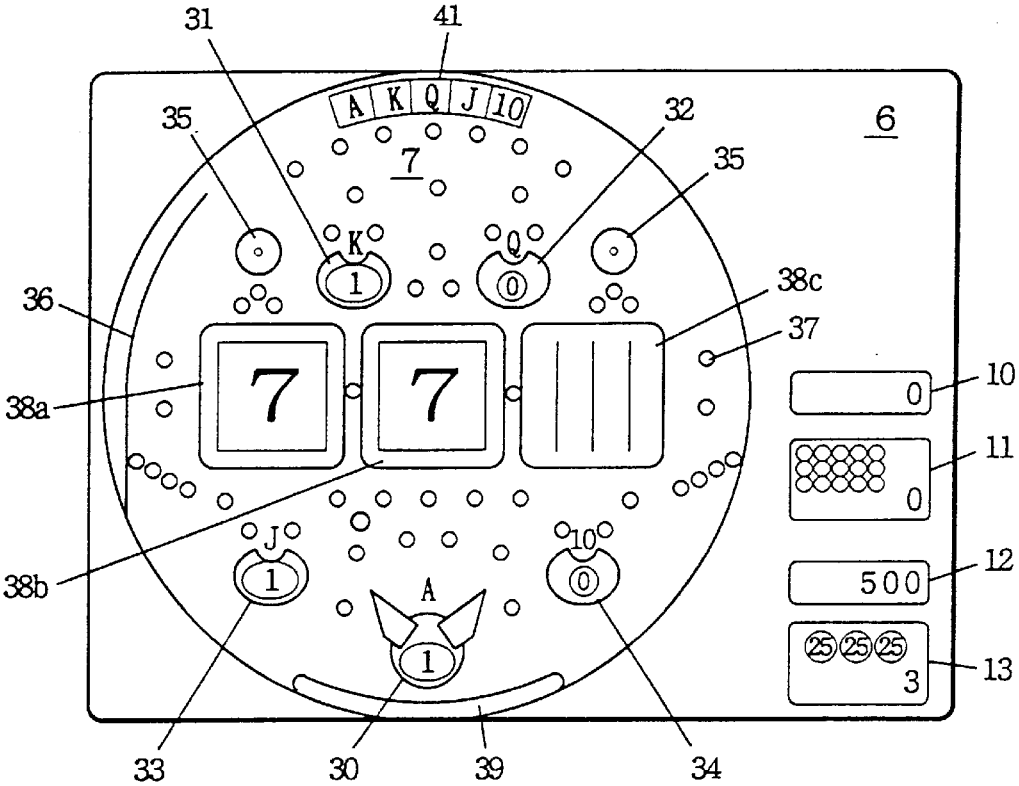
Figure 20B:
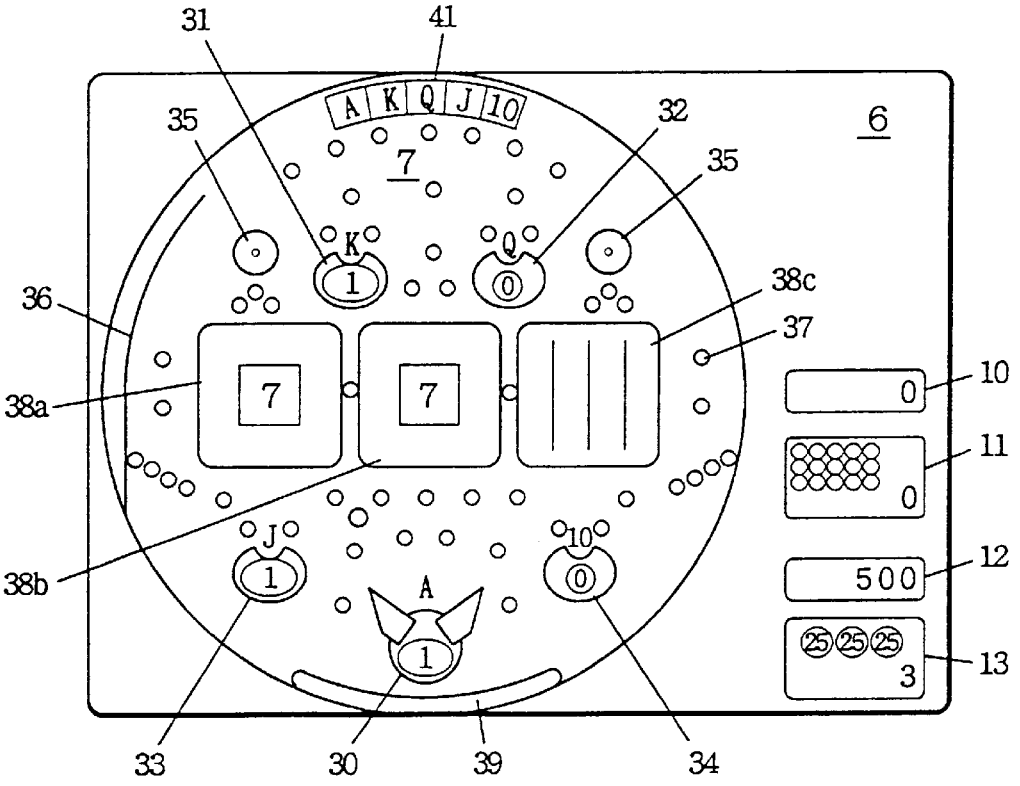

FIGS. 20A and 20B show a leechi display of a pattern 3. Simultaneously to establishment of a reel leechi state, display control is provided to show a display as in FIG. 20B and a state normal display as in FIG. 20A. In FIG. 20B, the stationary symbol in left reel 38*a* and middle reel 38*b* are displayed in a reduced manner, i.e. reduced in size. In FIG. 20A, the same symbols are displayed in a normal manner. Following this alternate display control for 6–10 seconds, control is effected to provide a stationary symbol in right reel 38*c*. An audio effect particular to the leechi state of pattern 3 is generated from loudspeaker 19 during the leechi display control of pattern 3.

The control of display of credit payment dispensed to the player according to the game result will be described hereinafter. In image display type game machine 1 of the present embodiment, control of dispensing credit in response to a win in a pocket or a great hit during the game is carried out at the completion of one game.

Figure 21A:
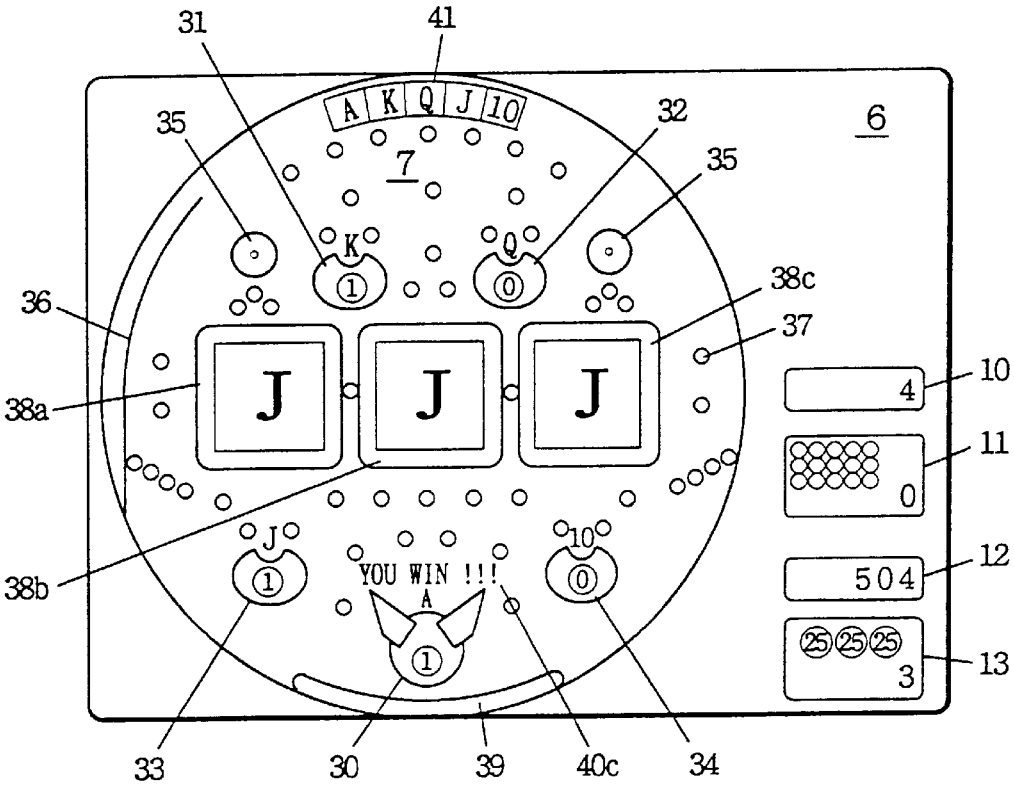
FIGS. 21A and 21B show images displayed on play board screen display region 6 when a reel win is achieved and coins are to be dispensed.
Figure 21B:
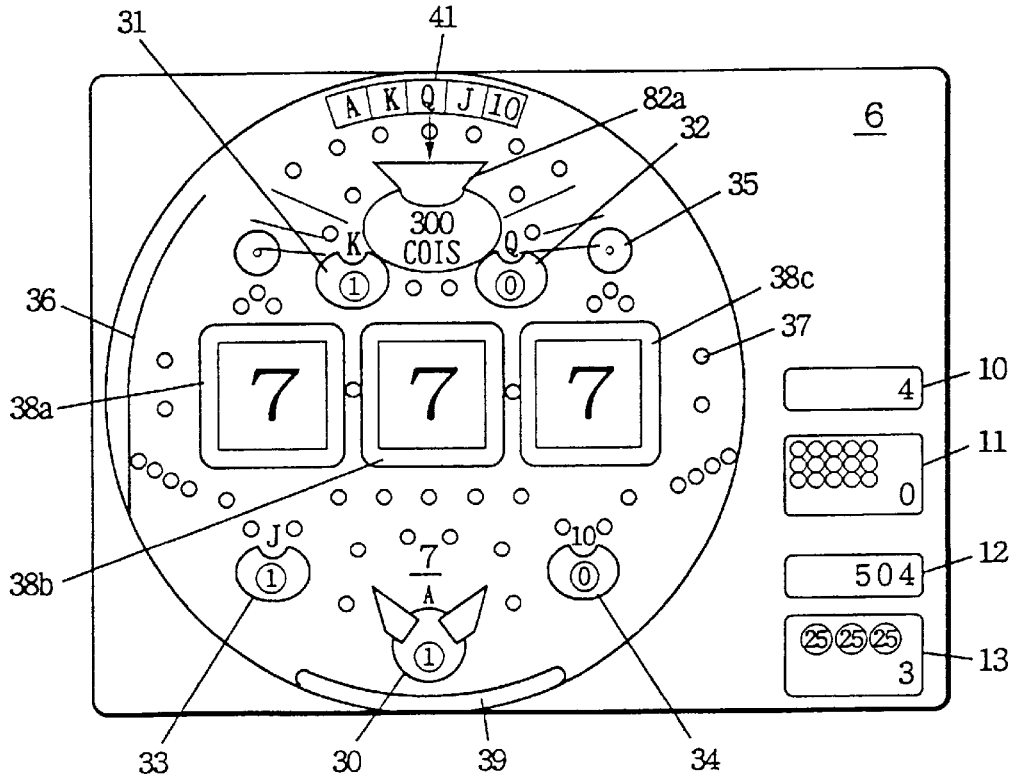

FIGS. 21A and 21B show displays of credit payment when a hit is generated in response to a predetermined combination of symbols of the reels. The payment display control in paying out credit according to a hit due to a combination of the symbols of the reel includes a payment display control of a pattern 1 shown in FIG. 21A and a pattern 2 shown in FIG. 21B.

Referring to FIG. 21A of pattern 1, an audio effect of a reel hit in response to achievement of a hit by a predetermined combination of symbols is generated from loudspeaker 19, and a predetermined count of credit awarded to the player in response to the certain combination is added to the value in earned point display unit 10 and credit count display unit 12 in increment by 1. The credit dispensed according to pocket wins 30, 31, and 33 are also additionally updated. An audio effect corresponding to discharge of coins is generated from loudspeaker 19 during update of the addition. The credit count displayed in earn point display unit 10 at the termination of the addition update is "the credit count awarded corresponding to a predetermined combination of the hit symbols+the credit count awarded by a pocket win". The credit count displayed in credit count display unit 12 is the result of adding and subtracting the amount spent or earned up to the current stage of the game for the player. The credit value indicates the monetary value owned by the player.

Referring to FIG. 21B of pattern 2, a relatively small dollar bag 82*a* in which the number of coins (credit count) presented to the player due to a predetermined combination of symbols appears on play field 7 after an audio effect of a hit is generated from loudspeaker 19. The picture of dollar bag 82*a* is displayed in a dropping manner from the upper region of play field 7 downwards together with the audio effect from loudspeaker 19. The credit count displayed on dollar bag 82*a* is additionally added to update the value of earned point display unit 10 and credit count display unit 12 by increment of 1 and an audio effect of the clinking of coins is generated from loudspeaker 19.

Figure 22A:
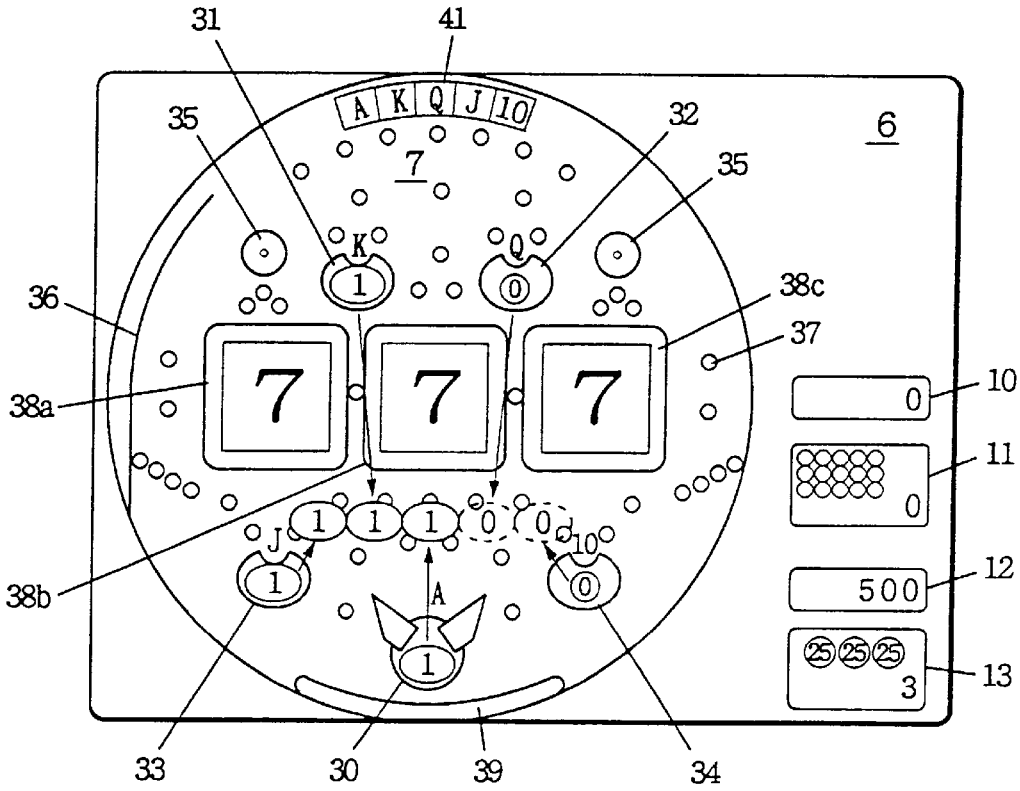
FIGS. 22A and 22B show images displayed on play board screen display region 6 when a pocket win is achieved and coins are to be dispensed.
Figure 22B:
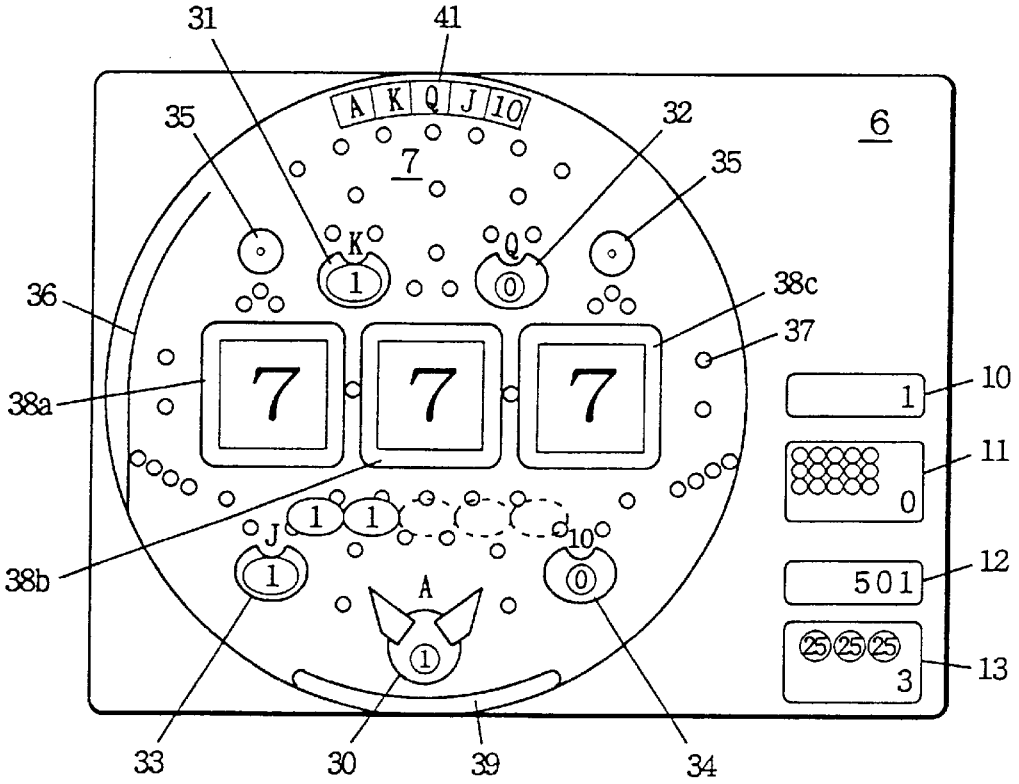

FIGS. 22A and 22B show play board screen display region 6 for describing the dispense display control by credit according to a pocket win. The winning count display region of a pocket attaining a win is displayed in a shifting manner as indicated by the arrow towards message display region 40*b* at the end of one play. In FIG. 22A, a shifting display of pockets, 30, 31 and 33 are shown since a win was achieved therein. However, the display of pockets 32 and 34 do not shift since they have not achieved a win. The winning count display region of a pocket with a win is displayed elliptically in a magnified manner. An audio effect indicating a shifting movement is generated from loudspeaker 19 corresponding to the shifting display of the win count display region.

Referring to FIG. 22B, the credit count corresponding to the number of wins displayed in the shifted winning count display region is provided to earned point display unit 10, and credit count display unit 12. In this sequential payment of the credit, the value in earn point display unit 10 and credit count display unit 12 are additionally updated one by one, and an audio effect corresponding to the pay-out is generated from loudspeaker 19. The winning count display region settled in account disappears sequentially from message display region 40*b*. The winning count display regions on the relevant pocket return to its normal size of display from the magnified display, and the number of wins is reset to 0.

Coin payment control will be described hereinafter.

Figure 23A:
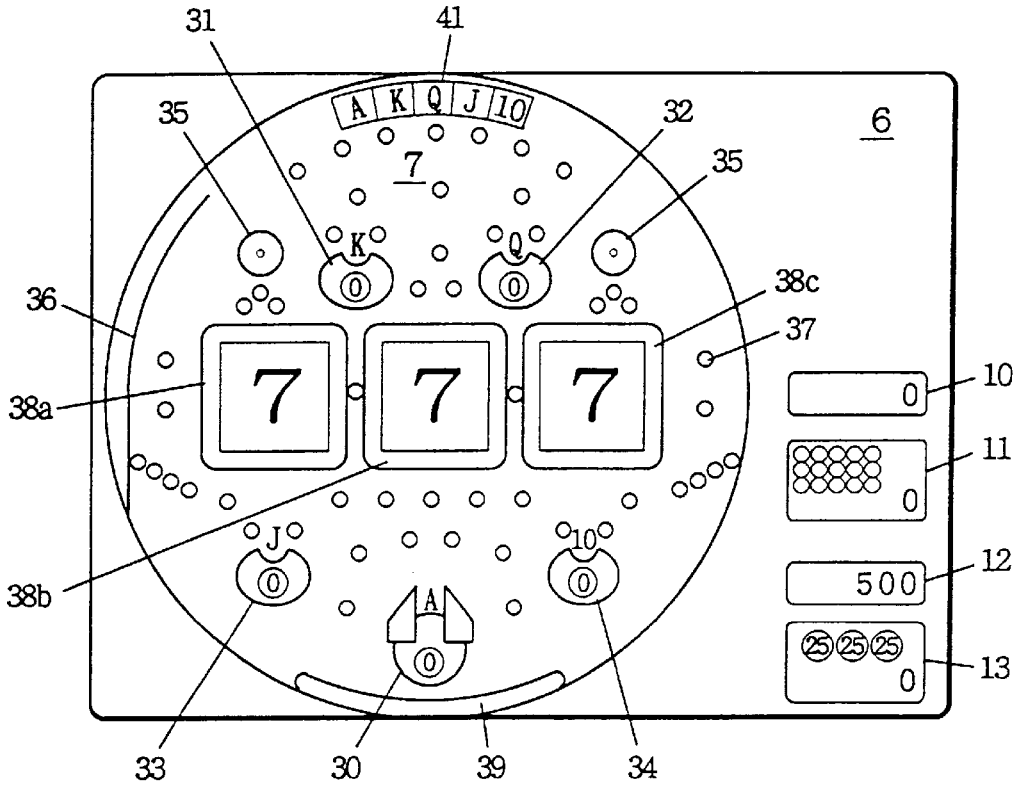
FIGS. 23A and 23B show images displayed on play board screen display region 6 when payment of credit is carried out.

Referring to FIG. 23A, the light-up of pocket win display region 41, the winning points in pockets 30–34, earn point display unit 10, bet count display unit 13 are all cleared in response to depression of payment button 21 by the player at the end of a game.

Figure 23B:
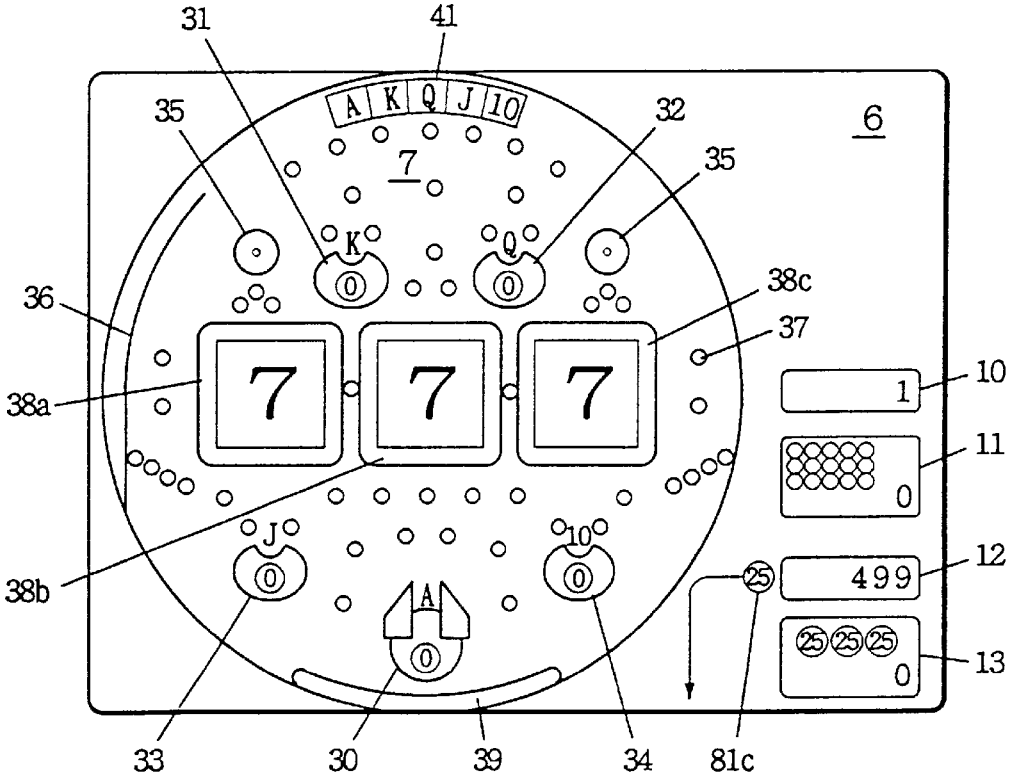

Referring to FIG. 23B, the value of the credit count is decremented by 1 in credit count display unit 12, and an image 81*c* of a quarter coin is displayed as moving in the direction indicated by the arrow. Then, one coin is paid out from hopper 138 (refer to FIG. 3) through outlet 25. An audio effect resembling discharge of a coin is output from loudspeaker 19 at each output of a coin, and "1" is added to the count display in earned point display unit 10. The operation of paying out a coin is repeated until the value in credit count display unit 12 becomes 0. Earned point display unit 10 will display the number of coins paid out at the time point where payment of all the credit count is completed. More specifically, earned point display unit 10 shows the credit count earned for each one game during a game play mode, and the number of coins paid during a coin payment control mode.

As described above, when the credit count displayed on credit count display unit 12 exceeds a predetermined credit count, or when a big hit by a jackpot is generated, payment of a coin from hopper 138 is not provided even when payment button 21 is depressed. A predetermined display that will be described afterwards will be shown in message display region 40*b* in such circumstances.

Figure 24:
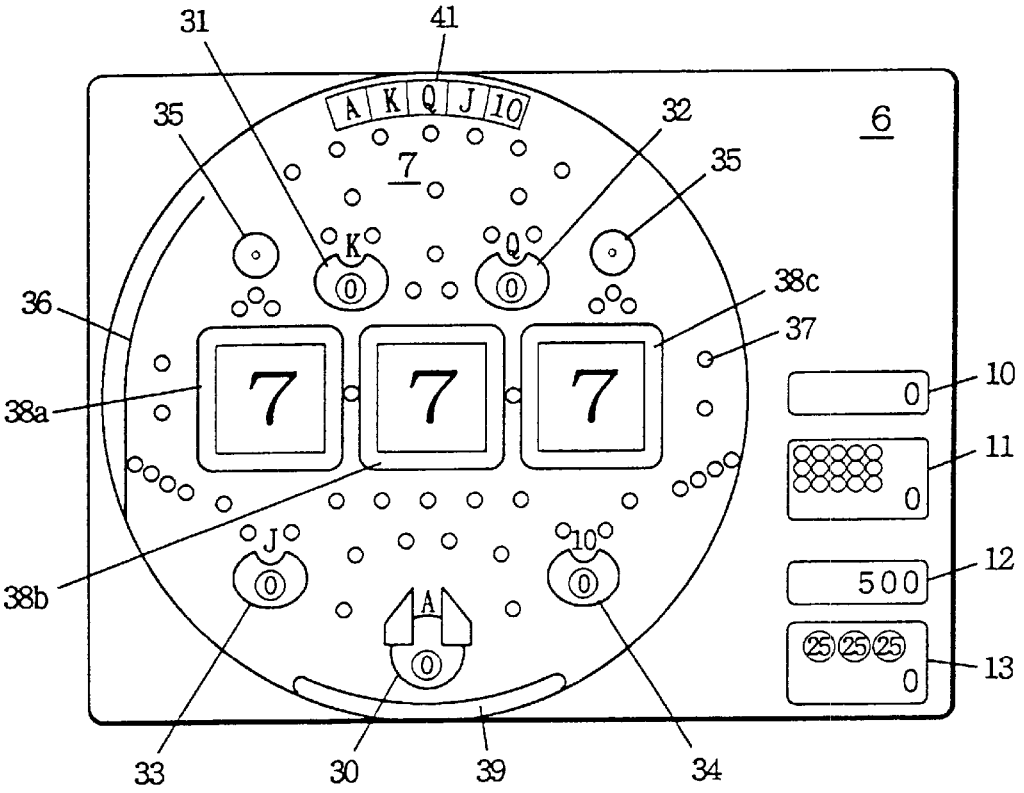
FIGS. 24–26 show images displayed on play board screen display region 6 when the credit is to be paid out by an attendant.
Figure 25:
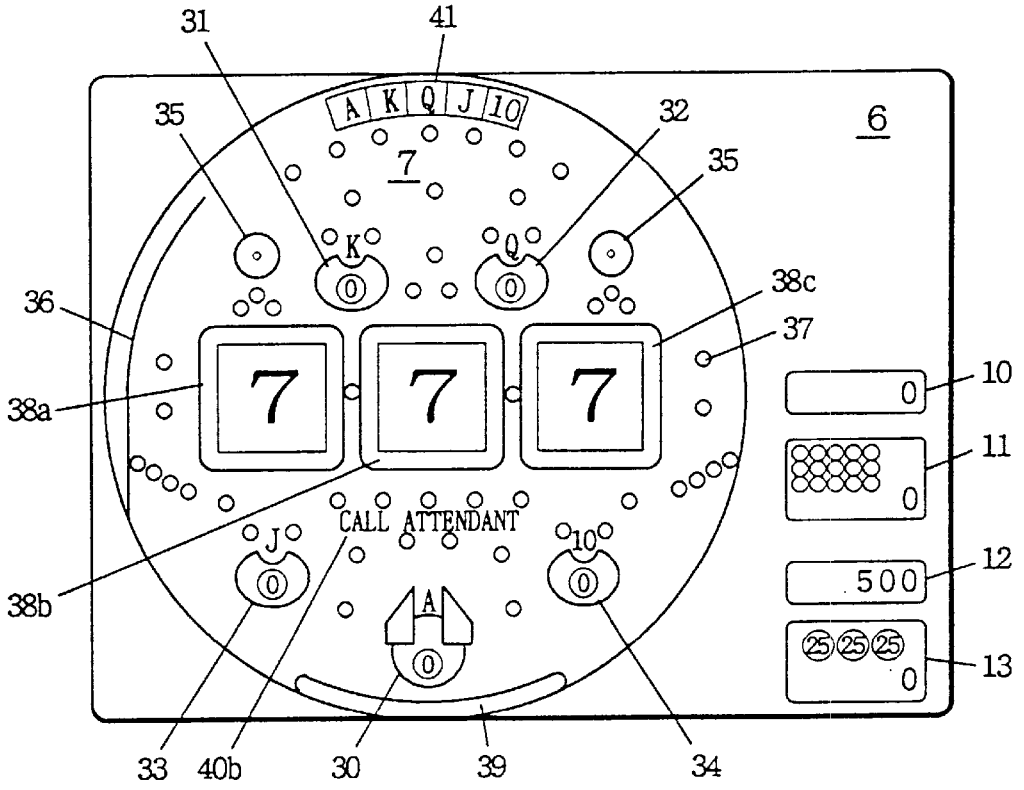
Figure 26:
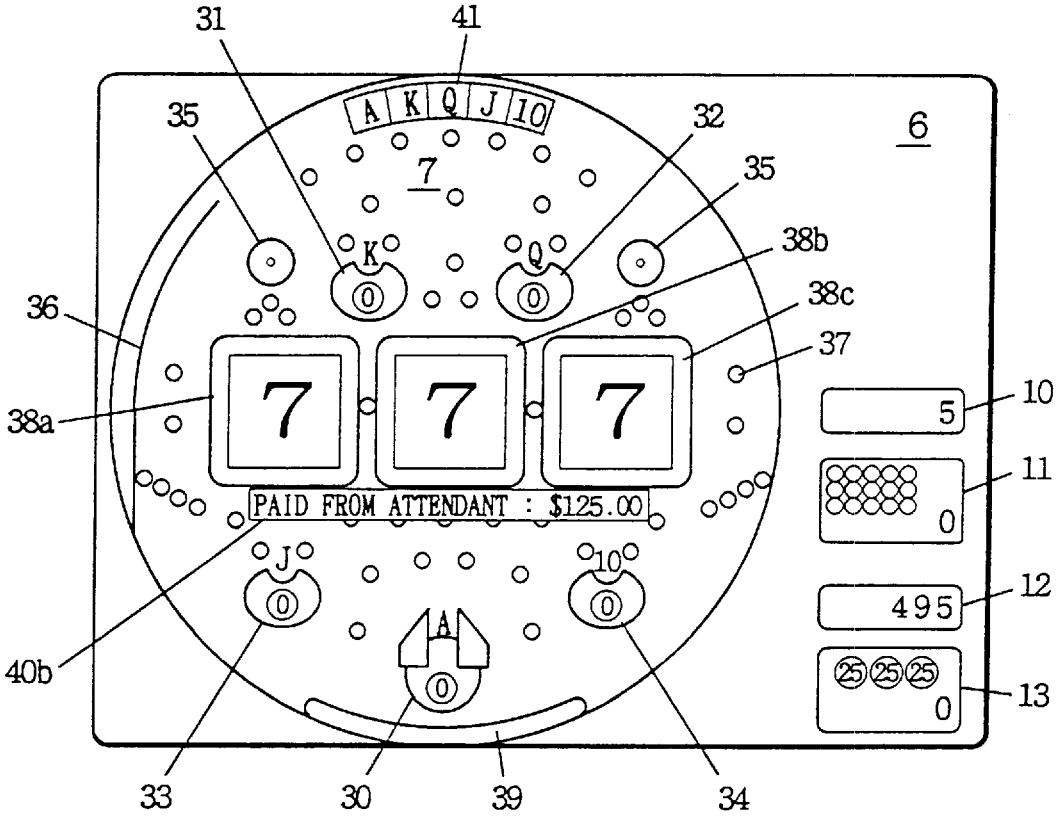

FIGS. 24–26 show play board screen display region 3 in a payment control mode when the credit count earned by the player exceeds a predetermined credit count.

Referring to FIG. 24, depression of payment button 21, when the credit count earned by the player exceeds a predetermined value, causes the light-up display in pocket win display region 41, the winning point display in pockets 30–34, the stake in game bet count display unit 13, and the remaining ball display in available ball count display unit 11 to be cleared. In the present embodiment, a structure is provided in which the hopper limit value which is the controlled number of coin-out is variable according to the strap setting of dual in-line package switch 145 (refer to FIG. 3). When the hopper limit value is set to 400, for example, and the value displayed in credit count display unit 12 in FIG. 24 is 500, a clear operation for various displays is carried out except for credit count display region 12 since the hopper limit value is exceeded.

Referring to FIG. 25, "CALL ATTENDANT" for calling an attendant is displayed in message display region 40*b* in a lighted manner following the clear operation of various displays in response to depression of payment button 21. Credit count display unit 12 is displayed in a blinking manner. In response to depression of call button 20 by the player according to the displayed message, candle lamp 14*a* provided at the top of image display type game machine 1 is lit up.

Referring to FIG. 26, an attendant is called according to depression of call button 20 by the player. The attending clerk inserts a key into reset switch 15 (refer to FIG. 1) to turn the key to a reset mode, whereby the credit count earned by the player is converted into the value count of dollars to be displayed in message display region 40*b*. More specifically, the credit count displayed in credit count display unit 12 is sequentially decremented by 5 in response to the operation of reset switch 15, and the count in earned point display unit 10 is sequentially incremented by 5. The amount to be paid for the player is displayed in an additionally updated manner in the unit of dollars in message display region 40*b*. Since the credit count indicated the value of 500 in the drawing, a value of 125 dollar is provided in message display region 40*b*.

The player receives the amount of money displayed in message display region 40*b* from the attendant. If the attendant turns reset switch 15 to its former state, the display in play board screen display region 6 attains its initial state to allow a new game to be played by insertion of a coin or a bill.

Payment control when a big hit is achieved will be described hereinafter with reference to FIGS. 27A and 27B.

Figure 27A:
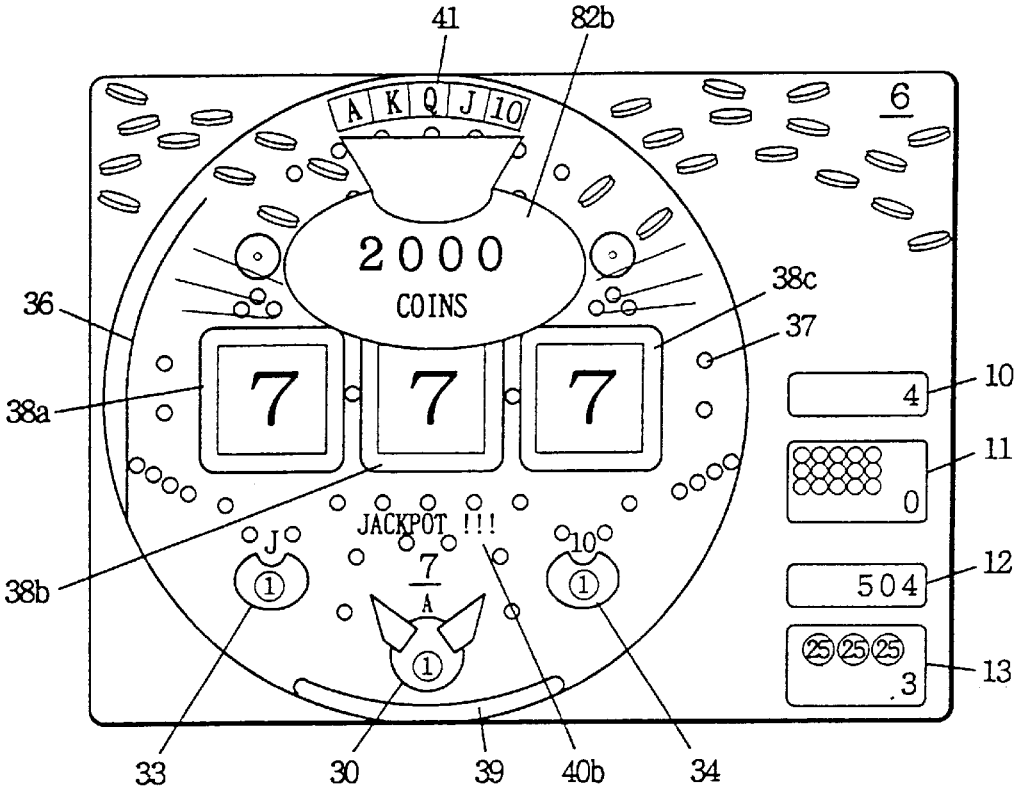
FIGS. 27A and 27B show images displayed on play board screen display region 6 when a reel jackpot is hit and a prize is to be dispensed.
Figure 27B:
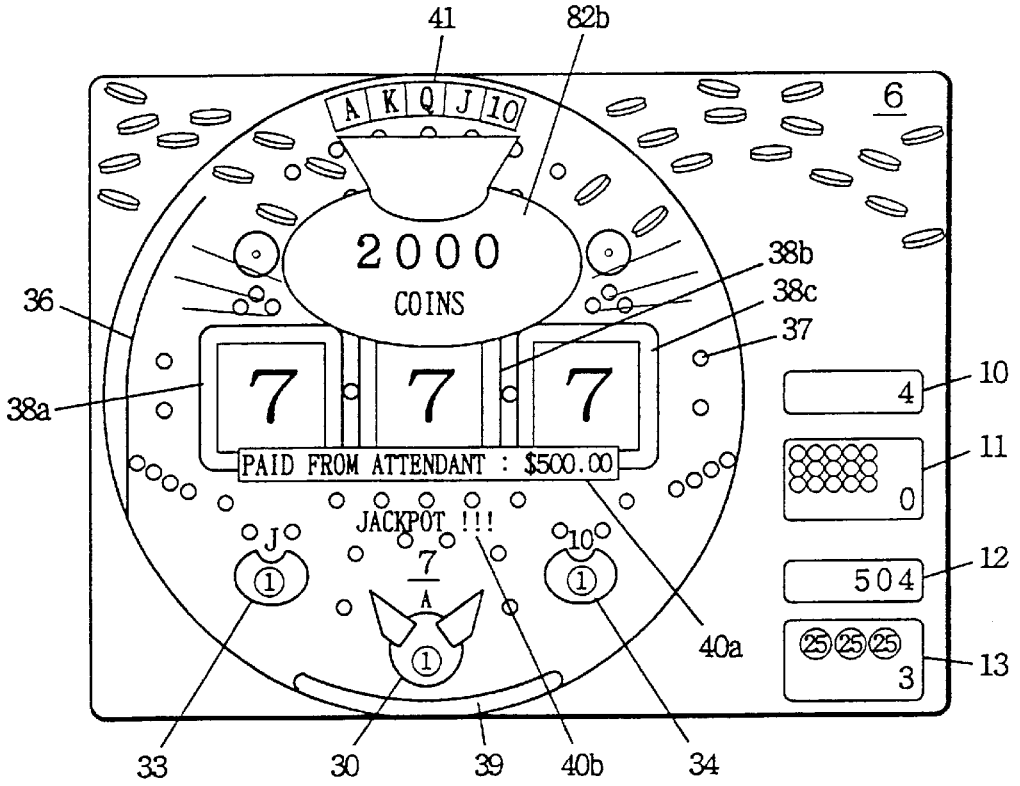

Referring to FIG. 27A of a reel jackpot hit, the combination of the symbols in the reels match a specific combination of symbols for a reel jackpot (symbols of number "7" with red as the background color). An audio effect informing achievement of a reel jackpot is generated from loudspeaker 19 at the end of the game. A relatively big dollar bag image 82*b* in which the number of coins (credit count) awarded to the player as a prize for the reel jackpot state is displayed in a dropping manner from the upper portion of play field 7 towards middle reel 38*b*. A graphical image indicating explosion of a plurality of coins is shown in play board screen display region 6 and an audio effect of "clinking" of coins colliding with each other is generated from loudspeaker 19. A message indicating a big hit is shown in message display region 40*b* in a lighted manner.

Furthermore, candle lamps 14*a* and 14*b* provided at the top of image display type game machine 1 are lighted up in a blinking manner. The operation of the game attains a interrupted state when a great hit is generated.

The attention of an attendant is called according to the blinking display of candle lamps 14*a* and 14*b* or by operation of call button 20 to pay out the credit for the player. The attendant inserts a key into reset switch 15 (refer to FIG. 1) and turns the key to a reset state. The amount of value or money to be paid to the player is displayed in message display region 40*b* similar to the control operation described with reference to FIG. 26. In the present invention, 2000 coins are awarded as credit to the player when a great hit of a reel jackpot is achieved. Therefore, a prize corresponding to 500 dollars is provided to the player. Following the payment of 500 dollars to the player by the attendant of the game house, the reset switch 15 is returned to its former state to unlock the game play interrupt state.

Figure 28A:
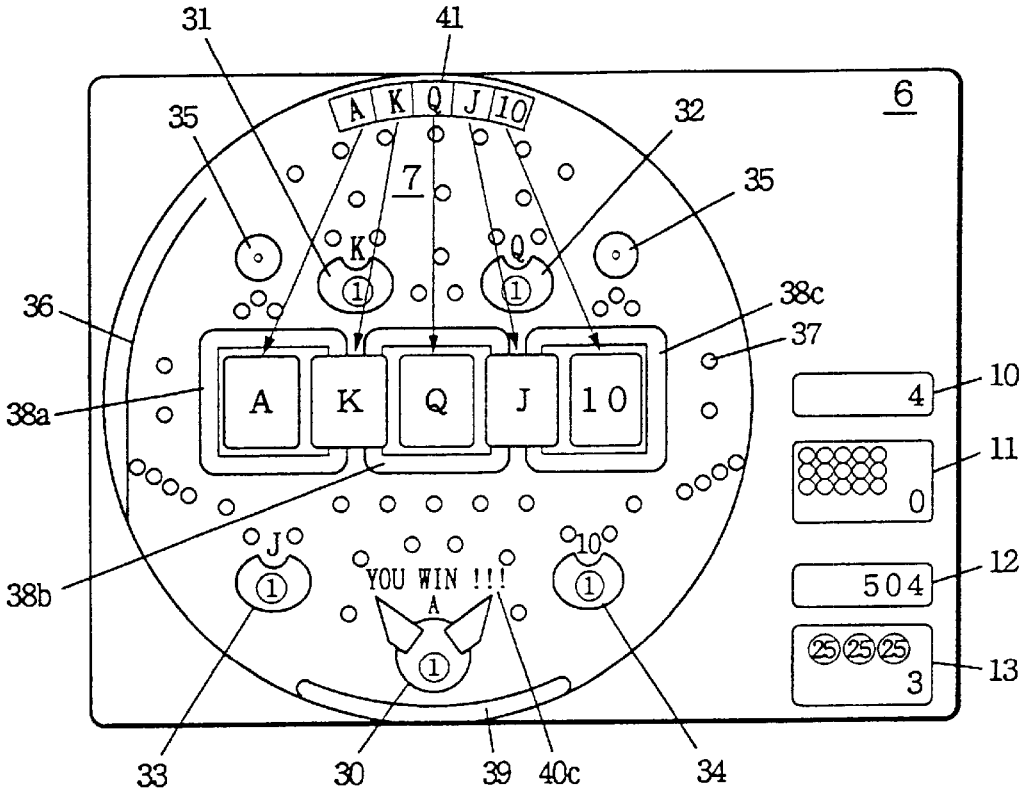
FIGS. 28A and 28B show images displayed on play board screen display region 6 when a pocket jackpot is hit.
Figure 28B:
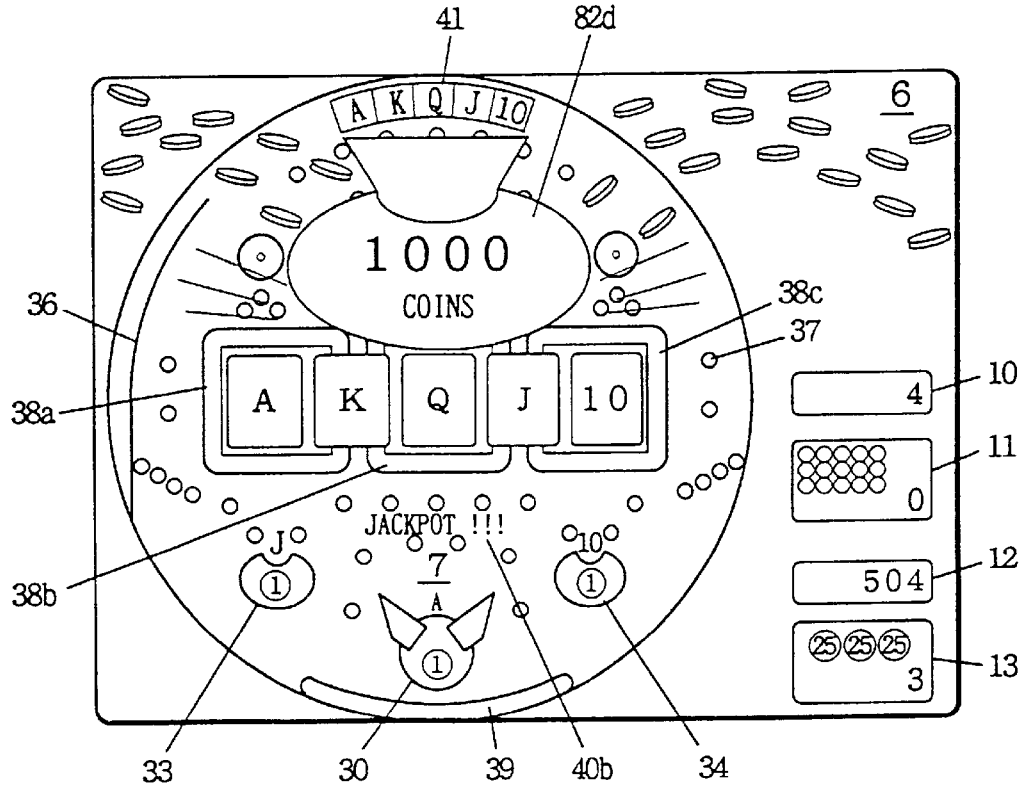

FIGS. 28A and 28B shows play board screen display region 6 during payment control when a great hit by a pocket jackpot is achieved.

Referring to FIG. 28A, the image of each card in pocket win display region 41 is shifted so as to overlie left reel 38*a*, middle reel 38*b* and right reel 38*c* as indicated by the arrow while being magnified in size at the end of the game in which a win is achieved in all the pockets. An audio effect of a pocket jackpot is generated from loudspeaker 19 to notify generation of a pocket jackpot. Furthermore, a message of "YOU WIN!" for example, is displayed in message display region 40*c* in a lighted manner for the period of one second.

Referring to FIG. 28B, a relatively big dollar bag 82*d* in which the number of coins (credit count) presented to the player by winning the big hit moves downward on the screen from the upper portion of play field 7 towards middle reel 38*b* together with the audio effect generated from loudspeaker 19. In the present embodiment, an amount of 1000 coins is earned by the player with respect to a big hit of a pocket jackpot. On the screen, an image of the coins being scattered as in an explosive manner is shown within play board screen display region 6 while the picture of the dollar bag 82*d* is falling down and an audio effect of tinkle of coins is generated from loudspeaker 19. A message of "HIT THE JACKPOT!!" indicating a big hit is displayed on message display region 40*b*. Furthermore, candle lamps 14*a* and 14*b* provided at the top of image display type game machine 1 are lighted up in a blinking manner. The game attains an interrupted state.

Figure 29:
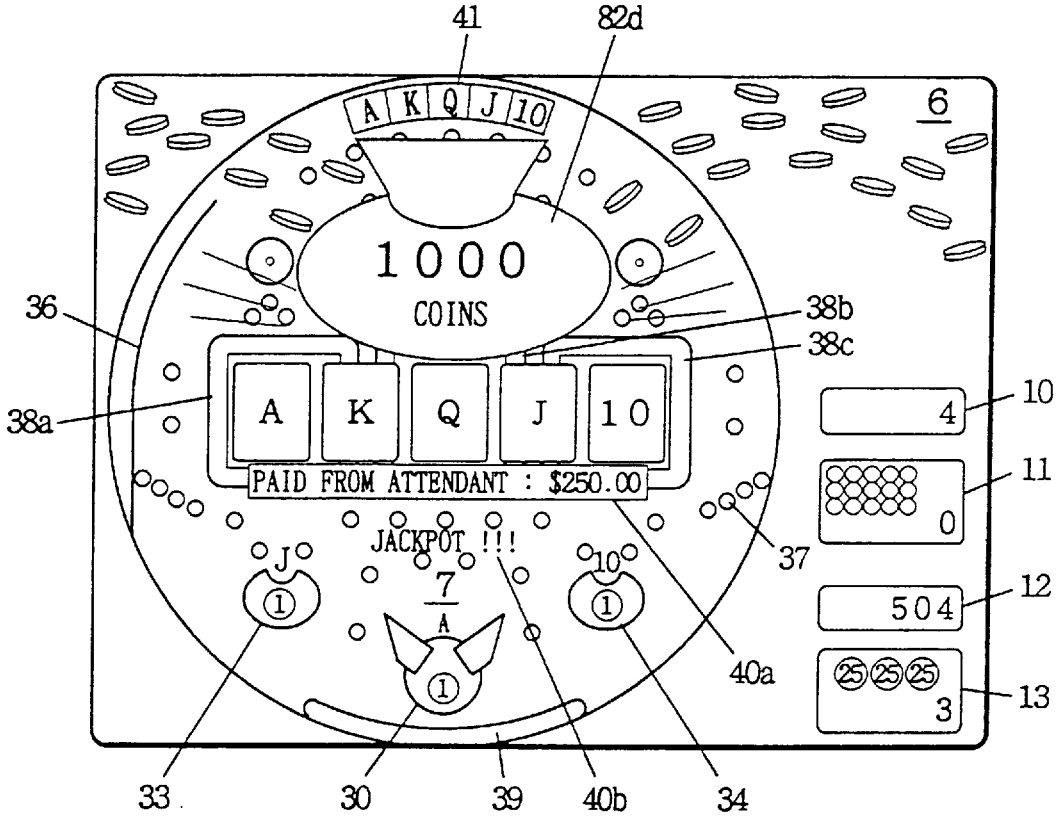
FIG. 29 shows an image displayed on play board screen display region 3 when a pocket jackpot is hit and a prize is to be dispensed.

When the game operation is suppressed, the attendant of the game house can carry out the aforementioned predetermined operation of reset switch 15, whereby the amount of money to be paid to the player is displayed in message display region 40*b* as shown in FIG. 29. Following the payment of a predetermined amount (250 dollars) to the player, reset switch 15 can be turned to its former state to release the suppress state of the game operation.

Figure 30A:
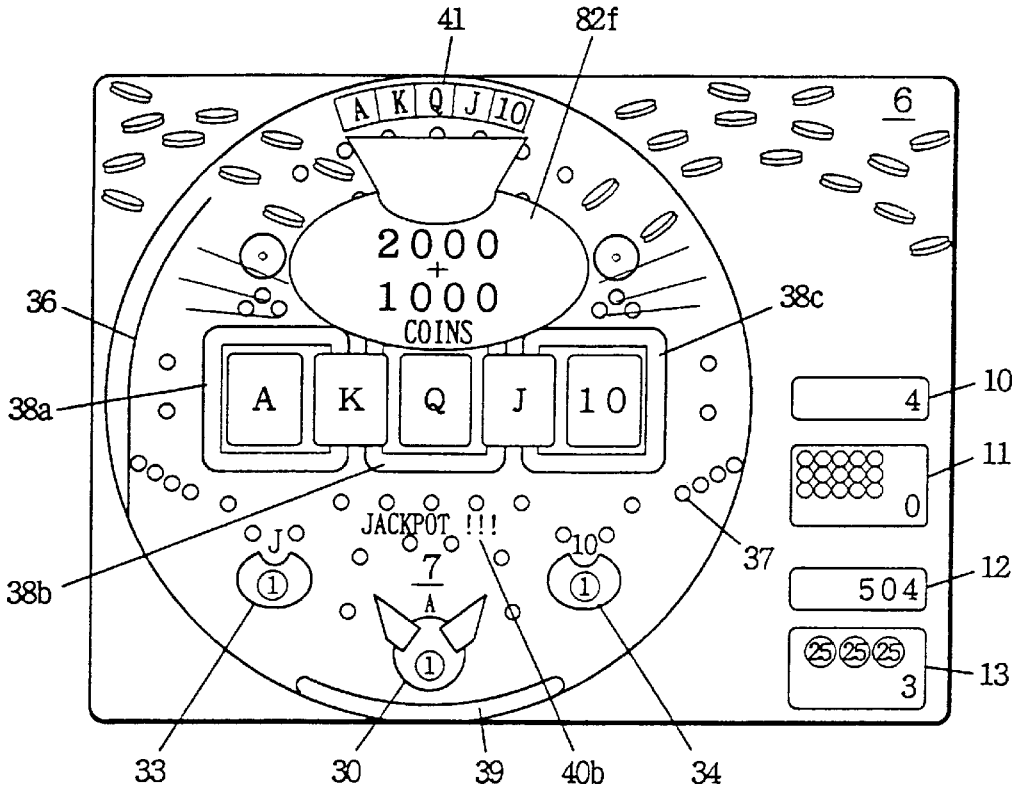
FIGS. 30A and 30B show images displayed in play board screen display region 6 when both a reel jackpot and a pocket jackpot are hit and a prize is to be dispensed.
Figure 30B:
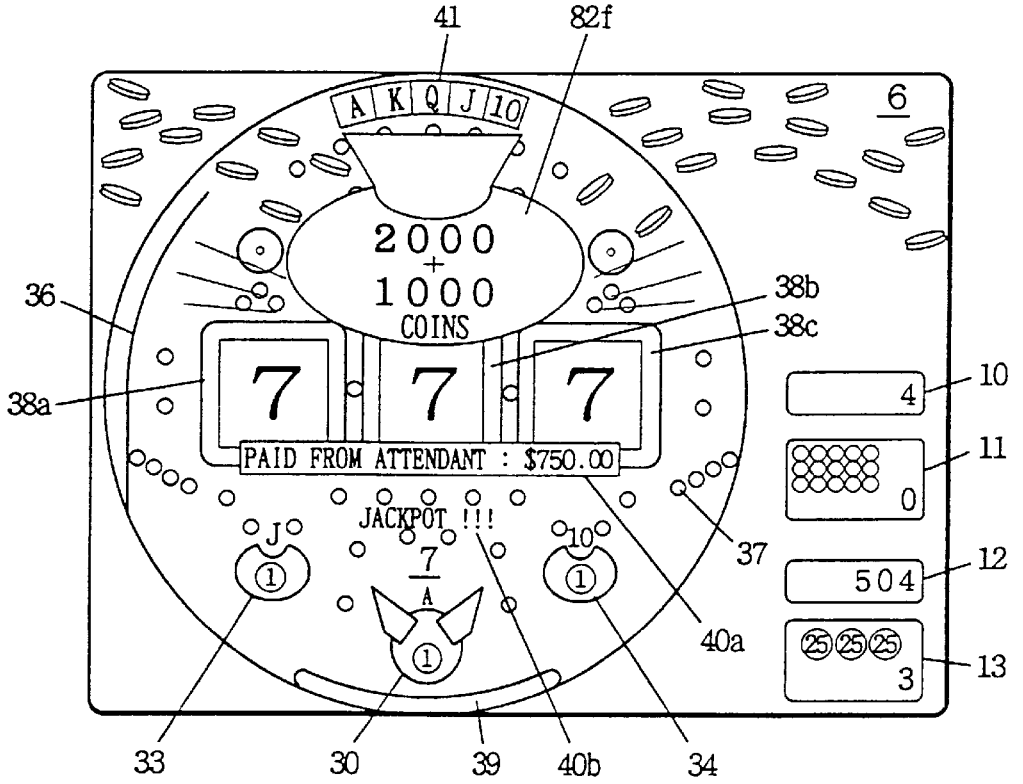

FIGS. 30A and 30B show play board screen display region 6 in which a reel jackpot and a pocket jackpot both occurs during one play.

Referring to FIG. 30A where the game has ended with the occurrence of both a reel jackpot and a pocket jackpot, each display region of pocket win display region 41 is shifted towards middle reel 38*b* while being magnified. A big dollar bag 82*f* in which the number of coins (1000) awarded to the player when winning a pocket jackpot and the number of coins (2000) awarded to the player when winning a reel jackpot are displayed therein is shown to fall down from the upper area of play board screen display region 6 to a region above middle reel 38*b* together with the audio effect from loudspeaker 19. Then, a picture of a plurality of coins scattered in an explosive manner in play board screen display region 6 is shown with the audio effect of the collision of coins from loudspeaker 19. Furthermore, each picture card of A, K, Q, J, and 10 constituting the respective regions of pocket winning display region 41 shifted to a region above middle reel 38*b* are shown on screen in an alternating manner. More specifically, the picture of the cards appear in front of left reel 38*a*, middle reel 38*b* and right reel 38*c*, i.e., overlying the reels, and then appear at the back side of the reel, i.e. overlaid by the reels. Candle lamps 14*a* and 14*b* of image display type game machine 1 are lighted in a blinking manner to call the attention of the attendant.

Referring to FIG. 30B, the attendant of the game machine manipulates switch 15 as described before to pay a predetermined amount of money to the player. The amount paid to the player when there is double hit of a pocket jackpot and a reel jackpot is 750 dollars.

Figure 31:
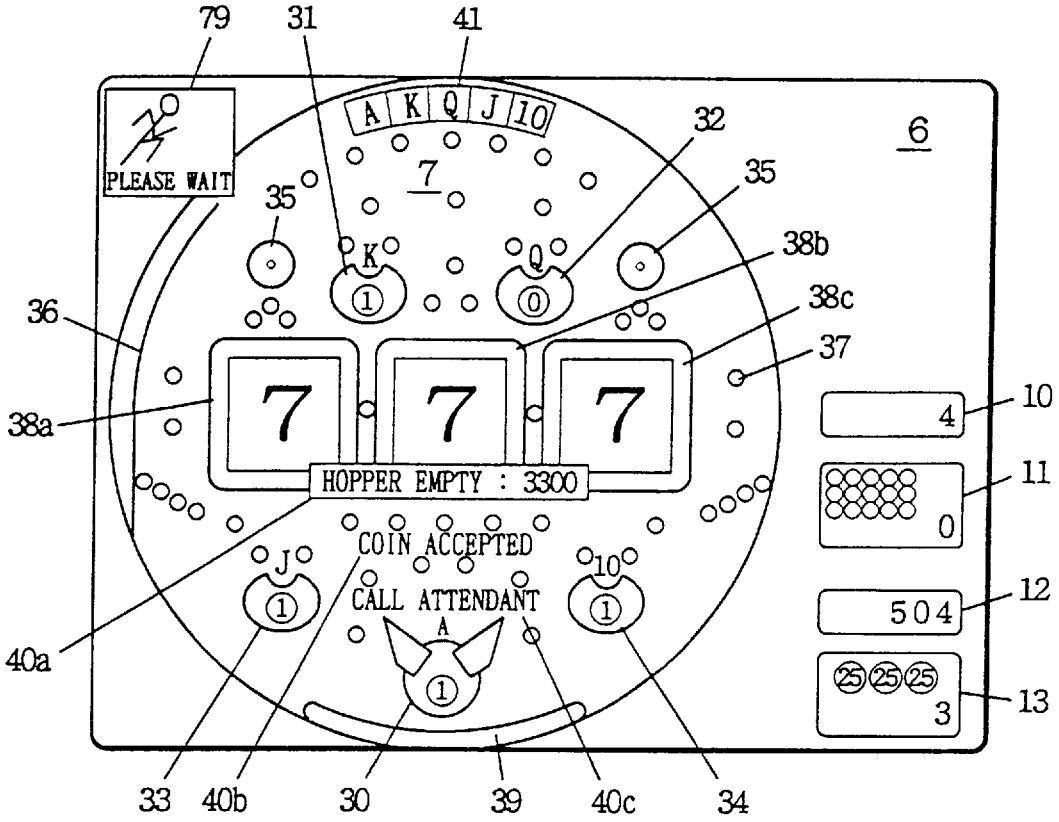
FIG. 31 shows an image displayed in play board screen display region 6 when an error occurs during a play.

FIG. 31 shows a play board screen display region 6 when an error occurs during a play. A picture 79 showing the image of an attendant appears at the upper left portion of play board screen display region 6. The cause of the fault and an error code are shown in message display region 40*a*. In message display region 40*c*, a message is displayed prompting the player to call the attendant. Furthermore, candle lamp 14*a* provided at the top of image display type game machine 1 is lighted in a blinking manner. In FIG. 31, a message is displayed informing that there are no coins left in hopper 138 and that payment of coin is disabled as the cause of the error. In earn point display unit 10, the number of coins paid out before the hopper became empty is shown in a blinking manner. Other types of errors causing the blinking display of earned point display unit 10 includes the case where coins to be paid are jammed (coin-out jam), and when excessive coins are paid out (excessive coin-out).

After the attendant deals with the error, reset switch 15 can be operated to reset the game machine. Then, the player can return to his or her play.

Figure 32:
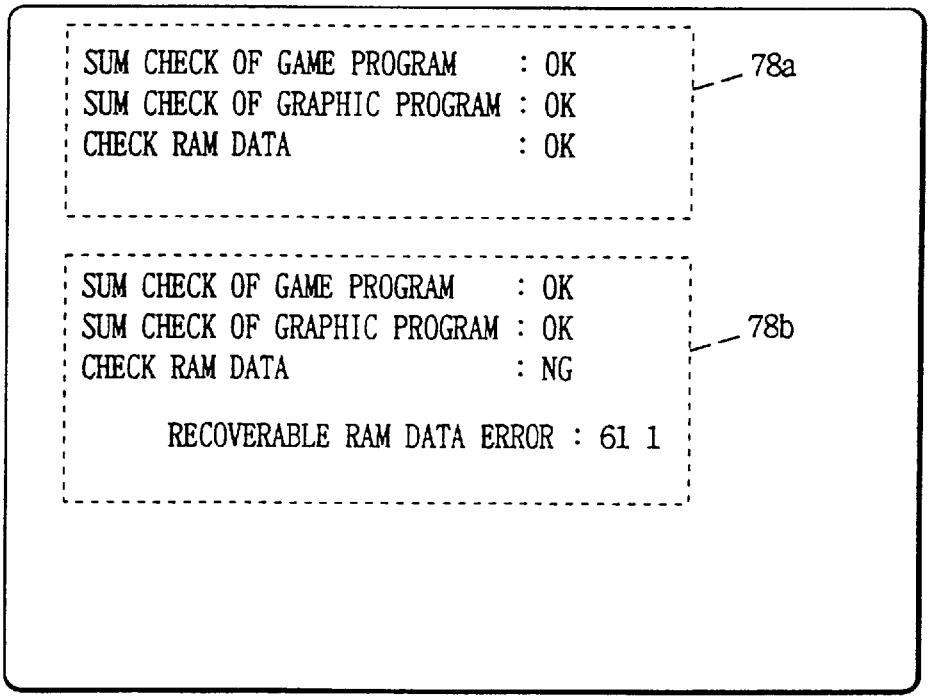
FIG. 32 shows results of system checking provided on screen display region 6.

FIG. 32 shows a check result display of ROM 152 and RAM 151 carried out right after the power of the game machine is turned on.

When the power of the game machine is turned on, a sum check of the game program to carry out game control, a sum check of the graphic program to carry out image display control, and verification of the various game administration data stored in RAM 151 and various counters used in the game control are effected. The game program and the graphic program are stored in ROM 152. The result of the system check is shown in play board screen display region 6.

When the result of the system checking is proper, a system check result display representation 78*a* is shown. The result is displayed for each checking item, i.e. the result of checking the game program, the result of checking the graphic program, and the result of checking the RAM data. The letters of "OK" is shown when the relevant check item is determined as being proper as a result. Following this display for a predetermined time period, display control is effected to switch the screen automatically to a screen play field 7 or the like to proceed to a state in which a game play is allowed.

A system check result display representation 78*b* shows an example that is displayed when an error is detected as a result of the system check. The item detected as having an error is indicated by the letters of "NG". The cause of the error and the error code are also shown. It is appreciated from system check result display representation 78*b* in FIG. 32 that an error is detected in the check of the RAM data, and that the error can be recovered by the message of "Recoverable RAM data error:61 1". The "61 1" therein is the error code. When an error is detected, the error display is continuously shown on the screen unless a reset operation by manipulating reset switch 15 is carried out.

An error in RAM data detected in system checking will be described in detail hereinafter. In the present embodiment, data that are particularly important are stored in three storage regions within RAM 151 for protection. During the system check, determination is made whether the data stored in the three storage regions all match each other or not. A "proper state" is determined when all the data match. When only data in two storage regions match, determination is made that there is an error in the data stored in the remaining one storage region. The result of the check is indicated as "Recoverable Error". In the case of a "Recoverable Error" of RAM data, the data error can be solved by copying the proper data (the data stored in one of the three storage regions matching the other data) into the storage region where the error data is stored after the error data is cleared by the reset operation carried out by the attendant.

When all the data stored in the three storage regions differ from each other, the result of the check is provided as "Unrecoverable Error".

When the RAM data is recoverable as indicated in system check result display representation 78*b* and the attendant of the game house manipulates reset switch 15 to effect a reset operation, a system check will be carried out again after the recovery procedure of the error data is effected. When no error is detected as a result of the system check, system check result display representation 78*a* is shown for a predetermined time period, and a game can be played. When the result of the system check is an "Unrecoverable Error" of RAM data, play field screen display region 6 is switched into a data display mode by manipulation of reset switch 15 to carry out a clear procedure of RAM data that will be described afterwards. Then, system check is carried out again. When a display is provided that there are no errors, game machine 1 proceeds to a state that allows a game to be played.

All the results of the system check is shown on screen display region 6. More specifically, screen display region 6 is commonly used as a screen used for playing a game such as play field 7, and for displaying the system check result.

FIG. 33 shows a menu of a various data stored in game machine 1.

The screen of FIG. 33 is shown in screen display region 6 when the attendant of the game house inserts a key into reset switch 15 (refer to FIG. 3) to enter a data display mode. In a data display mode, data is displayed in play board screen display region 6. Also, operation buttons required to select data are shown together with its function. The operation buttons required to select data and the buttons used for a game play are used in common. More specifically, the function of each button differs depending upon reset switch 15 (refer to FIG. 3) set to the COM position and set to the data display position.

Referring to FIG. 33, 20*a* is a graphical representation corresponding to call button 20. When call button 20 is depressed, the currently displayed screen is switched to a screen of one higher hierarchy. 22*a* is a graphical representation corresponding to 1-bet button 22. When 1-bet button 22 is depressed, a cursor of a predetermined color moves upwards on the menu. 24*a* is a graphical representation corresponding to start button 24. When start button 24 is depressed, a cursor moves downwards on the screen. 23*a* is a graphical representation corresponding to maximum-bet button 23. When maximum-bet button 23 is depressed, data of the item selected by the cursor in the menu is displayed. It is therefore possible to display the selected data in the menu by selecting a menu with 1-bet pattern 22, start button 24, and then maximum-bet button 23. In a data display mode, all the buttons other than those displayed on the screen are invalid. Therefore, no procedure is executed when payment button 23 not shown in FIG. 33 is depressed.

SOFT METER is a menu for displaying the account information of the game machine. CLEAR SOFT METER is a menu used in clearing the data in the soft meter. BILL INSERTION DATA shows data of the amount for each type of paper note inserted into bill receptor 17. CLEAR BILL IN-DATA is a menu used in clearing the data of the bill-in data. GAME REPLAY DATA shows a menu for recalling games in the past. ERROR STATISTICAL DATA shows a menu for displaying the types and number of occurrence of errors detected in the past. CLEAR ERROR STATISTICAL DATA is a menu used in clearing the data of the error statistics. RAM DATA CLEAR is a menu used in clearing the data within RAM 151. The DESIGN OF DISPLAY IMAGE menu is used in designing a picture or image of a flipping ball or the like used in the game. DUAL IN-LINE PACKAGE SWITCH SETTING DATA shows a menu used in confirming the setting of dual in-line package switch 145 provided in main substrate 140. SELF-TEST is a menu used in functional testing of hopper 138 and display adjustment of CRT.

Figure 34:
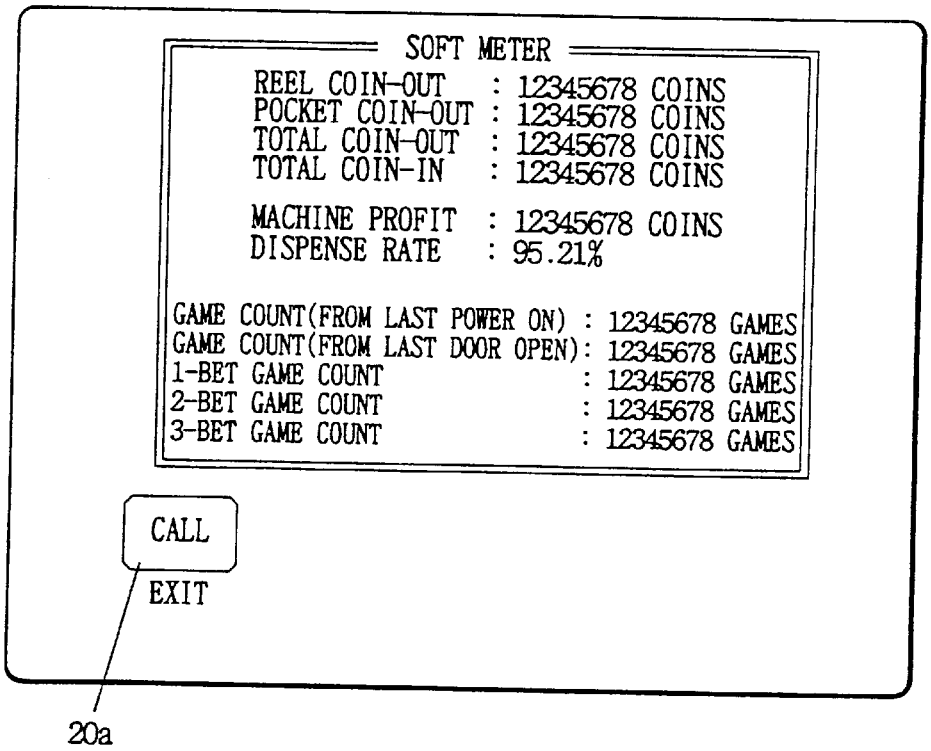
FIG. 34 shows an image of SOFT METER displayed in screen display region 6.

FIG. 34 shows the display of SOFT METER. The number of coins (credit count) paid out in response to achievement of a predetermined combination of the stationary display of symbols is indicated in the item of REEL COIN-OUT. The value therein includes the credit awarded to the player when a reel jackpot was hit. The number of coins paid out in response to a pocket win is shown in POCKET COIN-OUT. This value includes the credit paid out for the player when a pocket jackpot was hit. The sum of the value in REEL COIN-OUT and in POCKET COIN-OUT is indicated in the field of TOTAL COIN-OUT. The TOTAL COIN-IN indicates the number of coins (credit count) consumed in game. The result of the value of the TOTAL COIN INSERTION COIN minus the value of the total TOTAL COIN-OUT is indicated as the machine profit. The value of dividing the total number of coins paid out divided by the total number of coins inserted is indicated as the dispense rate in percentage. The number of games played from the power-on of the game machine is shown in the field of GAME COUNT (after power on). The number of games played after the prior opening/closing of front cover panel 5 is shown in the field of GAME COUNT (after door/open close). The value in 1-BET GAME indicates the number of games played on a 1-coin bet. The value in 2-BET GAME indicates the number of games played on a 2-coin bet game. The value in 3-BET GAME indicates the number of games played on a 3-coin bet game.

The values displayed in fields other than the GAME COUNT fields (after power on, and after door open/close) are continuously updated until a clear process of SOFT METER is effected. The values will not be cleared even when the power of the game machine is turned off. Since only call button 20*a* is shown in the display of the soft meter, operations via buttons other than the call button are invalid.

FIG. 35 shows a display a menu for clearing the soft meter. When the maximum-bet button is depressed when CLEAR SOFT METER is displayed, data of the soft meter is cleared. The display can be switched back to the menu display of FIG. 33 by pressing call button 20 regardless of whether maximum-bet button 23 is depressed or not.

FIG. 36 shows a screen of BILL-IN DATA. The number of paper notes accepted via bill receptor 17 is shown according to each kind of paper note. Also, the total amount of the inserted bills is indicated. The menu screen of FIG. 33 can be recalled by depressing call button 20.

Figure 37:
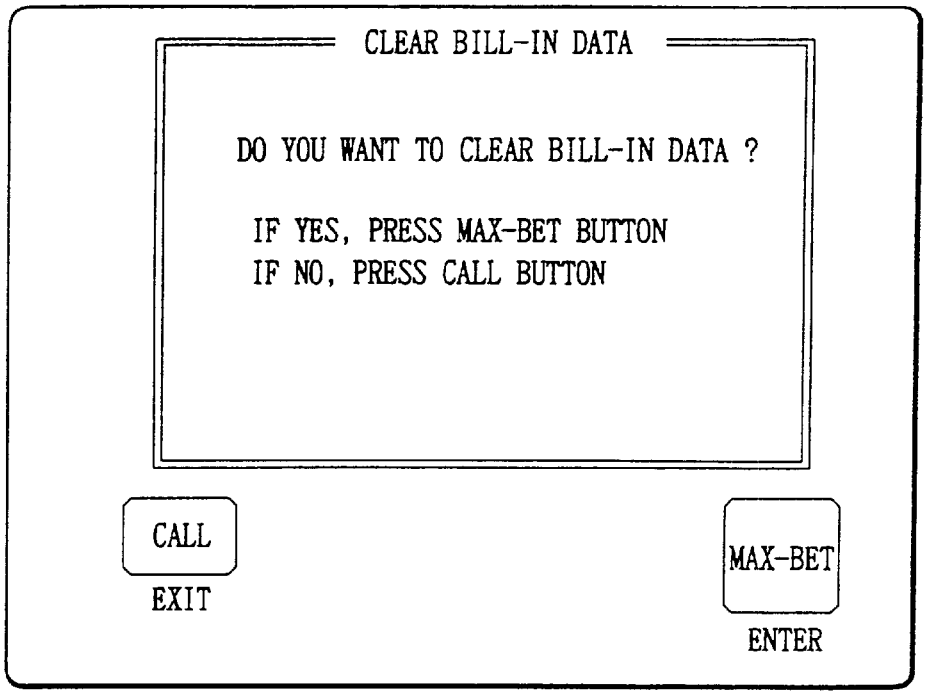
FIG. 37 shows an image of CLEAR BILL-IN DATA displayed in screen display region 6.

FIG. 37 shows a screen of CLEAR BILL-IN DATA. The data is cleared by depressing maximum-bet button 23. The screen can be switched back to the menu screen of the FIG. 33 by depressing call button 20.

Figure 38:
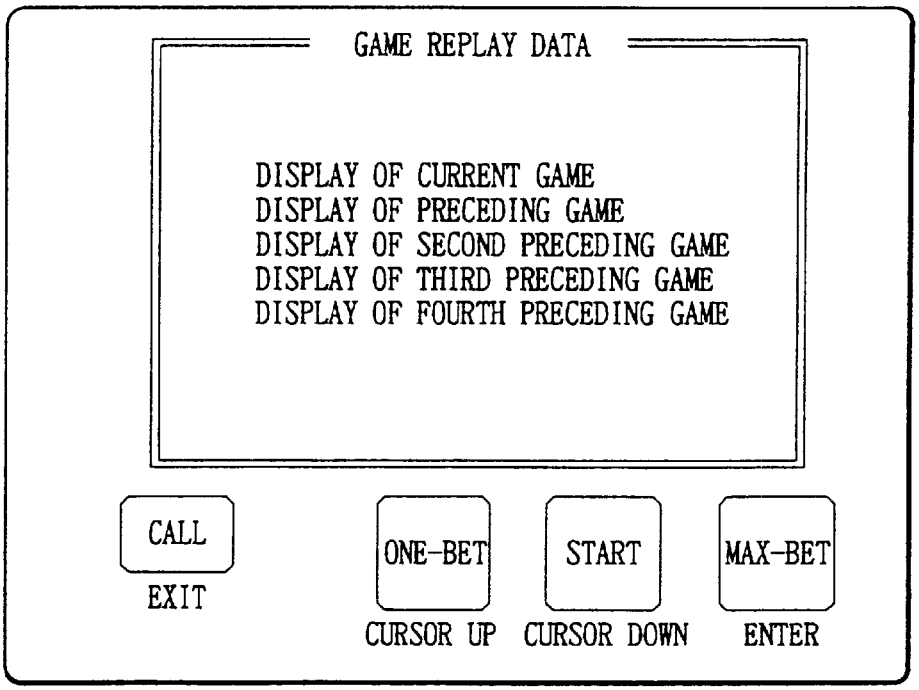
FIG. 38 shows an image of GAME REPLAY DATA displayed in screen display region 6.

FIG. 38 shows a display for GAME REPLAY DATA. In this screen, the cursor can be moved by operating 1-bet button 22 and start button 24. Using the cursor, any of the display of the current game, the preceding game, the second preceding game, the third preceding game, and the fourth preceding game can be selected. By depressing maximum-bet button 23 after selecting a particular game to be displayed, the selected game will be replayed on the screen. The screen can return back to the menu screen of FIG. 33 by depressing call button 20.

FIG. 39 shows a display of ERROR STATISTICAL DATA. The error code of the latest error and the cause thereof are indicated in the field of "LAST GENERATED ERROR CODE". A message indicating that no coins are left in the hopper and the error code of "3300" are shown in FIG. 39. In respective fields other than "LAST GENERATED ERROR CODE", the number of times of respective error occurrence is displayed in an accumulated manner. "LOW BATTERY" is an error detected when the voltage of capacitor 153 (refer to FIG. 4) becomes lower than a certain level when power is turned on. "INSERTED COIN JAMMING" is an error detected when the coins inserted through coin inlet 18 are jammed in coin selector 144. "COIN IMPROPER INSERTION" is an error message when the second sensor downstream of the coin passage does not provide a detection signal of a coin within a predetermined time period after the first sensor upstream of the coin passage of coin selector 144 provides a coin detection signal. Such an error occurs as in the case of an illegal action by preventing a coin from falling down with a string. "EXCESSIVE COINS OUT" is an error detected when extra coins are discharged after the dispense procedure of coins from hopper 138 is completed. "COIN-OUT JAMMING" is an error detected when jamming occurs in the discharging coin. This is detected at the elapse of a predetermined time (one second) of the ON period of a coin-out sensor provided in hopper 138 during the drive of hopper 138. "NO COINS IN HOPPER" is an error detected when there are no coins to be discharged from hopper 138. Determination is made that hopper 138 is empty if a coin pay out sensor provided in hopper 138 is not turned on at an elapse of a predetermined time period (8 seconds). "UNRECOVERABLE RAM DATA ERROR" is detected when the data stored in three storage regions in RAM 151 in a repeated manner do not match each other. "RECOVERABLE RAM DATA ERROR" is detected when only one of the three data stored in the three storage regions do not match the other two. "PROGRAM RUNAWAY" is an error detected when the game control program (game program) or the image display control program (graphic program) runs away. "MOMENTARY POWER FAILURE" is an error detected when the power supply is cut off temporarily.

The statics of this error will be updated in an accumulated manner until a clear process for the error statistical data is effected. The menu screen of FIG. 33 can be recalled by depressing call button 20.

Figure 40:
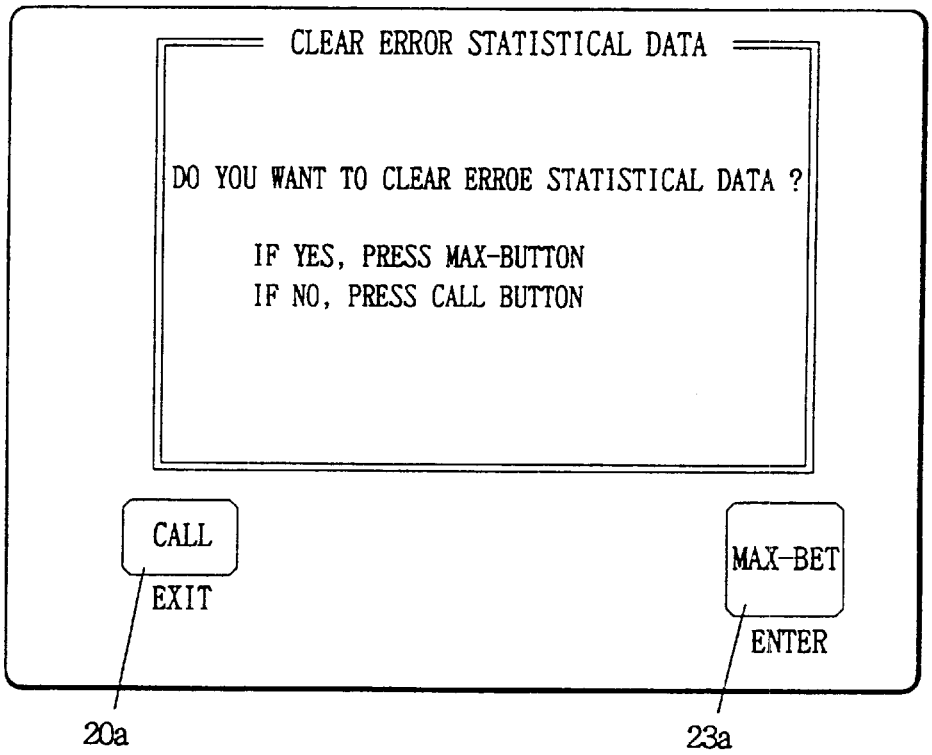
FIG. 40 shows an image of CLEAR ERROR STATISTICAL DATA displayed in screen display region 6.

FIG. 40 shows the menu of clearing error statistical data. The data are cleared by depressing maximum-bet button 23. The screen returns back to the menu screen of FIG. 33 by depressing call button 20.

Figure 41:
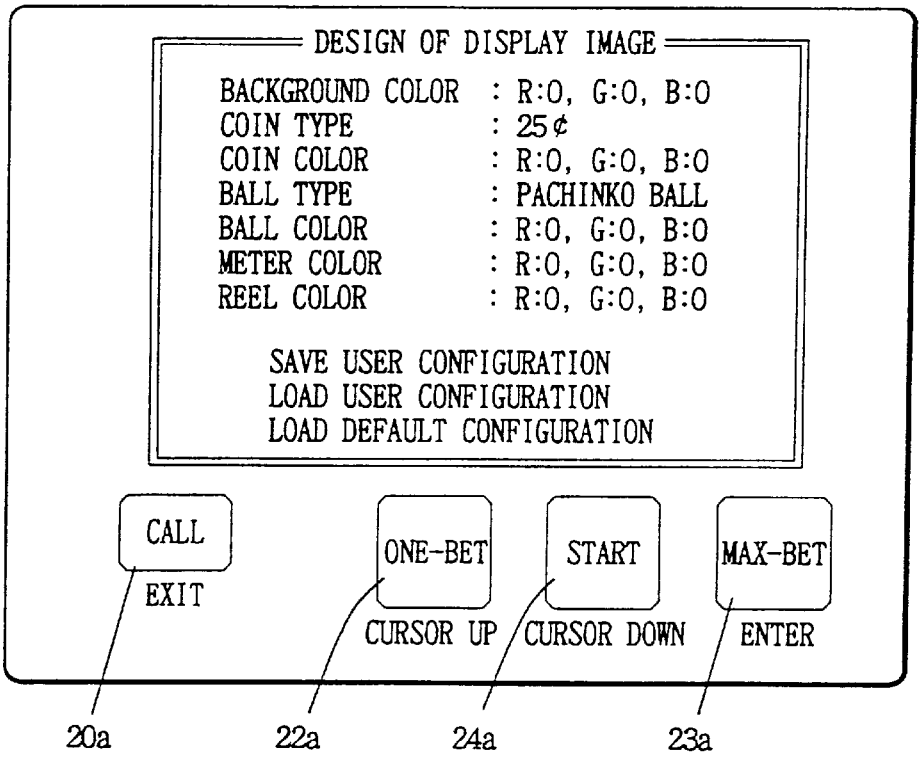
FIG. 41 shows an image of DESIGN OF DISPLAY IMAGE displayed in screen display region 6.

FIG. 41 shows the designing of the display picture. The background color, the type of coins displayed on the screen, the color of the coin, the type of ball to be flipped, the color of the ball, the color of the meter, and the color of the reel of the current play field 7 are shown. In the display, "R" shows the color intensity of red, "G" shows the color intensity of green, and "B" shows the color intensity of blue. It is also shown that a quarter is selected as the coin to be displayed, and a pachinko ball is selected as the type of ball to be flipped.

The cursor can be shifted to a relevant field by operating 1-bet button 21 and start button 24. By shifting cursor on the screen to an appropriate field and depressing maximum-bet button 23, the selected field item can be set. "SAVE USER CONFIGURATION" is a field for saving the design after the background color, the type of coins, and the like are set. "LOAD USER CONFIGURATION" is a field used in changing the design value saved as the user configuration. "LOAD DEFAULT CONFIGURATION" is a field to return to the default of the design of the screen. By operating 1-bet button 22 and start button 24 to shift the cursor to the field of an appropriate configuration and then depressing maximum-bet button 23, the design contents of the display screen is modified according to the selected contents.

Figure 42:
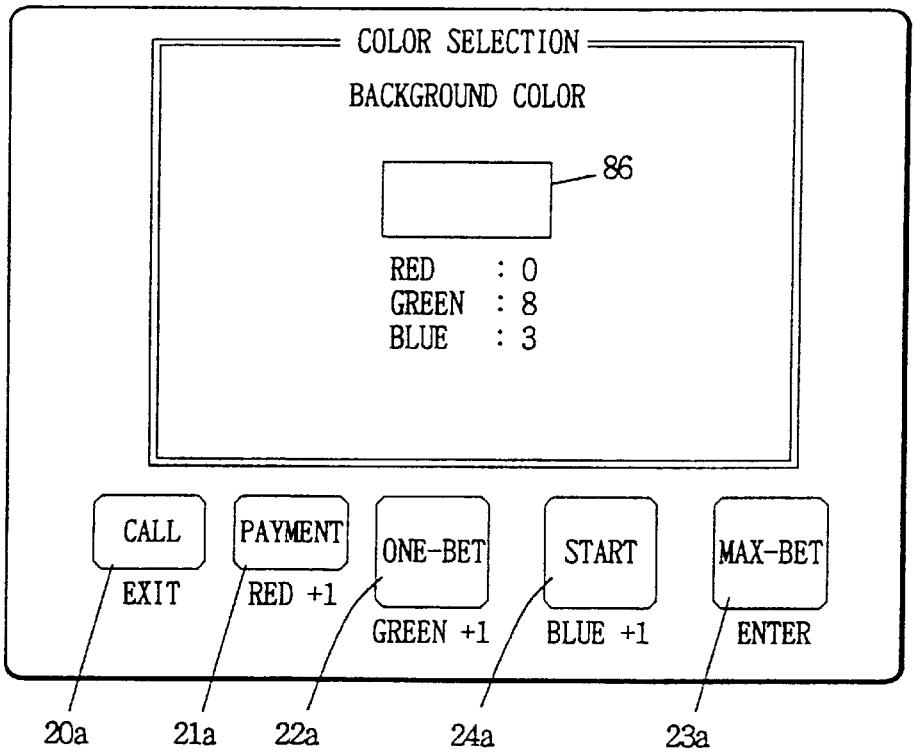
FIG. 42 shows an image of COLOR SELECTION OF BACKGROUND COLOR displayed in screen display region 3.

FIG. 42 shows a screen displayed in selecting the field of the background color of FIG. 41. The numeric value in the field of "RED" is incremented according to the number of depressions of payment button 21, whereby the intensity of the red color in a sample color display region 86 is increased. Also, the numerical value in the field of "GREEN" can be incremented to increase the intensity of the color of green in sample color display region 86 according to the number of depressions of 1-bet button 22. Similarly, the numerical value of the field of "BLUE" can be incremented to increase the intensity of the color of blue in sample color display region 86 according to the number of depressions of start button 24. The background color can be set to a desired design by appropriately operating payment button 21, 1-bet button 22, and maximum-bet button 23. When the number of depressions of respective buttons come to a predetermined value, the numerical value in the field returns to 0 to allow accumulation again.

The background color can be fixed by depressing maximum-button 23 after designing the background color. Depression of call button 20 causes the screen to be switched to the display screen of FIG. 41. Data of the newly designed background color are displayed in the field of "BACKGROUND COLOR".

Figure 43:
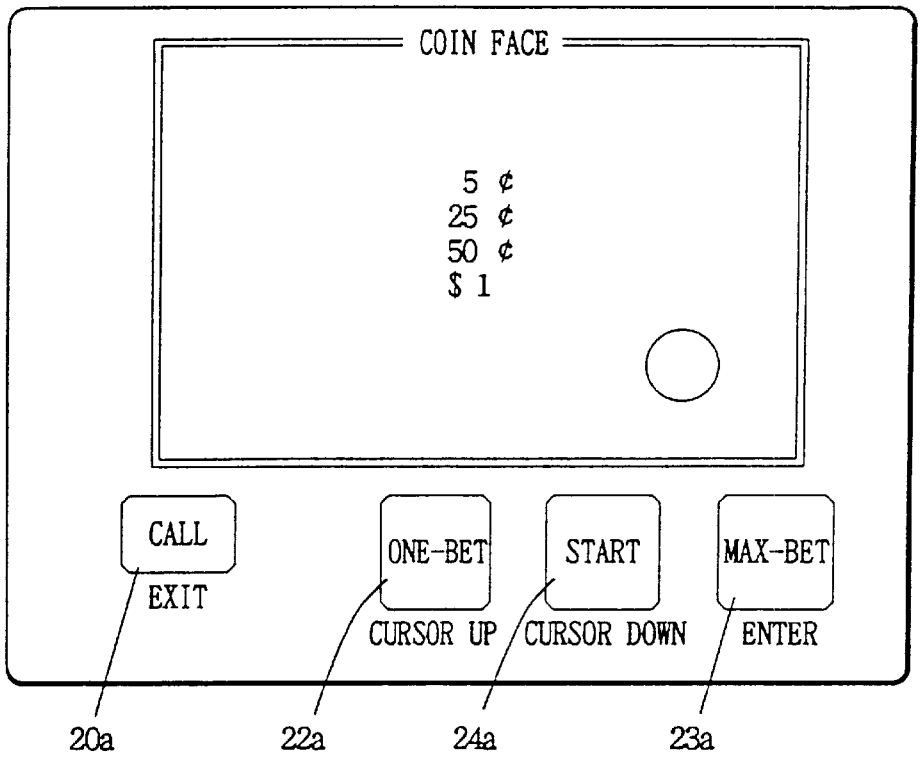
FIG. 43 shows an image displayed in screen display region 6 in selecting the type of coins.

FIG. 43 shows a screen displayed in selecting "COIN TYPE". The type of the coin can be selected with the cursor by operating 1-bet button 22 and start button 24. The picture of the selected coin is shown in a sample coin display region 87. The type of the coin can be determined by depressing maximum-bet button 23 after selecting a particular type of coins.

Figure 44:
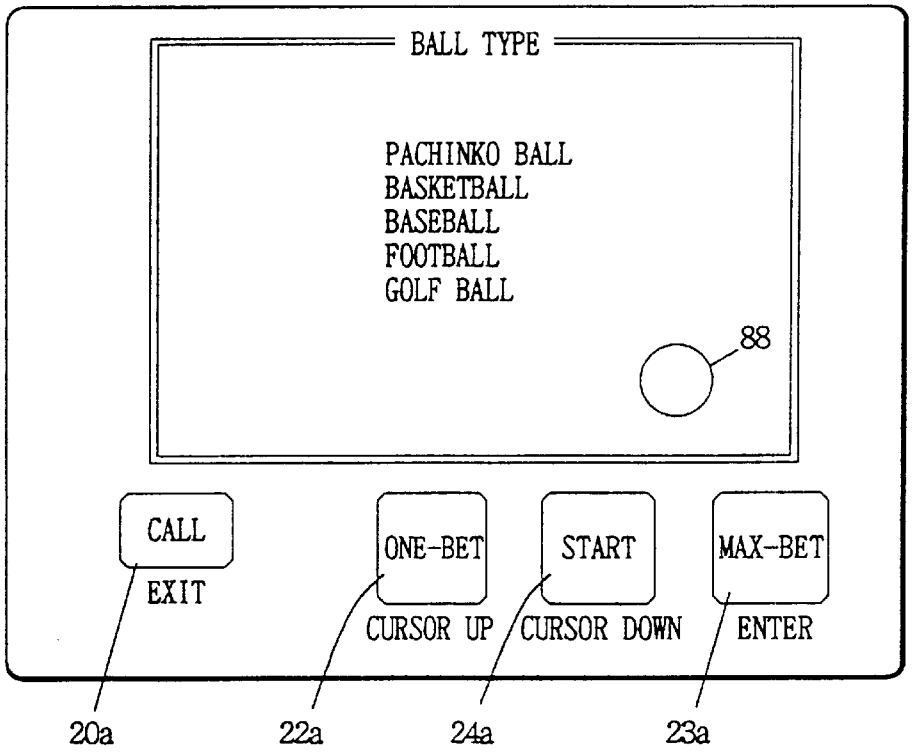
FIG. 44 shows an image displayed in screen display region 6 in selecting the type of balls to be shooted.

FIG. 44 shows a screen displayed when the field of "TYPE OF BALL" is selected. The cursor can be shifted on the field by operating 1-bet button 22 and maximum-bet button 23, and the selected ball is displayed in a sample ball display region 88. The ball to be flipped can be decided by depressing maximum-bet button 23 after selecting any of the balls on the menu.

Figure 45:
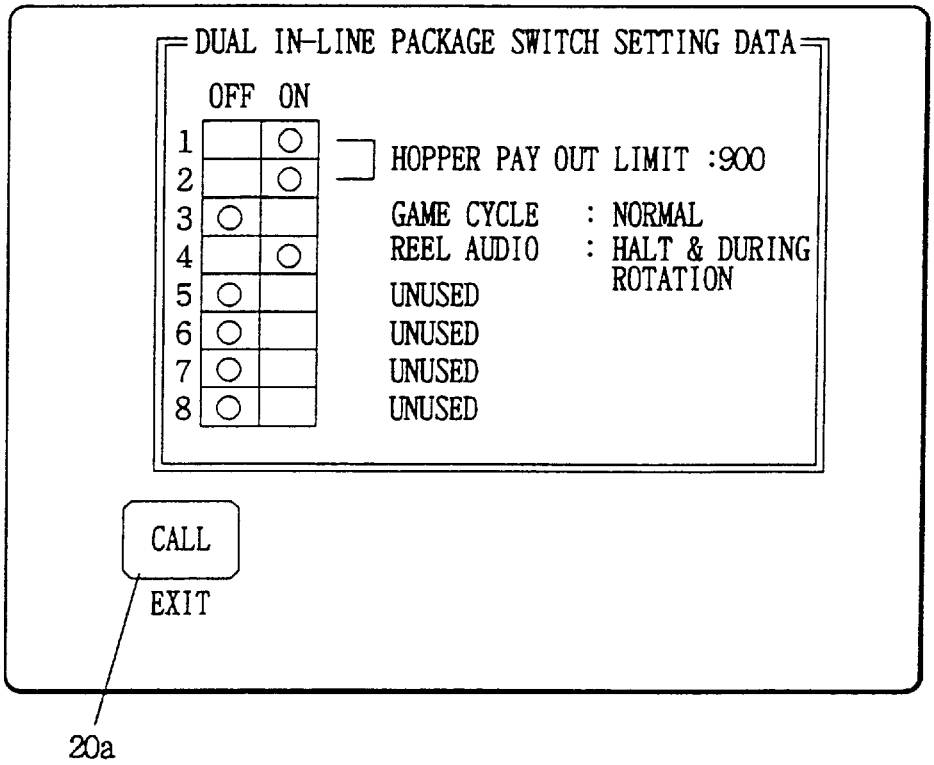
FIG. 45 shows an image of DUAL IN-LINE PACKAGE SWITCH SETTING DATA displayed in screen display region 6.

FIG. 45 shows an image displaying DUAL IN-LINE PACKAGE SWITCH SETTING DATA. The current state by dual in-line package switch 145 can be confirmed by this screen. In the screen of FIG. 45, 1–8 at the left side indicates the number of each strap of dual in-line package switch 145. It is appreciated that the straps of 1, 2 and 4 are set to an ON state, and straps 3, 5–8 are set to an OFF state. The limited number of coins to be paid out can be set by straps 1 and 2. The number of coins to be paid is currently limited to 900. Strap 3 allows setting of a game cycle. The duration of one game can be set to "NORMAL", or "FAST" which is shorter than the duration of "NORMAL". It is appreciated that a "NORMAL" duration is set in FIG. 45. Strap 4 allows setting of the audio effect of the rotation of a reel. One of two states can be selected. The first state is to generate an audio effect of reel from loudspeaker 19 only when the reel is providing a variable display. The second state is to generate the reel audio effect even when the reel does not provide a varying display. It is appreciated that the latter state is set in FIG. 45. It is noted that straps 5–8 are not yet used.

Figure 46:
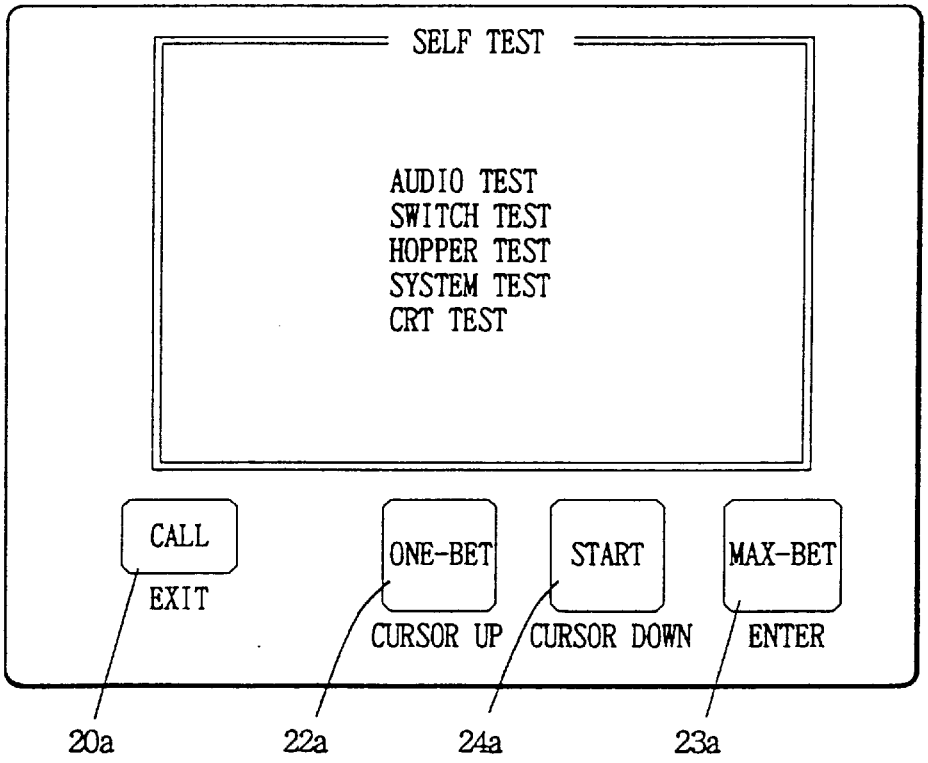
FIG. 46 shows a menu screen of SELF TEST displayed in screen display region 6.

FIG. 46 shows a screen displayed when "SELF TEST" in the field of FIG. 41 is selected. Any of an audio text, a switch text, a hopper test, a system test, and a CRT test can be selected by placing the cursor at an appropriate field by operating 1-bet button 22 and start button 24. By depressing maximum-bet button 23 after selecting an appropriate test field, display of the relevant test is provided.

Figure 47:
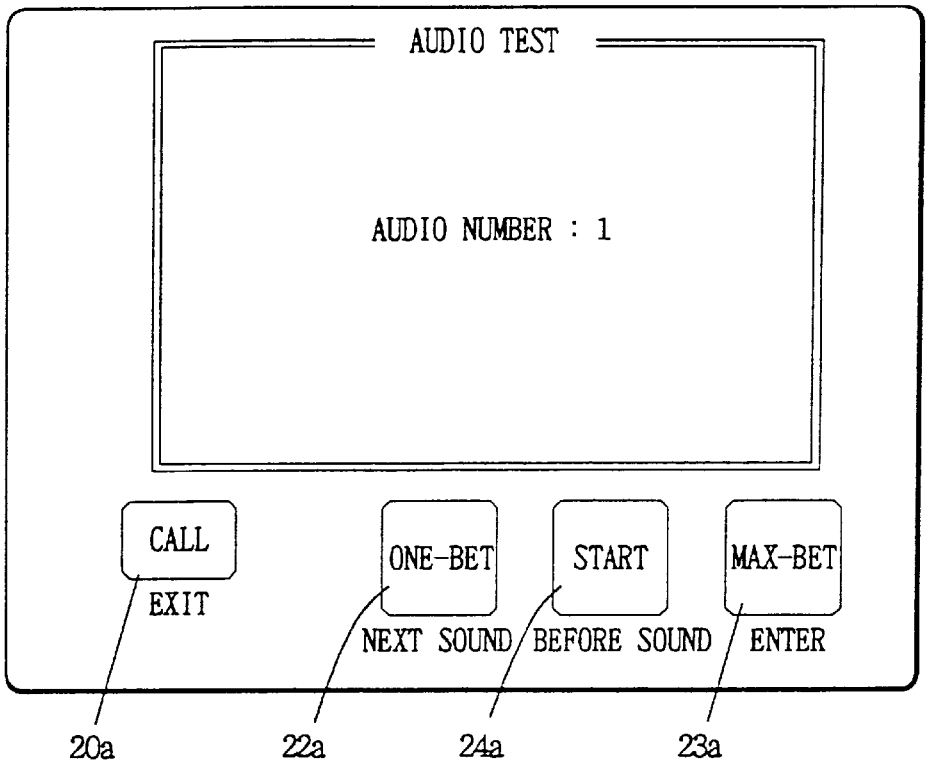
FIG. 47 shows an image displayed in screen display region 6 in carrying out audio testing.

FIG. 47 shows a screen displayed in carrying out an audio test. A certain audio number is specified by operating 1-bet button 22 and start button 24, followed by depression of maximum-bet button 23. An audio effect corresponding to the specified audio number can be tested.

Figure 48:
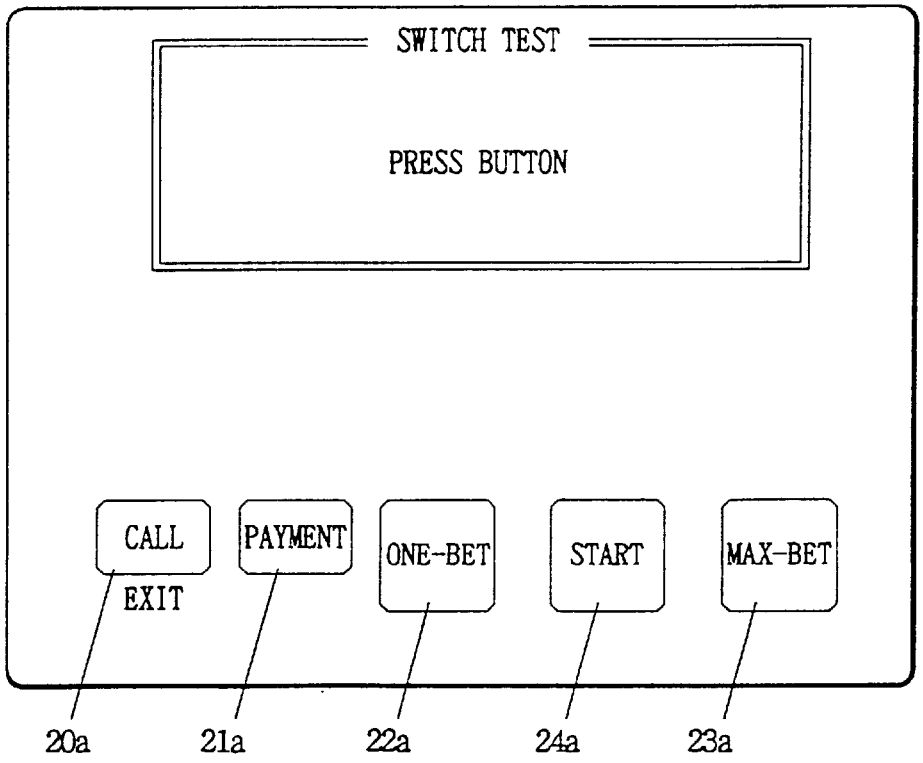
FIG. 48 shows an image displayed in screen display region 6 in carrying out switch testing.

FIG. 48 shows a screen displayed in carrying out a switch test. By depressing any of call button 20, payment button 21, 1-bet button 22, start button 24, and maximum-button 23, a picture corresponding to the depressed button is displayed in a light-up manner.

Figure 49:
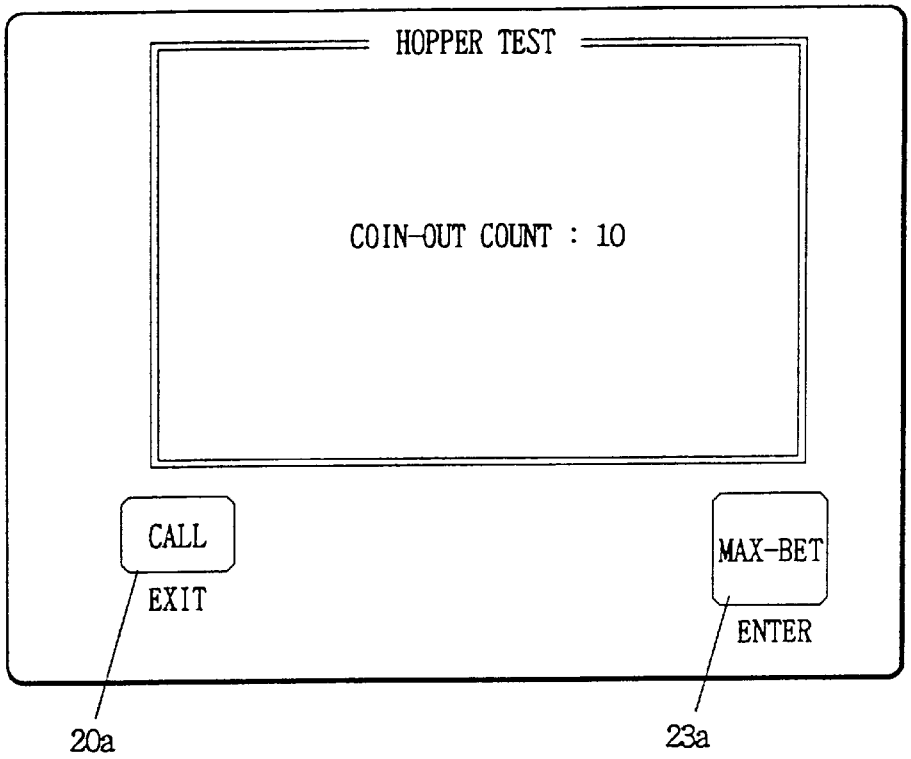
FIG. 49 shows an image displayed in screen display region 6 in carrying out hopper testing.

FIG. 49 is screen displayed in executing a hopper test. By depressing maximum-bet button 23, a number of coins corresponding to the count display in coin-out number is dispensed via outlet 25.

Figure 50:
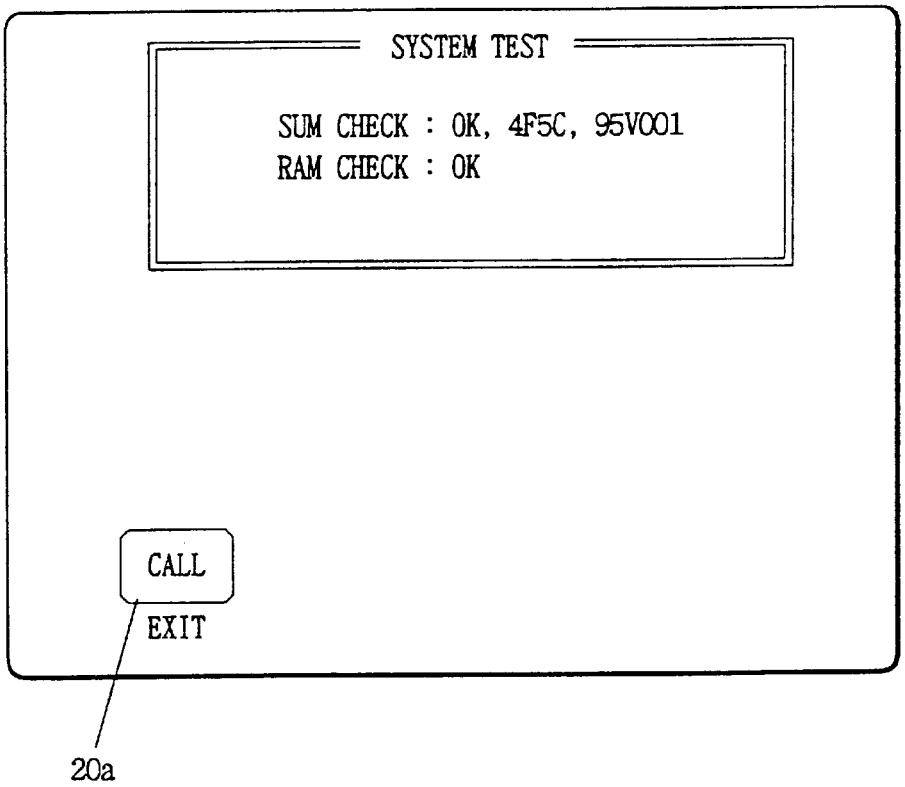
FIG. 50 shows an image displayed in screen display region 6 in carrying out system testing.

FIG. 50 shows a screen displayed in executing a system test. When the field of "SYSTEM TEST" is selected in FIG. 46, the sum check of ROM 152 and the data check of RAM 151 is immediately executed. The result of the execution is displayed in FIG. 50. FIG. 50 shows a screen in the case where no error was detected as a result.

Figure 51:
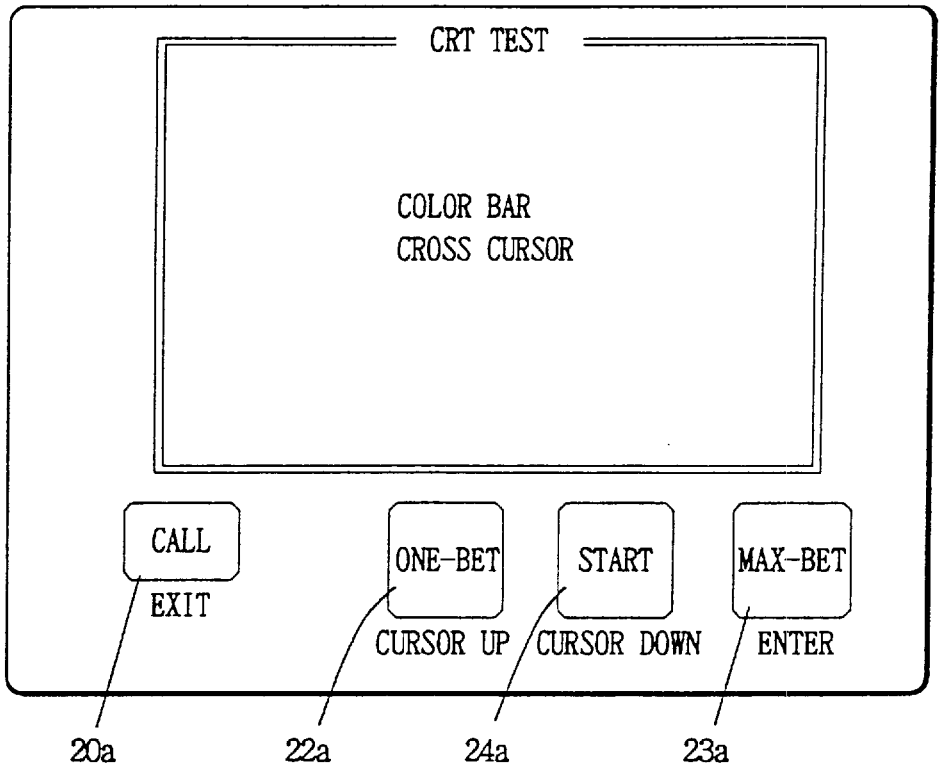
FIG. 51 shows an image displayed in screen display region 6 in carrying out CRT testing.

FIG. 51 shows a screen displayed in executing a CRT test. A display screen to be used in the testing is selected by operating 1-bet button 22 and maximum-bet button 23. By depressing maximum-bet button 23, the screen of either "COLOR BAR" or "CROSS CURSOR" is displayed. The screen of the CRT can be adjusted using the displayed screen.

The game control and image control will be described hereinafter with reference to the flow charts of FIGS. 52–59. Main substrate 140 carries out a predetermined control according to each flow chart that will be described hereinafter.

Figure 52:
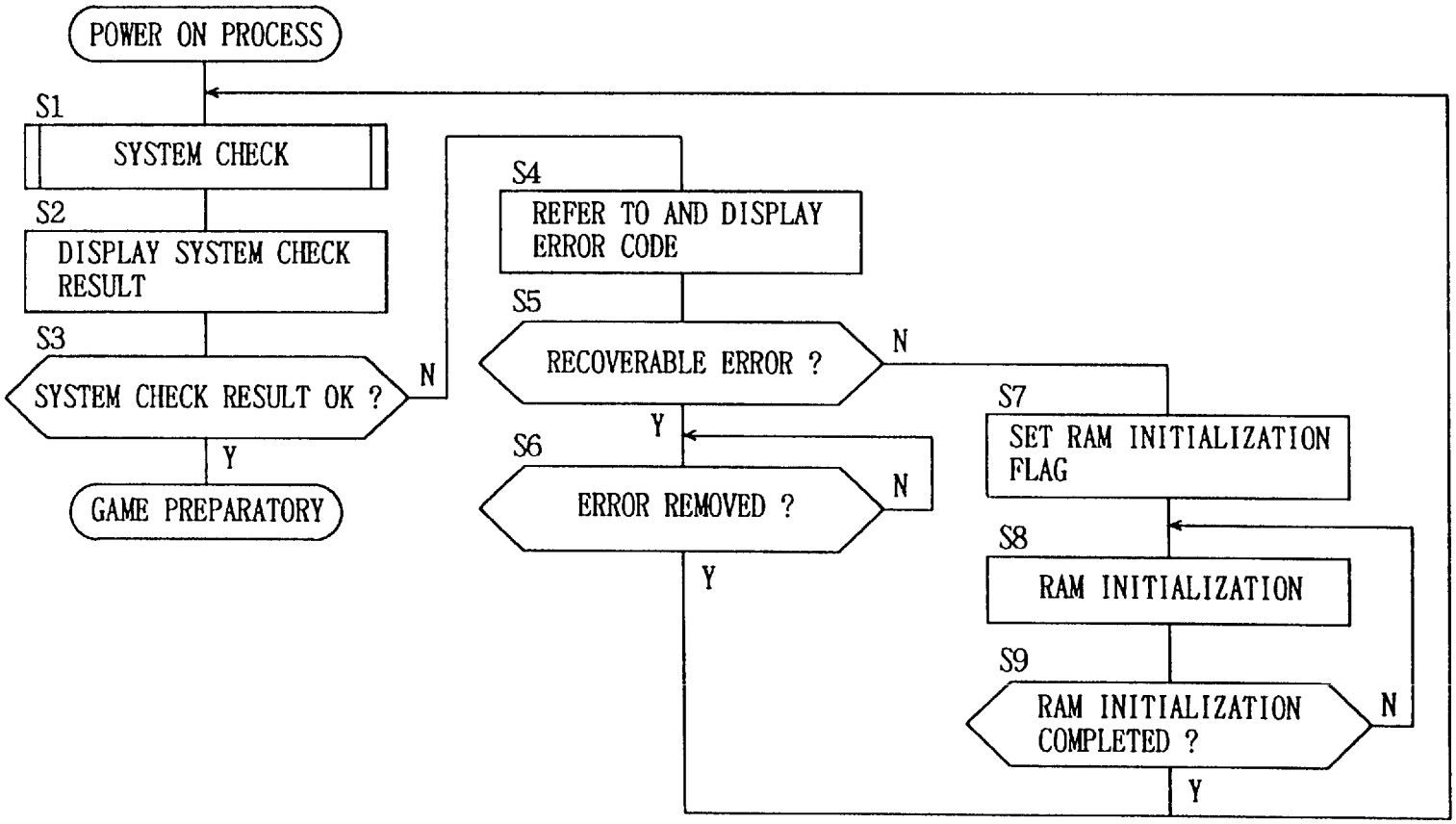
FIG. 52 is a flow chart showing a procedure of a power-on process.

Referring to the flow chart of FIG. 52 showing the procedure of a power on process, the system is checked in response to the power being turned on. An error, if detected, is indicated and the error in RAM 151 is solved.

At step S1, a system check process is carried out. This system check process will be described afterwards with reference to FIG. 53. A signal to control the display of the system check result is transmitted from CPU 150 to CRT 139 via I/O port 157. At step S2, the system check result is displayed in screen display region 6. At step S3, determination is made whether an error is detected as a result of the system check. More specifically, CPU 150 determines whether the values of the check sum of the game control program and the image display control program stored in ROM 152 are proper or not, and whether each data stored in RAM 151 is proper or not. When determination is made that there is no error in the result, CPU 150 proceeds to the game preparatory process that will be described afterwards with reference to FIG. 54. When an error is detected, the error code is referred to and displayed (S4). Then, determination is made whether the error can be recovered or not (S5). More specifically, determination is made whether the error of the RAM data with the error code of "61 1" can be recovered or not. In the case of a recoverable error, the control returns to step S1 after an error release process is carried out (S6). More specifically, a reset process is effected via reset switch 15 by the attendant of the game house. The error is solved and the display screen is reset. Here, the RAM data with an error is cleared and a copy process of the proper RAM data is carried out.

When the error code indicates an unrecoverable error, a RAM initialization flag is set (S7) to initialize the RAM (S8). More specifically, the mode of the game machine is switched to the data display mode by operation of reset switch 15. The clear process of RAM data is selected from the menu screen to be carried out. When initialization of the RAM is completed, the process returns to step Sl again (S9).

Figure 53:
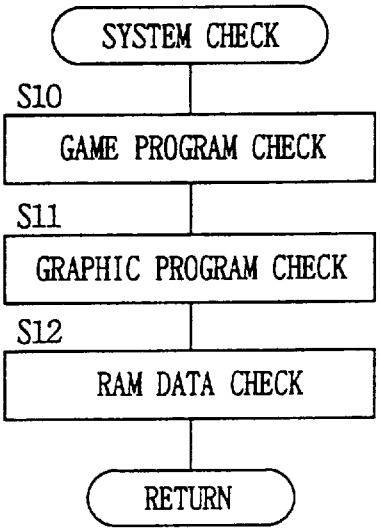
FIG. 53 is a flow chart showing a procedure of a system check process.

Refer to the flow chart of FIG. 53 showing the procedure of a system check process. In a system check process, the game control program, the image display control program and the RAM data are checked when the power is turned on. At step S10, a sum check of the game control program (game program) stored in ROM 152 is carried out. At step S11, a sum check of the image display control program (graphic program) stored in ROM 152 is carried out. At step S12, data stored in RAM 151 is checked. This RAM data check includes the determination whether the data duplicatedly stored in three storage regions all match each other or not, data in only two storage regions match each other or not, or all the data in the three storage regions differ from each other. The system check process is terminated at the end of steps S10–S12.

Figure 54A:
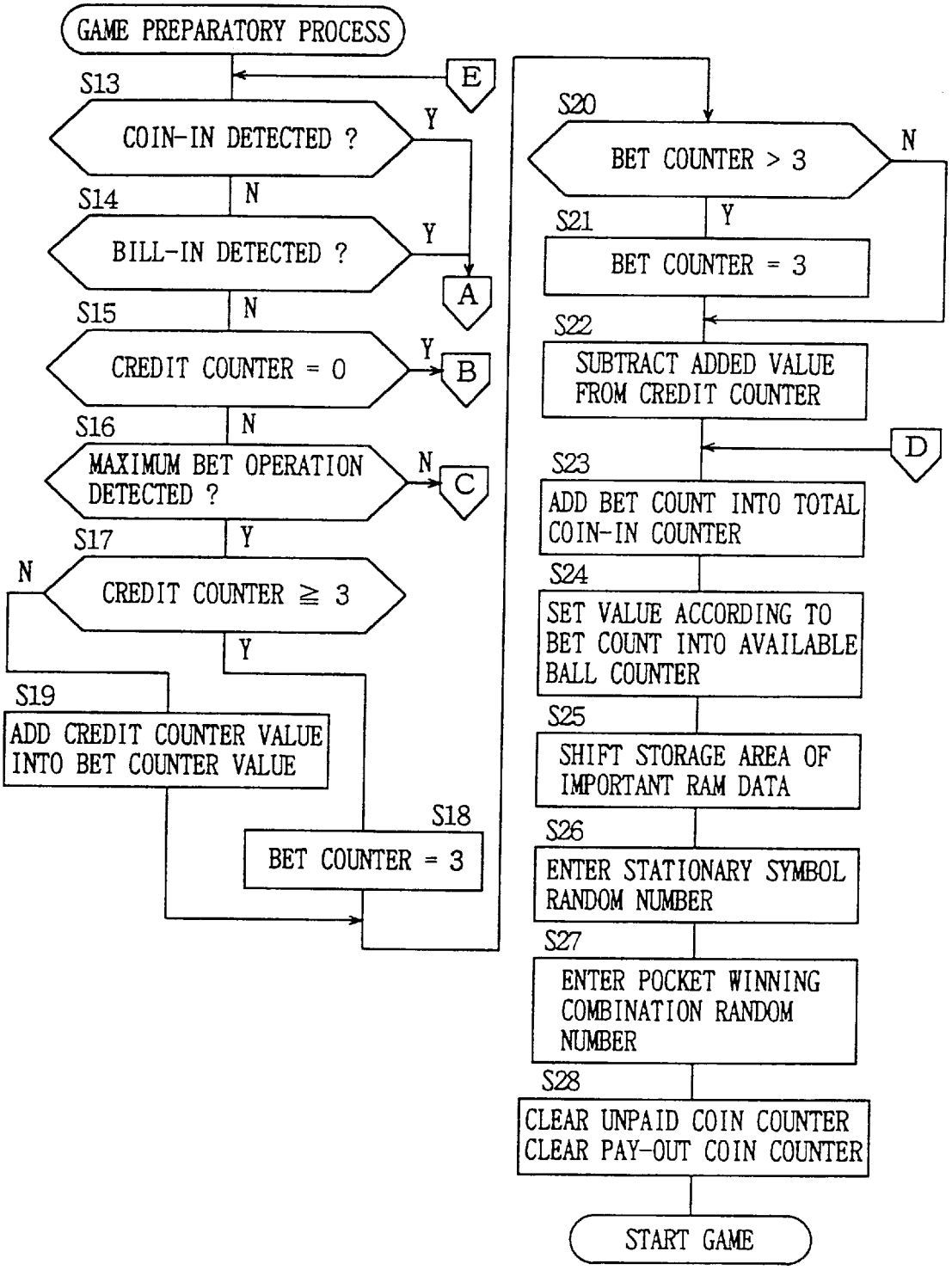
FIGS. 54A, 54B, 55A, 55B and 55C are flow charts showing a procedure of a game preparatory process.
Figure 54B:
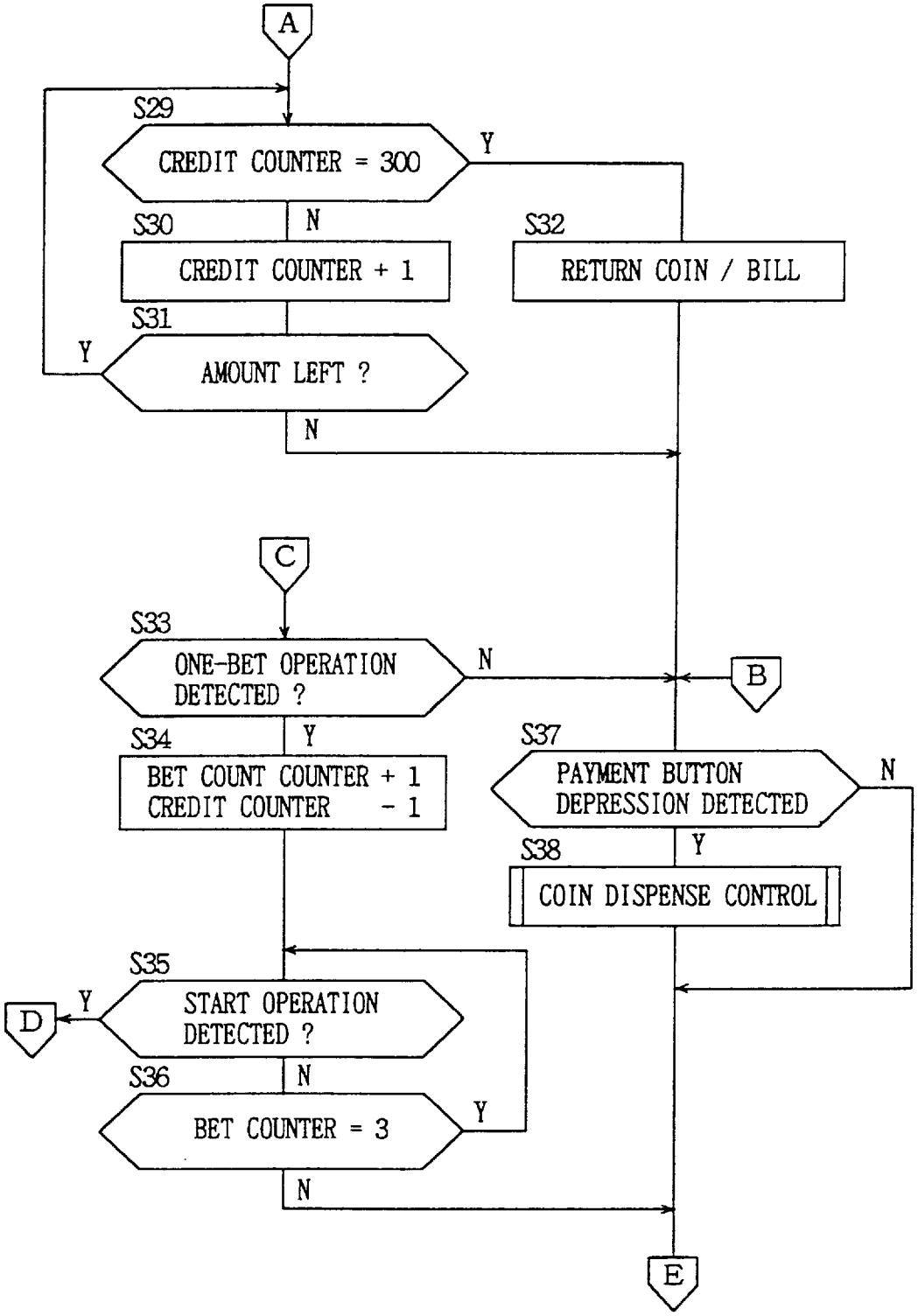

The flow charts of FIGS. 54A and 54B show the procedure of a game preparatory process. In the game preparatory process, insertion of a coin or a bill is detected. Then, depression of start button 24 or maximum-bet button 23 is detected to allow a game to be started. Also, depression of payment button 21 by the player is detected to control the discharge of the coins. At step S13, determination is made whether insertion of a coin is detected or not. More specifically, determination is made by coin selector 144 whether the coin, if inserted via coin inlet 18, is proper or not. When the inserted coin is a proper coin, a coin detection signal is transmitted from coin selector 144 to CPU 150 via I/O port 157. CPU 150 receives this detection signal to determine that insertion of a coin has been detected. When detection of a coin being inserted is made, the process proceeds to step S29 in FIG. 54B, otherwise the process proceeds to step S14 where determination is made whether a bill is inserted or not. When a bill is inserted through bill receptor 17, bill acceptor 17 transmits a bill detection signal to CPU 150 via I/O port 157 if the inserted bill is detected as being a proper bill. CPU 150 receives the bill detection signal to determine that detection of insertion of a bill is made.

When detection of a coin or a bill is detected in step S13 or S14, the process proceeds to step S29 in FIG. 54B to determine whether the value in the credit counter is 300 or not. The credit counter is stored in RAM 151 to determine the hopper limit value set by dual in-line package switch 145. The amount of coins or bills that can be inserted in advance by the player is limited by this credit counter. If the value in the credit count has not yet reached 300, the count is updated (+1) at step S30. Then, the process proceeds to step S31 where determination is made whether there is amount left, i.e., whether all the inserted coins or bills have been converted into credit coins or not. When all have been converted, the process proceeds to S37, otherwise to S29. Thus, the steps of S29–S31 is repeated until all the inserted coins or bills are converted into credit counts, or until the count value in the credit counter arrives at 300.

When the count of the credit counter becomes 300 at S29 or when the count of the credit counter was already 300 when the coin or bill was inserted, the coin or bill is returned (S32). When determination is made that there is no margin count in step S31 during the update of the credit counter in steps S29–S31, or after the returning process of S32, determination is made whether depression of payment button 21 is detected or not (S37). More specifically, when a payment button 21 input signal is provided to CPU 150 via I/O port 157 in response to depression of payment button 21, CPU 150 determines that there was a depression operation of payment button 21. In this case, a coin dispense control process that will be described afterwards with reference to FIG. 56 (S38) is carried out. Following the coin dispense control, or when determination is made that payment button 21 has not been depressed, the process returns to step S13 of FIG. 54A.

When insertion of a coin or a bill is not detected in steps S13 and S14 of FIG. 54A, the process proceeds to step S15 to determine whether the count in the credit counter is 0 or not. When the count is 0, the process proceeds to step S37 of FIG. 54B. When the count of the credit counter is not 0, the process proceeds to S16 to determine whether depression of maximum-bet button 23 is depressed or not. More specifically, when maximum-bet button 23 is depressed, a maximum-bet button input signal is provided to CPU 150 via I/O port 157. In response, CPU 150 detects depression of maximum-bet button 23. When depression of maximum-bet button 23 is not detected, the process proceeds to step S33 to determine whether 1-bet button 22 is depressed or not. More specifically, when 1-bet button 22 is depressed, a 1-bet button input signal is provided to CPU 150 via I/O port 157. In response, CPU 150 determines that 1-bet button 22 is depressed. When depression of 1-bet button 22 is not detected, the process proceeds to step S37. When detection of depression of 1-bet button 22 is detected, the process proceeds to step S34 to update the bet counter (+1) and to update the count in the credit counter (−1). The bet count counts the number of coins or the credit bet by specification of the player by operation of 1-bet button 22 or maximum-bet button 23. The count in this bet counter is updated at step S34, or updated to a predetermined value at respective steps of S18, S19, and S21 which will be described afterwards. The count in the bet counter is cleared when one game is completed. At step S35, determination is made whether a start operation is detected or not, i.e. whether depression of start button 24 is detected or not. When start button 24 is depressed, a start button input signal is provided to CPU 150 via I/O port 157. In response, CPU 150 determines that start button 24 is depressed.

When a start operation is detected, the process proceeds to step S23 of FIG. 54A that will be described afterwards. Otherwise, the process proceeds to step S36 to determine whether the count of the bet counter is 3 or not. When the value is 3, the process of steps S35–S36 is repeatedly carried out until a start manipulation is detected at step S35. When the count in the bet counter is not 3, the process returns to step S13 of FIG. 54A since a higher bet can be specified.

When depression of maximum-bet button 23 is detected at step S16, the process proceeds to step S17 to determine whether the count of the credit counter is equal to or greater than 3. If the result of the determination is YES, the count of the bet counter is set to 3 (S18). Then, the process proceeds to step S20. When the determination of step S17 is NO, the bet counter is set to the current value in the credit counter (S19). Following the setting of the bet counter, the process proceeds to step S20 to determine whether the count of the bet counter is greater than 3. There may be a case in which the value of the bet counter exceeds 3. Specifically, depression of maximum-bet button 23 when the count in the bet counter already attains the value of 1, 2, 3 in response to the insertion of 1–3 coins or the operation of a 1-coin bet operation to play a game by the player may cause the value of 3 to be further added to the count in the bet counter (step S19). In this case, the determination of YES is obtained at S20. The process proceeds to step S21 to set the count of the bet counter to 3. The added count of the bet counter is subtracted from the count of the credit counter according to the step of S22. Then, the control proceeds to step S23. For example, when the count in the credit counter is smaller than 3, for example "2" at the execution of a maximum bet operation after a 1-coin bet operation is executed two times already, a process of adding the current credit counter value of "2" to the current value of "2" of the bet counter is carried out to result in the value of "4" in the bet counter. In this case, determination is made that the value of the bet counter is greater than 3 at step S20 and the value of the bet counter is corrected to 3 at step S21. Then, the process of subtracting the credit corresponding to the added amount of "1" of the bet counter from the count in the credit counter is carried out at step S22. It is to be noted that when the control proceeds to step S22 in response to the determination of NO at step S20, "3" will be subtracted from the count in the credit counter since the added amount is "3" in this case.

Following the process of step S22, or when detection of a start operation is made at step S35, the process proceeds to step S23 to add the value in the bet counter to the value in the total coin-in counter. The total coin-in counter is used to calculate the total number of bets used in the game by the player. This counter is stored in RAM 151. Then, the number of balls according to the bet is set in the available ball counter. The values of "5", "10", and "15" are set in the available ball counter when a game is to be played on a 1-coin bet, a 2-coin bet, or a 3-coin bet, respectively. The available ball counter counts the number of balls that can be flipped in one game. A number of balls corresponding to the value in the counter can be flipped into play field 7 in one game. The available ball counter is stored in RAM 151. The process proceeds to step S25 to shift the storage area of important RAM data. Important RAM data refers to data stored in RAM 151 that are particularly important for playing a game. More specifically, it refers to data required to replay a game in the data display mode. This includes, for example, a winning flag (a flag in which determination of whether to generate a win according to the stationary symbol determination random number and in which the result of the determined winning contents are stored, and a flag in which the combination result of a pocket win is stored), the total number of coins paid out, the bet count, the credit count, the stationary symbols of each reel, the winning counts of pockets 30–34, an extracted value of the random number for determining the stationary symbol, and the extracted value of the random numbers for determining the combination of the pocket win, all required to replay the games of the preceding game, the second preceding game, the third preceding game, and the fourth preceding game. By shifting the area in which the important RAM data is stored, the data used in displaying the third preceding game is shifted into the storage area in which the data used for displaying the fourth preceding game was stored. The data used in displaying the second preceding game is shifted into the area in which the data used in displaying the third preceding game was stored. The data used in displaying the preceding game is shifted into a region in which the data used for displaying the second preceding game was stored. The data used in displaying the current game is shifted into a region in which the data used for displaying the preceding game was stored.

At step S26, entry of a stationary symbol random number is carried out. More specifically, a random number generated by random number generator 155 is fetched by CPU 150 at the timing of establishment of a condition to carry out the process of step S26. Then, at step S27, a random number for combination of a pocket win is entered. Similar to the entry of a random number for a stationary symbol, entry of a random number for a pocket win combination is carried out by having CPU 150 take a random number generated from random number generator 155. At step S28, a process for clearing the counts in the unpaid coin counter and the pay-out coin counter is carried out. The unpaid counter stores the credit count to be dispensed to the player according to the game result. The pay-out coin counter stores the credit count actually paid to the player. The unpaid coin counter and the pay-out coin counter are stored in RAM 151. When the process of step S28 ends, the control proceeds to a game start process.

Figure 55A:
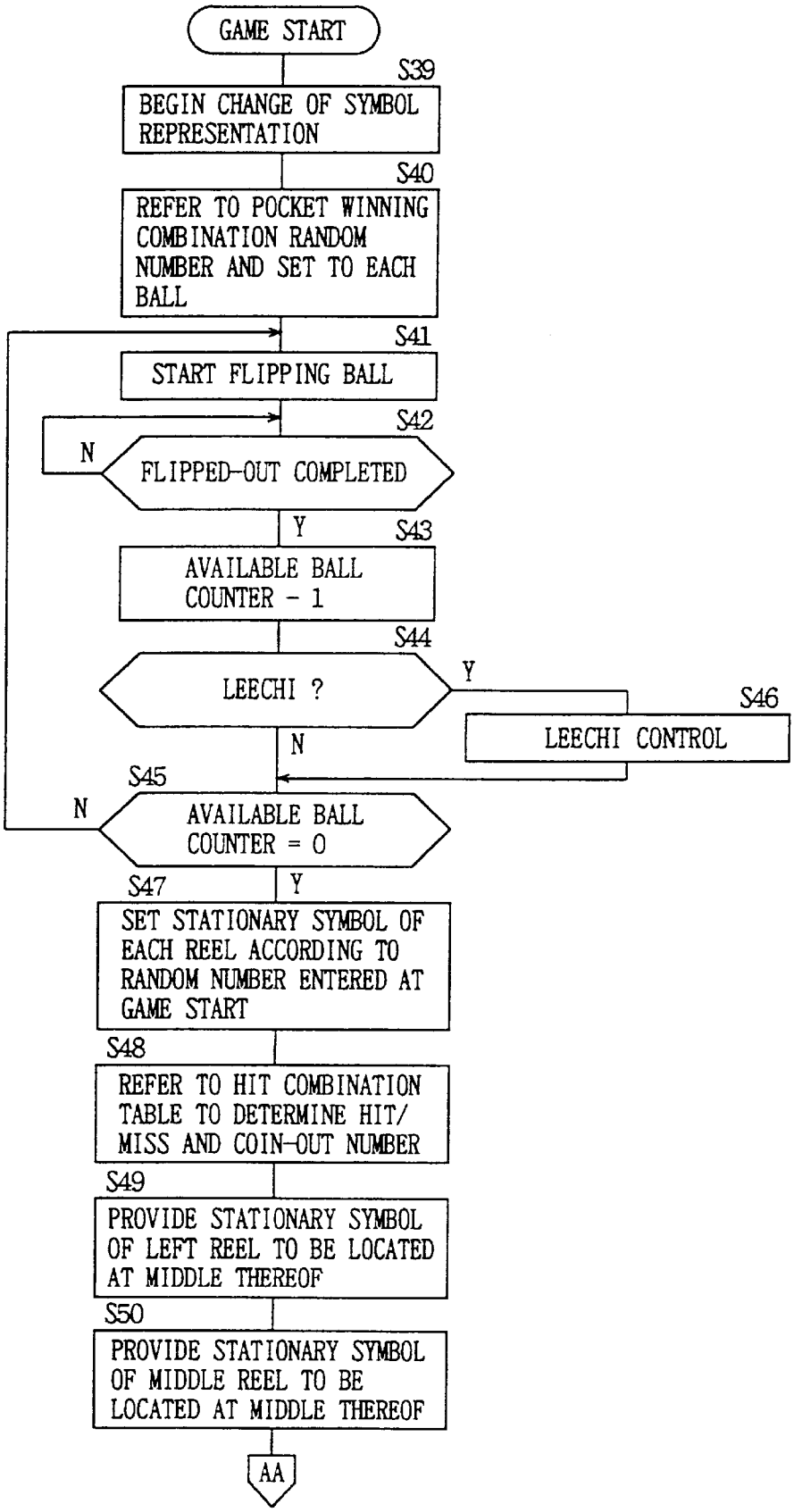
Figure 55B:
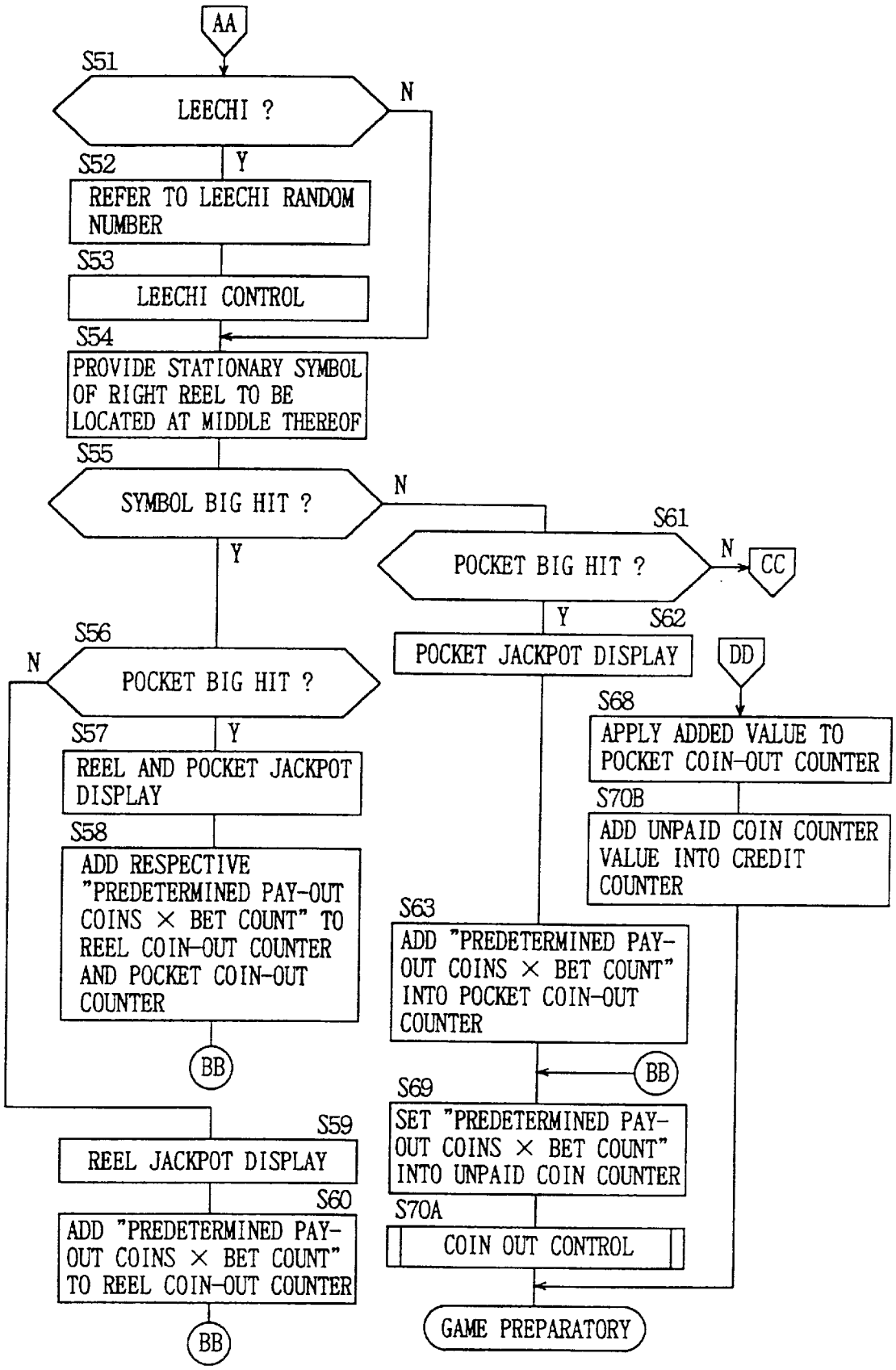
Figure 55C:
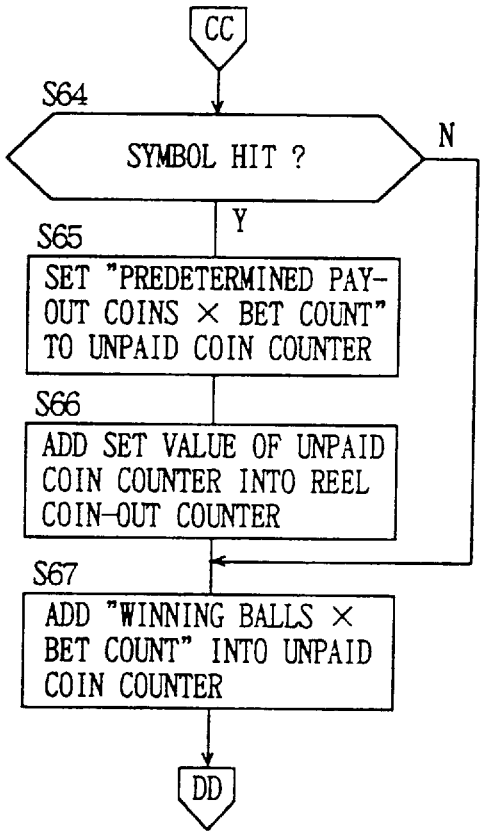

The flow charts of FIGS. 55A, 55B, and 55C show the procedure of a game start process. Game control is provided according to game control contents preset in the game preparatory process. Referring to FIG. 55A, the graphical representations of left reel 38*a*, middle reel 38*b*, and right reel 38*c* begin to change its display (S39). At step S40, the pocket win combination random number is referred to, and the display control contents of a ball to be flipped into play field 7 is set. At step S41, the graphical representation of the balls being flipped out commences. At step S42, determination is made whether a flip out is completed. Specifically, determination is made whether a predetermined time period has elapsed from the flipping out of one ball. The process of step S42 is repeated until the elapse of a predetermined time period. When a ball has been flipped out, the available ball count counter is updated, i.e. the count is decremented by 1 (S43). At step S44, determination is made whether a pocket leechi state has been achieved or not. When a pocket leechi state is achieved, a leechi control is effected (S46). The leechi control includes the control to display a flipped out ball particularly in the vicinity of the last pocket not yet attaining a win, the control to display the relevant pocket in a particular color different from the colors of the other pockets already achieving at least one win, the control of showing pocket win display region 41 in a blinking manner, and the control of generating an audio effect inherent to a pocket leechi state from loudspeaker 19. At step S45, determination is made whether the available ball counter shows a count of 0. When the count in the available ball counter is not 0, the process returns to step S41 to repeat the steps of S41–S45 until the count in available ball counter becomes 0. When the available ball counter shows the count of 0, the stationary symbols of left reel 38*a*, middle reel 38*b*, and right reel 38*c* are set according to the stationary symbol random number entered at the game preparatory process (S47). Then, a winning combination table is referred to, whereby determination is made whether the set stationary symbols achieve a win or not. In the case of a hit, a process for determining the count of the credit to be paid out is carried out. This hit combination table is stored in ROM 152. At step S49, control is provided so that the set symbol to be displayed in left reel 38*a* is positioned at the center of left reel 38*a* in a stationary manner. At step S50, control is provided so that the symbol to be displayed in middle reel 38*b* is located at the center of middle reel 38*b* in a stationary manner. At step S51 (FIG. 55B), determination is made whether a reel leechi state is achieved or not. When a reel leechi state is not achieved, the process proceeds to step S54, otherwise to step S52 where the leechi random number is referred to. Leechi control is provided according to the leechi random number in step S53. Determination is made of which of the three aforementioned leechi display controls is to be effected according to the leechi random number.

At step S54, control is provided so that the symbol to be displayed in right reel 38*c* is located at the center of right reel 38*c* in a stationary manner. At step S55, determination is made whether a big hit of the combinations of the symbols is generated or not, i.e. whether a reel jackpot is hit or not. In the case of a reel jackpot state, determination is made whether a pocket big hit is established or not, i.e. whether a pocket jackpot is hit or not (S56). When only a reel jackpot is hit, display control of a reel jackpot state is effected (S59). At step S60, the value of "predetermined number of coins to be paid out×bet count" is added to the count in the reel coin-out counter. Then, the process proceeds to step S69. In the case of both a reel jackpot and a pocket jackpot being hit, display control of a reel jackpot and a pocket jackpot state is effected (S57). At step S58, the value of "predetermined number of coins to be paid×bet count" is added to the counts of the reel coin-out counter and the pocket coin-out counter. Then, the process proceeds to S69.

When a big hit of the combination of the symbols is not achieved at step S55, the process proceeds to step S61 where determination is made whether a pocket big hit is established or not, i.e. whether a pocket jackpot is hit or not. When a pocket jackpot status is not established, the process proceeds to step S64 (FIG. 55C), otherwise to step S62 to provide display control of a pocket jackpot state. At step S63, the value of "predetermined number of coins to be paid out×bet count" is added to the count in the pocket coin-out counter. At step S69, the value of "predetermined number of coins to be paid out×bet count" is set in the unpaid coin counter. At step S70A, coin pay out control that will be described afterwards is effected. Then, the process proceeds to a game preparatory process.

When a pocket jackpot state is not established at step S61, the process proceeds to step S64 (FIG. 55C) where determination is made whether a symbol combination hit is established or not. A symbol hit is achieved when the combination of the stationary symbols of the reels match a predetermined combination. When a symbol hit is not established, the process proceeds to step S67, otherwise to step S65 where the value of "predetermined number of coins to be paid out×bet count" is set in the unpaid coin counter. At step S66, the values set in the unpaid coin counter is added to the value in the reel coin-out counter. When there is a pocket win, the value of "number of winning balls×bet number" is added to the count in the unpaid coin counter (S67). At step S68 (FIG. 55B), the added value is added to the pocket coin-out counter. At step S70B, the count of the unpaid coin counter is additionally applied to the count in the credit counter. Then, the process proceeds to a game preparatory process.

Figure 56A:
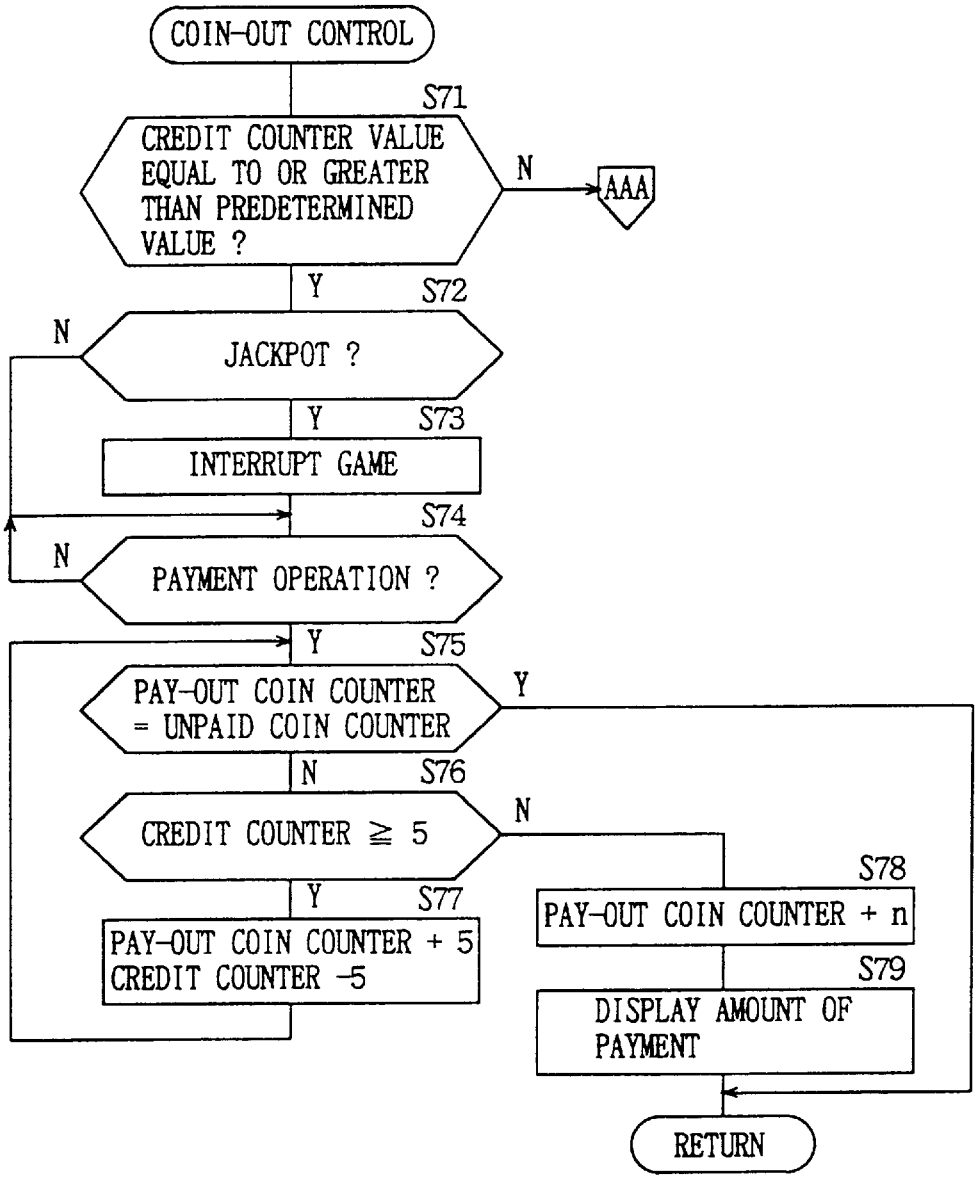
FIGS. 56A and 56B are flow charts showing a procedure of a coin-out control process.
Figure 56B:
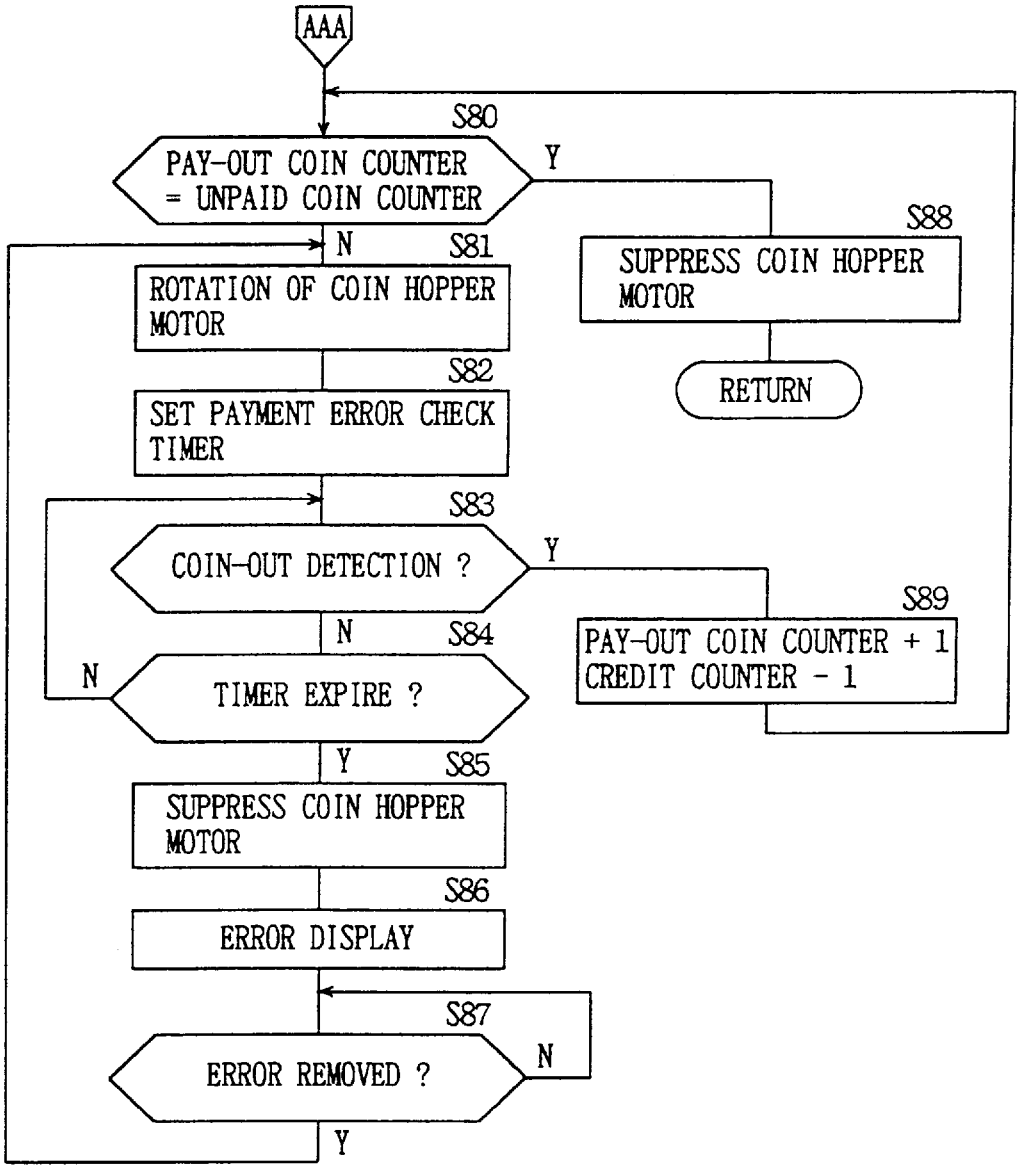

The flow charts of FIGS. 56A and 56B show the procedure of a coin dispense control process. Coin dispense control is carried out when a jackpot is hit or when the player depresses payment button 21. Referring to FIG. 56A, determination is made whether the count in the credit counter is equal to or greater than a predetermined value at step S71. This predetermined value is set by dual in-line package switch 145, and identical to the value of step S29 in FIG. 54B. When the value in the credit counter is smaller than the predetermined value, the process proceeds to step S80 (FIG. 56B) to provide control of coin-out. When the determination result at step S71 is YES, the process proceeds to step S72 to determine whether a jackpot state is established or not. When a jackpot state is established, the process proceeds to step S73 where the game play is interrupted. When a jackpot state is not established or after the game is interrupted due to establishment of a jackpot, determination is made whether a coin-out operation is effected or not at step S74. More specifically, determination is made whether a reset operation via reset switch 15 is effected or not (S74). The process of step S74 is repeated until a coin-out operation is effected. At step S75, determination is made whether the value in the pay-out coin counter matches that of unpaid coin counter.

Since the value in pay-out coin counter is 0 at the start of a coin-out operation, determination of NO is made to proceed to step S76 where determination is made whether the count in the credit counter is equal to or greater than 5. When the value in the credit counter is smaller than 5, the process proceeds to step S78, otherwise to step S77. At step S77, the value in the pay-out coin counter and the credit counter are updated. More specifically, the PAY-OUT coin counter is incremented by 5 and the credit counter is decremented by 5. Then, the process returns to step S75. The steps of S75–S77 are repeated until the values in the pay-out coin counter matches that of the unpaid coin counter in step S75 or until the value of the credit counter becomes smaller than 5 at step S76.

When the result of step S76 is NO, the process proceeds to step S78 where the current value of "n" in the credit counter is added to the count in the pay-out coin counter. The value of the pay-out coin counter is calculated to be converted into the amount to be paid to the player. The amount to be paid is displayed in message display region 40*b* (S79). Thus, the process is completed. The attendant or clerk pays the player the amount displayed on the screen.

When the count in the credit counter is determined to be below a predetermined value in step S71, the process proceeds to step S80 (FIG. 56B) where determination is made whether the count values of the pay-out coin counter and the unpaid coin counter match each other. When the count values match, the process proceeds to step S88 where the drive of the coin hopper motor is ceased, and this process ends. When the count values of the pay-out coin counter and the unpaid coin counter do not match, the process proceeds to step S81 where the coin hopper motor is driven. At step S82, a pay-out error check timer is set. At step S83, determination is made whether a coin-out is detected or not. When a coin-out is not detected, the process proceeds to step S84 where determination is made whether the coin-out error check timer has expired or not. The determination carried out in step S83 is continued until the timer expires. If a coin-out is detected prior to expiration of the coin-out error check timer, the process proceeds to step S89 where the count value in the pay-out coin counter is incremented by 1 and the count value in the credit counter is decremented by 1. Then, the process returns to step S80. When a coin-out is not detected even when the coin-out error check timer expires at S84, the process proceeds to step S85 whereby the drive of the coin hopper motor is suppressed. At step S86, a predetermined error message is displayed in screen display region 6. At step S87, waiting is conducted until the error is removed. Determination of YES at step S84 can be obtained when there are no coins in the coin hopper or when coins are jammed in the passage, for example. Following an appropriate treatment by the attendant, a reset operation results in the determination of YES in step S87 to return to step S81.

Figure 57:
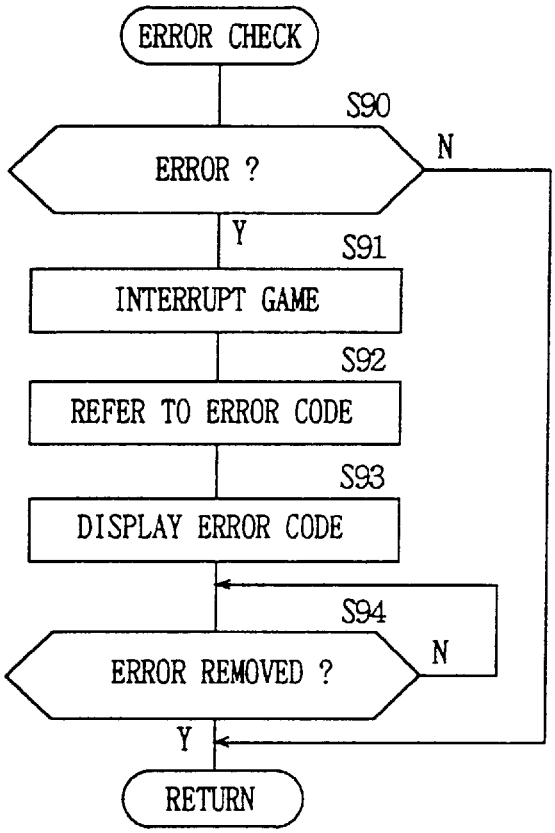
FIG. 57 is a flow chart showing a procedure of an error check process.

The flow chart of FIG. 57 shows the procedure of error checking. Generation of an error during a play is detected. At step S90, determination is made whether an error is generated or not. Generation of an error can be detected by a signal provided to CPU 150 via I/O port 157 from coin selector 144, bill acceptor 17, hopper 138, and the like. When there is no error, the error checking process ends. When an error is generated, control is provided to suppress the play (S91). At step S92, CPU 150 checks the error code according to the received signal. The referred error code is displayed in message display region 40*a* (S93). At step S94, determination is made whether a reset operation by reset switch 15 or other error removing processes are carried out or not. The game play is suppressed and display of the error code remains until an error removing process is carried out. The error checking process ends as a result of an error removing process being carried out.

Figure 58:
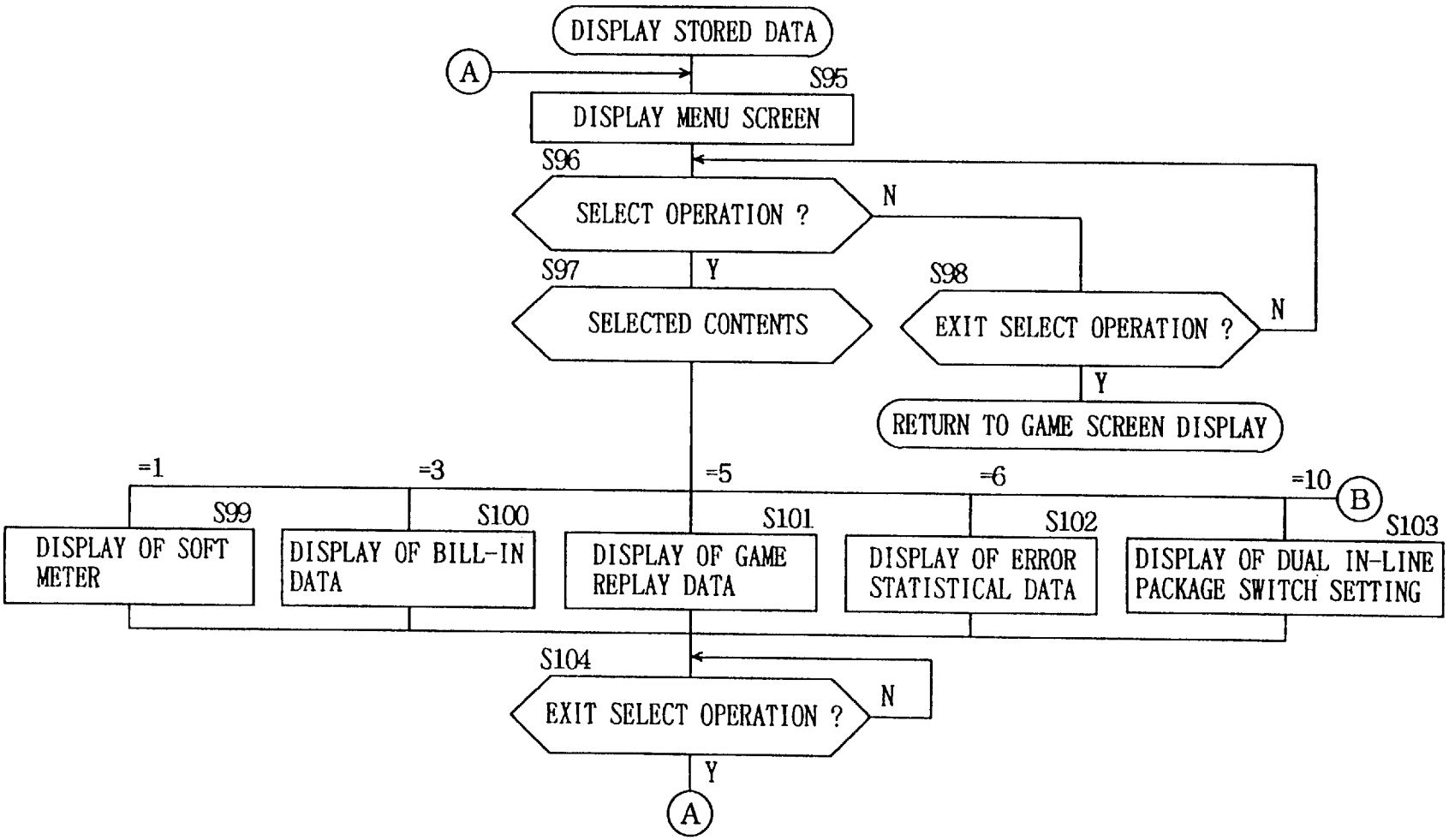
FIGS. 58 and 59 are flow charts showing a procedure executed according to manipulation of an operator when image display type game machine 1 attains a data display mode.
Figure 59:
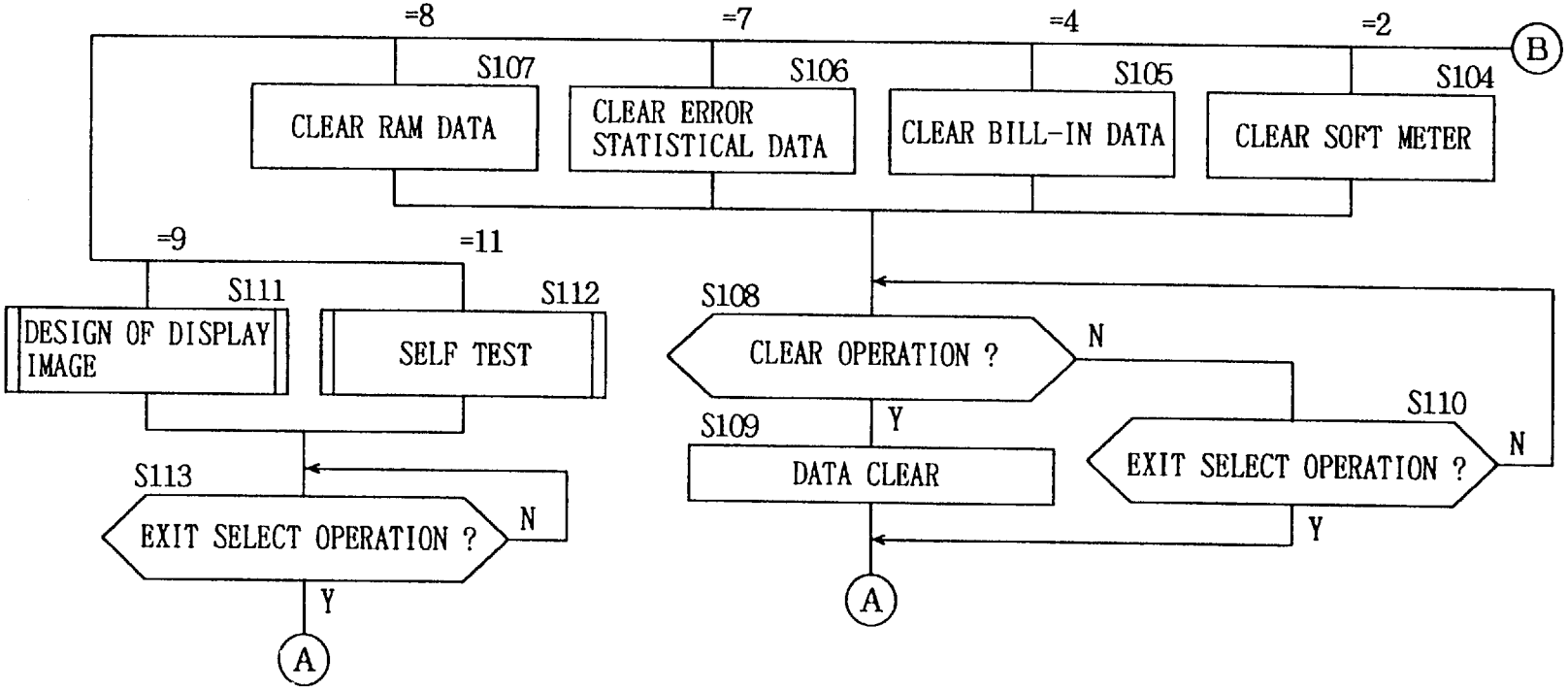
Figure 60:
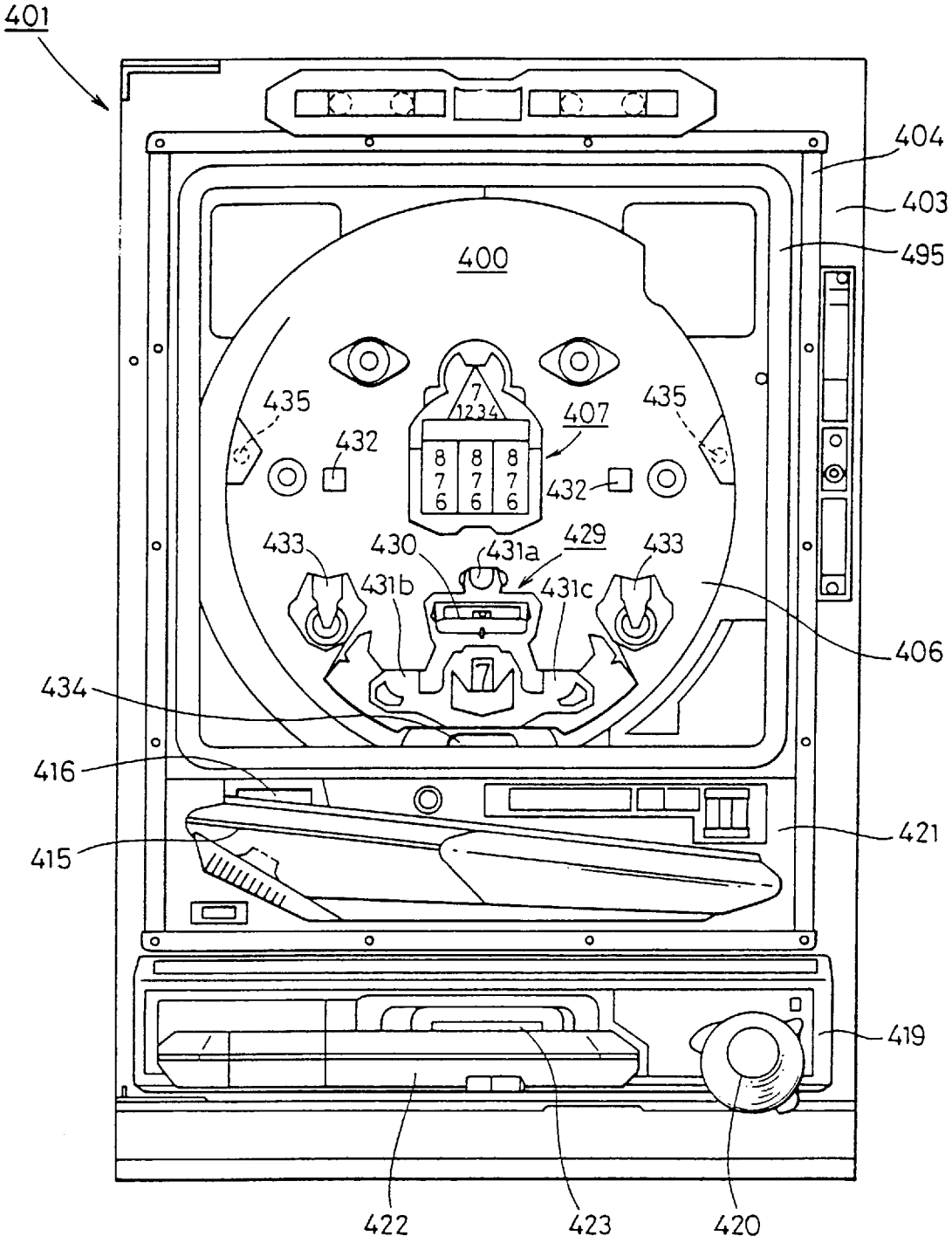
FIG. 60 PRIOR ART
FIG. 60 is a front view of a pachinko game machine exemplary of a conventional game machine.
Figure 61:
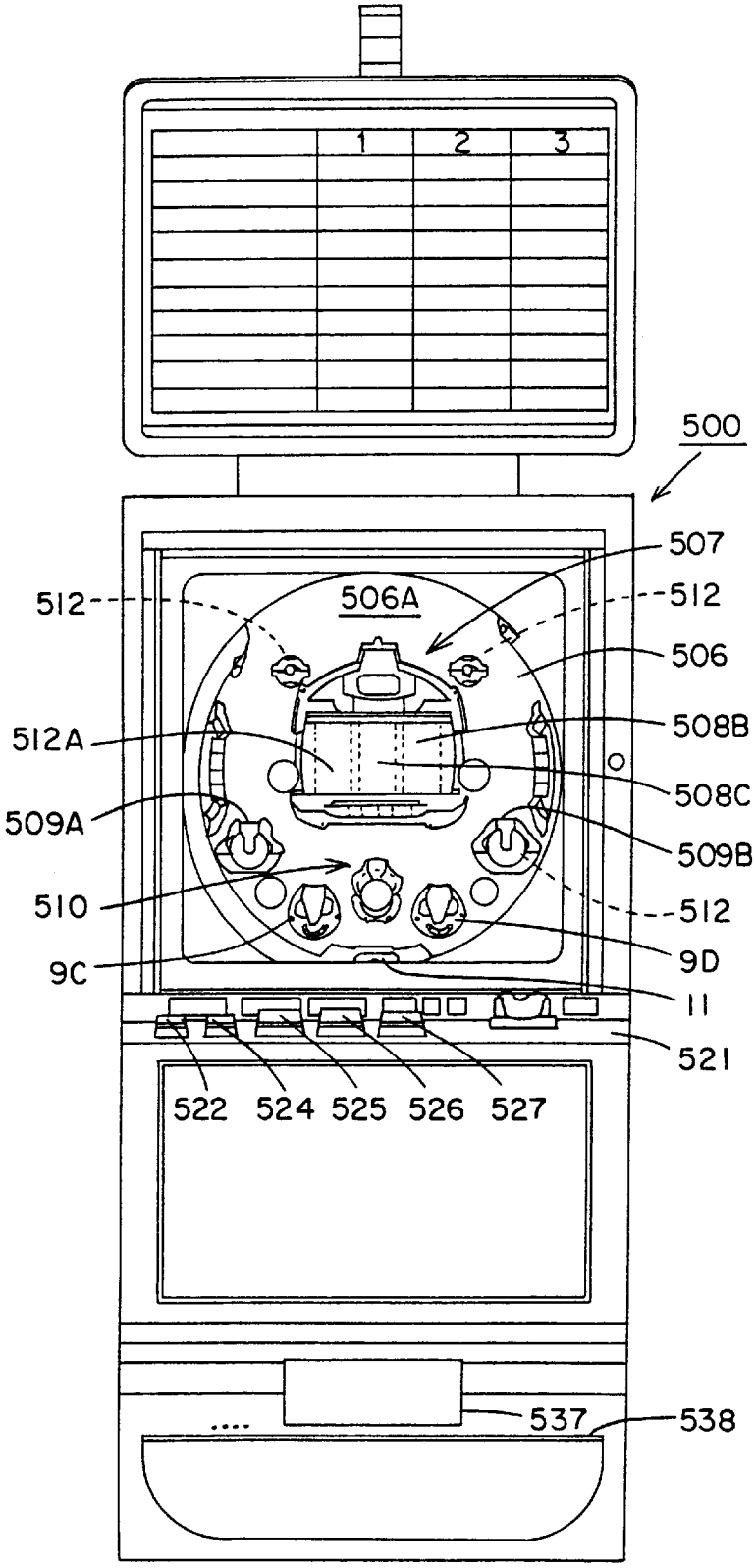
FIG. 61 PRIOR ART
FIG. 61 is a front view showing another conventional game machine.
Figure 62:
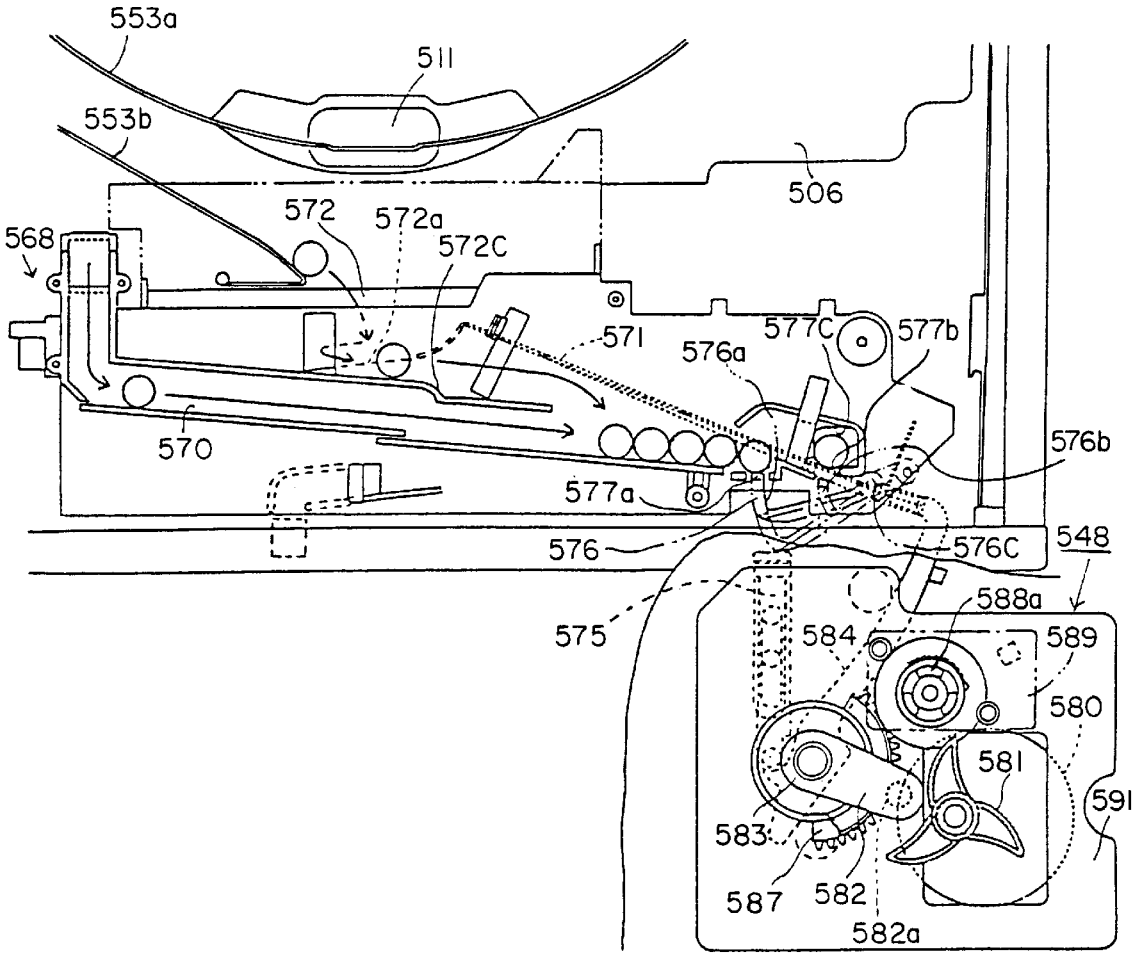
FIG. 62 PRIOR ART
FIG. 62 shows a ball store mechanism and a ball-shoot mechanism employed in the game machine of FIG. 61.
Figure 63:
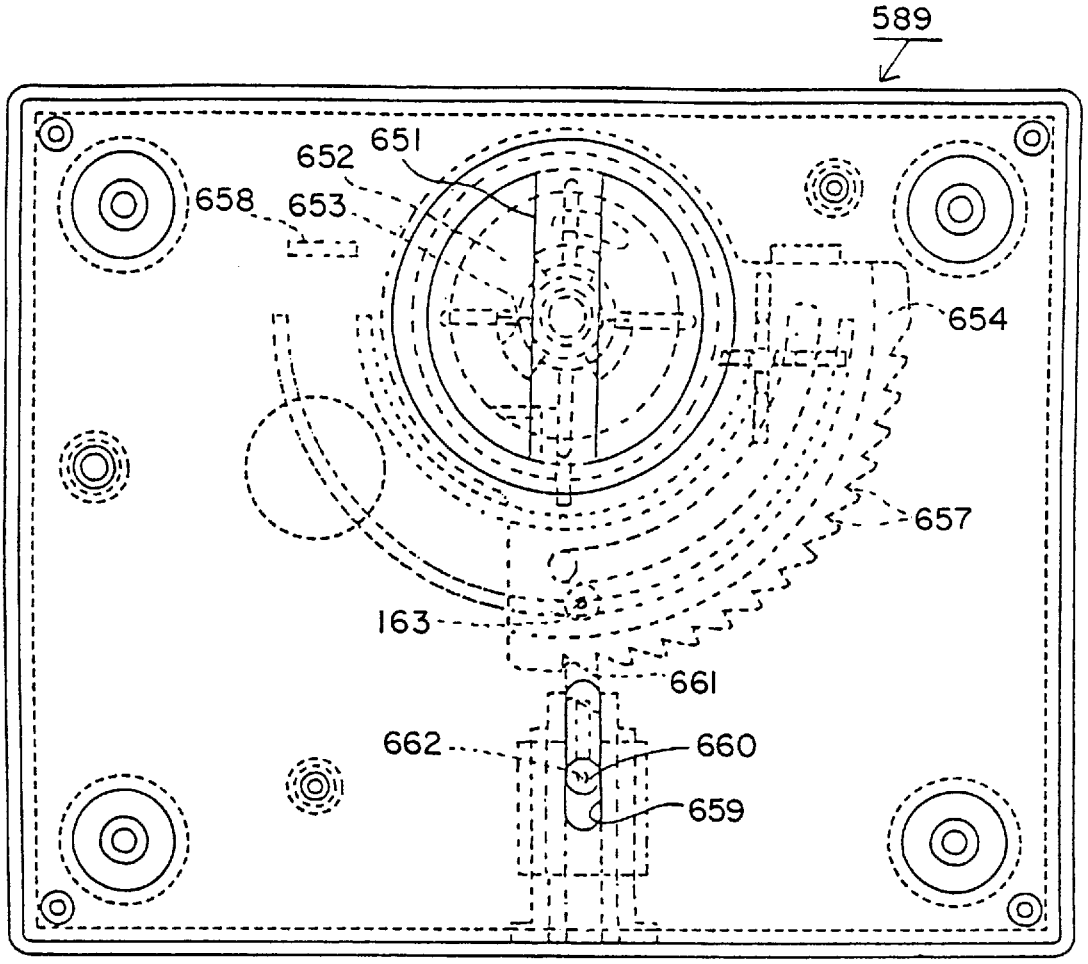
FIG. 63 PRIOR ART
FIG. 63 shows a structure of a flipping force fine-adjustment device used in the game machine of FIG. 61.

FIGS. 58 and 59 are flow charts of a menu screen displayed in a data display mode. When reset switch 15 is operated so as to enter a data display mode, a menu screen is displayed (S95). At step S96, determination is made whether any menu is selected. When no selection has been made, the process proceeds to step S98 to determine whether EXIT is selected or not. As described before, this operation is effected by depressing call button 20. When an exit operation is effected, the screen returns to the play field screen. When no selection operation is carried out, the process proceeds to step S96.

When any menu is selected at step S96, the selected content is displayed at step S97. Corresponding to the selection of a menu, a soft meter display (S99), a bill-insert data display (S100), a game replay data display (S101), an error statistical data display (S102), a dual in-line package switch setting data display (S103), a clear soft meter display (S104), a clear bill-insert data display (S105), a clear error statistical data display (S106), a RAM data clear display (S107), a display of design of display image (S111), and a self test display (S112) are provided. The screen returns to the menu display (S95) when a select operation of EXIT (S104, S113) is carried out during the display of S99, S100, S101, S102, S103, S111 and S112. Determination is made whether a clear operation is effected at step 108 during the display of S107, S106, S105, and S104. At step S109, a process for clearing data is carried out when a clear operation is specified. Then, the screen returns to the menu display at step S95. When CLEAR is not manipulated, determination is made whether EXIT is selected (S110). When a select operation is not carried out, the process proceeds to step S108, otherwise to step S95 to return to the menu display. The features and modifications of the above-described embodiment will be summarized in the following.

Image display type game machine 1 is provided including an image display apparatus that can present graphical representations of a play field including a plurality of win regions, and a flipped ball moving on the play field region. The image display apparatus is formed of a CRT 139 shown in FIG. 3 or 4. In image display type game machine 1, a game is initiated by depressing start button 24 or maximum-bet button 23. A graphical representation in which balls are automatically flipped into play field 7 at a predetermined interval is provided. The present invention is not limited to such a game machine. A game machine can be implemented including a ball flipping handle, wherein a graphical display is provided in which balls are flipped according to the operation of the flipped ball handle by a player. In this case, a flipping ball emission unit is implemented in which a graphical display of flipped balls being emitted according to the operation of the player via the flipping ball handle is provided. The image display apparatus is not limited to a CRT, and can include a display forming an image by liquid crystal, or other image display apparatuses.

A flipped ball emission display control unit is provided that presents a graphical representation of balls being flipped into a play field according to step S41–S45 of the flow chart of FIG. 55A. A value awarding unit for awarding a predetermined value is provided when an image display is presented indicating that a ball is flipped into any of the plurality of winning regions according to step S67 of the flow chart of FIG. 55C. A particular value awarding unit is provided to award a particular value to the player when a display is presented indicating that all the plurality of particular winning regions out of the plurality of winning regions have achieved hits by steps S61, S62, S63, S69, S56 and S58 of FIG. 55B. In the present embodiment, a particular value is awarded when a display is provided indicating that all the five pockets 30–34 have achieved a win. Alternatively, a particular value can be awarded when a particular two to four of the five pockets of the five pockets indicate a win. A particular winning graphical representation is provided as shown in the screen of FIG. 28.

A plurality of winning regions is displayed by the image display apparatus corresponding to pockets 30–34 of FIG. 2.

In image display type game machine 1, graphical representation is provided so that the flipped balls pass over the graphical representation of the variable display units of left reel 38*a*, middle reel 38*b*, and right reel 38*c*. In other words, the graphical image of the variable display device is also used as the region where the graphical representation of a flipped ball passed through. Therefore, the route of a flipped ball is not limited by the variable display device. The trajectory of the flipped ball can be represented in various routes. The screen can also be implemented so that the graphical representation of a flipped ball does not pass over the graphical representation of the variable display device. The region of the variable display device representing a state in which the graphical representation can be varied is provided by left reel 38*a*, middle reel 38*b*, and right reel 38*c* as the variable display graphical representation.

Generation of a pocket leechi, if any, is notified through loudspeaker 19. The graphical representation of flipped balls are shown in concentration in the proximity of the last pocket that requires a win to generate a big hit by a pocket jackpot. The last pocket is shown in a color different from the colors of the other pockets. Pocket win display region 41 is shown in a blinking manner to inform the player a generation of a leechi state more effectively. FIG. 16 shows a display screen when a pocket leechi state is generated.

When a screen is displayed as shown in FIG. 16 indicating that one more pocket is left to win to achieve a particular win display state, a semi-particular win display state is provided. The particular winning display is as shown in FIG. 28. The semi-particular winning display state, when attained, is notified according to the display state notify unit by steps S44 and S46 in the flow chart of FIG. 55A. Furthermore, a particular mode display control unit is provided according to steps S44 and S46 of the flow charts of FIG. 55A to provide control to display the play field or the movement of the flipped balls on the play field in a particular mode when the semi-particular win display state is achieved.

The variable display device that allows change in the graphical representation on the image display apparatus is implemented by left reel 38*a*, middle reel 38*b*, and right reel 38*c* of FIG. 2. The particular value award unit for awarding a particular value when the result of the graphical representations of the variable display device attains a particular display state is implemented by steps S55, S58, and S60 of the flow chart of FIG. 55B.

When the power of image display type game machine 1 is turned on, a system check, and then a game program (game control program) sum check, a graphic program (image control program) sum check, and a RAM data check are carried out. The result of the checking procedures are provided on the display. The game control program memory unit in which a game control program to control the game play state of image display type game machine 1 is stored is included in ROM 152 shown in FIG. 4. Similarly, the image control program memory unit in which a image control program for controlling the display of image display apparatus formed of CRT 139 is included in ROM 152. A data storage unit for storing data related to various game operations presented on a screen when image display type game machine 1 attains a data display mode is included in RAM 151. A game control program verification unit for determining whether the game control program is appropriate or not, an image control program verification unit for determining whether the image control program is appropriate or not, and a stored data verification unit for determining whether the data stored in the data storage unit is appropriate or not are implemented by the steps in the flow chart shown in FIG. 53. A display control unit for showing the determination results of the game control program verification means, the image control program verification means, and the storage data verification unit and also the cause of inappropriateness when power is turned on is implemented by steps S3 and S4 of FIG. 52.

An error determination unit for determining that there is a fault in the image display type game machine during a play, a game interrupt control unit for interrupting a game when determination of a fault is made by the error determination means, and a display control unit for showing the cause of the fault, when determined, on the image display apparatus are implemented by the steps in the flow chart of FIG. 57.

By manipulating switch 15 of image display type game machine 1, a menu screen of a data display mode is presented. The total number of coins paid out to the player that is unprofitable for the game house side, the total number of inserted coins spent by a player in playing games which becomes the profit for the game house side, and the machine game house side, and the machine profit which is the difference therebetween can be shown. The game house side can easily obtain information of the income and outgo. The value provided as the result of winning a game is the number of coins or the number of credit points. A total consumed value calculation unit for counting the total values used in a game, and the total awarded value calculation unit for counting the total number of values awarded to the player are implemented by ROM 152 shown in FIG. 4. A display control unit for displaying the game status of the image display type game machine calculated by the total consumed value calculation unit and the total awarded value calculation unit and the total on the image display apparatus when a personnel of the game machine carries out a predetermined operation is implemented by ROM 152.

A graphical representation corresponding to the type of bill inserted into bill acceptor 17 is indicated in play board screen display region 6 as shown in FIG. 7. A credit count according to the inserted bill is added to be displayed in earned point display unit 10 and credit count display unit 12 as shown in FIG. 8. As the added counting proceeds in the updated display, the graphical representation of the inserted bill is reduced in size. The graphical representation of the bill disappears from the screen simultaneous to the completion of the update of the addition. Also, a coin, when inserted, is shown in play board screen display region 6 and indicated in game bet display unit 13. The value display unit for showing the inserted bill or coin in play board screen display region 6 is implemented by CRT 139 of FIG. 3.

Play board screen display region 6 includes message display region 40*a* in which the amount to be paid to the player is shown, message display region 40*b* for indicating that a coin or a bill has been inserted, or that a big hit has been achieved, and message display region 40*c* in which a message prompting insertion of a coin or operation of the start button is provided. The message display unit for showing various messages in play board screen display region 6 is implemented by CRT 139 of FIG. 3. A message display region for providing a message according to the game status is formed of message display regions 40*a*, 40*b* and 40*c*.

By operating key switch 15 in image display type game machine 1, the screen can be switched to a menu display mode for showing data for maintenance. The switch operation unit for switching the display screen of the image display apparatus to the screen of the play field or menu of the data for maintenance is implemented by key switch 15. When in a menu display mode, the menu screen of FIG. 33 is provided on play board screen display region 6. By operating call button, 20, 1-bet button 22, start button 24, and maximum-bet button 23, the display can be switched from the menu screen to a predetermined menu display. The test operation unit for carrying out a testing of the operation of the image display type game machine 1 and the modification operation unit for modifying the setting of image display type game machine 1 are implemented by call button 20, 1-bet button 22, start button 24, and maximum-bet button 23.

Furthermore, the game operation unit used by the player in a game is implemented by these buttons. In other words, the test operation unit or the modification operation unit are used in a shared manner with the game operation means. The menus are classified according to the flow charts of FIGS. 58 and 59. The classified menus can be selected by the menu select unit. The classification memory unit storing classification of the menus shown in FIGS. 58 and 59 is implemented by ROM 152 shown in FIG. 4.

In the present embodiment, standard data of a game such as the limited number of coins that can be paid to a player from hopper 138 and a game cycle required for a one game unit can be selected and set via dual in-line package switch 145 shown in FIG. 3. The standard data input unit which becomes the reference for game control is implemented by dual in-line package switch 145.

The variable display control unit includes the random number generation unit for generating a random number used to determine a combination of stationary symbols. The random number generation unit is implemented by random number generator 155 shown in FIG. 4.

The variable display device includes a plurality of variable display units that can have the visual representation changed. A variable display unit is implemented by left reel 38*a*, middle reel 38*b*, or right reel 38*v*. The variable display control unit includes a display time control unit for showing the results of the plurality of variable display units at different time periods after the plurality of variable display units begins to change its visual representation.

At the generation of a reel leechi state as shown in FIGS. 18–20, a visual appearance different from that prior to generation of a reel leechi state is provided in a varying manner. The variable display control unit includes a particular variable display appearance control unit for providing display control of a variable display unit still providing a varying visual representation so as to attain a variable display appearance different from that of when the condition for attaining the predetermined particular visual appearance is not satisfied, in the event that the display result of a variable display unit already producing a stationary display result satisfies the condition of the predetermined particular visual appearance while a part of the plurality of variable display units is still providing a varying visual representation.

The player can operate 1-bet button 22 or maximum-bet button 23 to select 1, 2, or 3 coins as the stakes, i.e., the bet count for a game. When a game ends, credit according to the bet count is awarded to the player. Thus, the bet count setting unit for setting, to a desired value, the bet count that defines the dividend rate of the value awarded as a result of a game according to the operation of the player is implemented by 1-bet button 22 and maximum-bet button 23. The value award unit that awards a value to the player as a result of a game wherein the award rate of value is defined by the bet count set by the bet count setting unit is implemented by steps S58, S60, S63, S69 and S67 in the flow chart of FIGS. 55A and 55B. The bet count set by the bet count setting unit is shown in game bet count display unit 13. More specifically, the bet count display unit for showing the bet count set by the bet count setting unit is implemented by game bet count display unit 13.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image display type game machine including an image display apparatus that can provide an image display of a play field, a flipped ball moving in the play field, and a variable display device that can have a visual representation of the display changed, said image display type game machine comprising:

game starter condition detection means for detecting establishment of a predetermined game starter condition;

automatic ball-shoot display control means for providing an image display of said flipped ball automatically shooted and entered into said play field when said game starter condition detection means detects establishment of the game starter condition;

variable display control means for providing image display control of producing a display result after said variable display device begins to change the visual representations;

display result value award means for awarding a predetermined value to a player when a display result of said variable display device attains a predetermined particular visual appearance; and value display control means for providing a display of an amount of value awarded to a player on said image display apparatus by said display result value award means, wherein said value display control means controls displaying of a plurality of type of value images which differ in representation appearance in correspondence to the amount of value awarded to a player.

2. The image display type game machine according to claim 1, wherein an image display of a plurality of winning regions is provided in said play field, and further comprising particular value award means for awarding a particular value to a player when a particular winning image display is provided indicating that flipped balls have entered all of a predetermined number of particular winning regions out of said plurality of winning regions.

3. The image display type game machine according to claim 1, wherein said variable display control means provides image display control for producing a display result of said variable display device when said game starter condition detection means detects establishment of the game starter condition.

4. The image display type game machine according to claim 1, wherein said play field includes a message display region for providing a message display to a player according to a game play status.

5. The image display type game machine according to claim 1, further comprising:

data memory means for storing data associated with a game, and extra power supply means for supplying power to said data memory means at the time of power failure to maintain the data stored in said data memory means.

6. The image display type game machine according to claim 1, wherein said variable display control means comprises display result determination means for determining the display result of said variable display device, and display control means for providing control of display contents of said variable display device so that the display result determined by said display result determination means is provided.

7. The image display type game machine according to claim 6, wherein said variable display control means comprises random number generation means for generating a random number, and wherein said display result determination means determines said display result according to a random number generated by said random number generation means.

8. The image display type game machine according to claim 1, further comprising unitary game enable means in which the number of balls that can be shooted in a predetermined unitary game is predetermined for enabling a unitary game by providing a display of shooting balls within a range of said predetermined number of balls consuming a value required to play said unitary game.

9. The image display type game machine according to claim 8, further comprising:

value memory means in which a value of a predetermined monetary object is prestored to be used for a game, and repetition enable means for enabling repetition of said unitary game upon establishment of an enable condition based on a necessary condition which requires, when the value stored in said value memory means is used and said unitary game is played, the remaining amount of value stored in said value memory means is equal to or greater than the value required to play said unitary game.

10. The image display type game machine according to claim 8, wherein said unitary game enable means comprises shooting detection means for detecting shooting of a ball by said automatic ball-shoot display control means, counting means for counting the number of balls flipped into said play field according to a detection result of said shooting detection means, and shooting suppress means for suppressing shooting of a ball by said automatic ball-shoot display control means when a count value of said counting means reaches a value corresponding to said predetermined number of balls.

11. The image display type game machine according to claim 1, further comprising:

error determination means for determining that an error is generated in said image display type game machine during a game, game interrupt control means for interrupting a game when determination is made of an error generation by said error determination means, and display control means for displaying a cause of the error on said image display apparatus when determination is made of an error by said error determination means.

12. The image display type game machine according to claim 11, wherein said display control means provides display of said error cause in an image region where said play field is provided.

13. The image display type game machine according to claim 1, further comprising:

bet count setting means for setting, according to manipulation of a player, a bet count that defines a dividend rate of value awarded as a result of a game to a desired value, and value award means for awarding a value to a player as a result of a game play, wherein an award rate of said value is defined by the bet count set by said bet count setting means, wherein said automatic ball-shoot display control means provides an image display of shooting a ball towards said play field using the value of a predetermined monetary object, and wherein a consumption rate of the value of said monetary object used in said display is defined according to a predetermined bet count.

14. The image display type game machine according to claim 13, further comprising bet count display means for providing a display of the bet count set by said bet count setting means.

15. The image display type game machine according to claim 13, further comprising unitary game enable means in which the number of balls that can be shooted in a predetermined unitary game is predetermined for enabling a unitary game within a range of said predetermined number of balls consuming a value required to play said unitary game, wherein said unitary game enable means has the number of balls that can be shooted in an unitary game varied according to a bet count set by said bet count setting means.

16. The image display type game machine according to claim 1, further comprising:

a game control program memory unit in which a game control program for providing control of a game status of said image display type game machine is stored, an image control program memory unit in which an image control program for providing image control by said image display apparatus is stored, data storage means in which data associated with a game operation of said image display type game machine is stored, game control program verification means for determining whether said game control program is proper or not, image control program verification means for determining whether said image control program is proper or not, stored data verification means for determining whether the data stored in said data storage means is proper or not, and display control means for providing on said image display apparatus a display of determination results of said game control program verification means, said image control program verification means, and said stored data verification means, and also a cause of fault when determination is made of impropriety.

17. The image display type game machine according to claim 16, wherein said display control means provides a display of said determination result in an image region where said play field is provided.

18. The image display type game machine according to claim 16, wherein said display control means provides a display of said cause of impropriety in an image region where said play field is provided.

19. The image display type game machine according to claim 1, further comprising:

total consumed value calculation means for calculating the total number of capital value of a player consumed in a game, total awarded value calculation means for calculating the total number of values awarded to said player, and display control means for providing a display of a game result status calculated from said total consumed value calculation means and said total awarded value calculation means on said image display apparatus when a predetermined operation is carried out by a manager of the game machine.

20. The image display type game machine according to claim 19, wherein said display control means provide a display of a calculated result of said total awarded value calculation means on said image display apparatus.

21. The image display type game machine according to claim 19, wherein said display control means provides a display of a calculated result of said total consumed value calculation means on said image display apparatus.

22. The image display type game machine according to claim 1, wherein said game starter condition detection means comprises monetary object usage operation determination means for detecting that a predetermined operation is effected to use a value for using a value of a predetermined monetary object in a game.

23. The image display type game machine according to claim 22, wherein said monetary object usage operation determination means comprises a monetary object acceptor for accepting said monetary object, and monetary object acceptance detection means for detecting that a monetary object is accepted in said monetary object acceptor.

24. The image display type game machine according to claim 23, further comprising monetary object display control means for providing an image display indicating a type of a monetary object when acceptance of said monetary object is detected by said monetary object acceptance detection means.

25. The image display type game machine according to claim 23, further comprising unitary game time setting means for setting the time of a unitary game from the start to the end of said unitary game.

26. The image display type game machine according to claim 1, wherein said variable display device includes a plurality of variable display units that can have its display state changed, wherein said variable display control means comprises display time control means for providing a display result of said plurality of variable display units at different time periods after said plurality of variable display units begin to change its visual representation, and said image display type game machine further comprising notify means for notifying that a condition of said particular visual appearance is satisfied when a display result of a variable display unit that is already provided during a stage where a part of said plurality of variable display units is still providing a varying display satisfies the condition of said predetermined particular visual appearance.

27. The image display type game machine according to claim 1, wherein said variable display device comprises a plurality of variable display units that can have its display state changed, wherein said variable display control means comprises display time control means for providing a display result of said plurality of variable display units at different time periods after said plurality of variable display units begin to change its visual representation, and particular variable display appearance control means for providing a display control of a variable display unit still providing a varying visual representation so as to attain a variable display appearance different from that of when the condition for attaining said predetermined particular visual appearance is not satisfied, in the event that a display result of a variable display unit already providing a stationary display result satisfies the condition of said predetermined particular visual appearance while a part of said plurality of variable display units is still providing a varying visual representation.

28. The image display type game machine according to claim 1, further comprising game disable means for disabling a game when a display result of said variable display device attains a predetermined particular visual appearance.

29. The image display type game machine according to claim 1, wherein said variable display control means comprises display result determination means for determining a display result of said variable display device, and display control means for providing a control of contents of said variable display device so that the display result determined by said display result determination means is provided, wherein said display result value award means comprises result content determination means for determining whether the display result determined by said display result determination means is one that allows award of a value, wherein said result content determination means awards a value when determination is made that a value award is allowed.

30. The image display type game machine according to claim 1, wherein said result content determination means comprises win display result memory means in which a hit display result that allows a value to be awarded to a player out of the display results of said variable display device is stored, and display result comparing means for comparing the display result determined by said display result determination means and the win display result stored in said win display result memory means, wherein said display result value award means awards a value when the display result determined by said display result determination means matches the win display result stored in said win display result memory means as a result of comparison by said display result comparing means.

31. The image display type game machine according to claim 1, wherein said image display apparatus can also provide display of data for maintenance and administration, said image display type game machine further comprising switching operation means for switching the display image of said image display apparatus to said play field or said data for maintenance and administration.

32. The image display type game machine according to claim 31, wherein said data for maintenance and administration includes test data for testing propriety of operation of said image display type game machine, said image display type game machine further comprising test operation means for carrying out a test.

33. The image display type game machine according to claim 32, wherein said test operation means and said game operation means used for playing a game by a player are provided in a shared manner.

34. The image display type game machine according to claim 31, wherein said data for maintenance and administration includes setting data of said image display type game machine, said image display type game machine further comprising modify operation means for modifying the setting.

35. The image display type game machine according to claim 34, wherein said setting data includes data for setting a type of said ball.

36. The image display type game machine according to claim 34, wherein said setting data includes data for setting a type of coin that can be used for a game.

37. The image display type game machine according to claim 34, wherein said setting data includes data for setting a background color of said play field.

38. The image display type game machine according to claim 34, wherein said modify operation means and said game operation means used for playing a game by a player are provided in a shared manner.

39. An image display type game machine including an image display apparatus that can provide an image display of a play field with a plurality of winning regions and a flipped ball moving in said play field, said image display type game machine comprising:

ball-shoot display control means for providing an image display of a state in which a flipped ball is shooted and flipped into said play field, value award means for awarding a predetermined value when an image display is provided indicating entry of a flipped ball into any of said plurality of winning regions, and particular value award means for awarding a particular value when a particular winning image display is provided indicating entry of flipped balls into all particular predetermined number of winning regions out of said plurality of winning regions.

40. The image display type game machine according to claim 39, wherein said plurality of winning regions comprises a widen winning region that can be shown with a widen entrance to facilitate entry of a flipped ball, wherein said entrance of said widen winning region is increased when an image display is provided indicating entry of a flipped ball into said widen winning region.

41. The image display type game machine according to claim 39, wherein said play field comprises a display region for providing a display to a player to indicate which of said plurality of winning regions a flipped ball has entered.

42. The image display type game machine according to claim 39, further comprising:

winning status notify means for notifying achievement of a semiparticular winning display state when achieved, said semiparticular winning display state indicating that said particular winning image display will be provided if an image display is provided of a flipped ball entering one more winning region, and particular appearance display control means for providing control of display of said play field or a moving state of a flipped ball moving around in said play field in a particular appearance when said semiparticular winning display state is attained.

43. The image display type game machine according to claim 39, wherein said image display apparatus can further provide an image display of a variable display device that can have its display state changed, wherein said particular value award means provides a particular value when a display result of said variable display device shows a particular visual appearance.

44. The image display type game machine according to claim 43, further comprising:

unitary game enable means in which the number of balls that can be shooted in a predetermined unitary game is predetermined for enabling a unitary game within a range of said predetermined number of balls using a value required to play said unitary game, game result value memory means for storing a game result value awarded to a player as a result of said unitary game being played, monetary object dispense means for dispensing a predetermined monetary object to a player according to contents in said game result value memory means, and game disabled means for disabling a game when said particular winning image display is provided.

45. The image display type game machine according to claim 39, further comprising unitary game enable means in which the number of balls that can be shooted in a predetermined unitary game is predetermined for enabling a unitary game within a range of said predetermined number of balls using a value required to play said unitary game.

46. The image display type game machine according to claim 45, further comprising game result value memory means for storing a game result value awarded to a player as a result of said unitary game being played.

47. The image display type game machine according to claim 46, further comprising account operation means for settling the account of a game result, and game disable means for disabling a game under a condition that the stored value in said game result value memory means is equal to or greater than a predetermined value when said account operation means is manipulated.

* * * * *